US010675508B2

(12) United States Patent
Ortwig

(10) Patent No.: US 10,675,508 B2
(45) **Date of Patent: *Jun. 9, 2020**

(54) COUPLEABLE FIN APPARATUSES AND BOOT TOE BODIES

(71) Applicant: Cetatek Holdings Inc., Bowen Island (CA)

(72) Inventor: Jan Peter Ortwig, Bowen Island (CA)

(73) Assignee: Cetatek Holdings Inc., Bowen Island (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/789,747

(22) Filed: Oct. 20, 2017

(65) Prior Publication Data

US 2018/0133555 A1 May 17, 2018

Related U.S. Application Data

(63) Continuation-in-part of application No. PCT/CA2017/050044, filed on Jan. 13, 2017, which (Continued)

(51) Int. Cl.
*A63B 31/08* (2006.01)
*A63B 31/10* (2006.01)

(Continued)

(52) U.S. Cl.
CPC ..... *A63B 31/10* (2013.01); *A43B 3/24* (2013.01); *A43B 5/08* (2013.01); *A43B 5/18* (2013.01);

(Continued)

(58) Field of Classification Search
CPC ..... A63B 31/10; A63B 31/11; A43B 5/08; A43B 5/18; A43B 7/20; A43B 23/07; B63C 11/02

(Continued)

(56) References Cited

U.S. PATENT DOCUMENTS 1,607,857 A 11/1926 Zukal
3,171,142 A 3/1965 Auzols (Continued)

FOREIGN PATENT DOCUMENTS

CN 201220068 Y 4/2009
DE 55619 C 3/1891

(Continued)

OTHER PUBLICATIONS

"Aqua Lung Slingshot," Product Information, Aqua Lung International, Vista, Calif., as early as Feb. 14, 2008, <http://aqualung.com/us/content/view/226/282> [retrieved Jul. 12, 2013], 1 page.
"Cressi Scuba Diving Fins," Product Information, Cressi Sub S.p.A., Genoa, Italy, as early as Apr. 5, 2011, <http://www.cressisubusa.com/catalogue /index.asp?CategoriaID=101020> [retrieved Jul. 12, 2013], 3 pages.

(Continued)

*Primary Examiner* — Daniel V Venne
(74) *Attorney, Agent, or Firm* — Christensen O'Connor Johnson Kindness PLLC

(57) ABSTRACT

A method of coupling a boot toe body to a fin apparatus is disclosed. The fin apparatus includes a fin body coupled to a boot coupling body. The method involves connecting a first boot connector on a first end of the boot coupling body to a first complementary boot connector on a top side of the boot toe body, and connecting a second boot connector on a second end of the boot coupling body to a second complementary boot connector on a bottom side of the boot toe body. Boot toe bodies, fin apparatuses, and systems including the boot toe bodies and fin apparatuses are also disclosed.

54 Claims, 64 Drawing Sheets

Related U.S. Application Data is a continuation-in-part of application No. PCT/CA2015/051278, filed on Dec. 4, 2015, which is a continuation-in-part of application No. 14/171,288, filed on Feb. 3, 2014, now Pat. No. 9,737,762, which is a continuation of application No. 13/369,446, filed as application No. PCT/CA2011/000395 on Apr. 7, 2011, now Pat. No. 8,641,464, said application No. PCT/CA2015/051278 is a continuation-in-part of application No. 14/435,084, filed as application No. PCT/CA2012/000946 on Oct. 12, 2012, now Pat. No. 9,440,114, said application No. PCT/CA2017/050044 is a continuation-in-part of application No. 14/171,288, filed on Feb. 3, 2014, now Pat. No. 9,737,762, which is a continuation of application No. 13/639,446, filed as application No. PCT/CA2011/000395 on Apr. 7, 2011, now Pat. No. 8,641,464, application No. 15/789,747, which is a continuation-in-part of application No. 15/666,206, filed on Aug. 1, 2017, which is a continuation of application No. 14/171,288, filed on Feb. 3, 2014, now Pat. No. 9,737,762, which is a continuation of application No. 13/639,446, filed as application No. PCT/CA2011/000395 on Apr. 7, 2011, now Pat. No. 8,641,464.

(60) Provisional application No. 62/412,603, filed on Oct. 25, 2016, provisional application No. 62/281,890, filed on Jan. 22, 2016, provisional application No. 62/088,387, filed on Dec. 5, 2014, provisional application No. 61/322,104, filed on Apr. 8, 2010.

(51) Int. Cl.

| | |
|---|---|
| ***A43B 5/08*** | (2006.01) |
| ***B63C 11/02*** | (2006.01) |
| ***A43B 23/07*** | (2006.01) |
| ***A43B 5/18*** | (2006.01) |
| ***A43B 7/20*** | (2006.01) |
| ***A63B 31/11*** | (2006.01) |
| ***A43B 3/24*** | (2006.01) |

(52) U.S. Cl.

CPC ..... *A43B 7/20* (2013.01); *A43B 23/07* (2013.01); *A63B 31/11* (2013.01); *B63C 11/02* (2013.01); *Y10T 29/49716* (2015.01)

(58) Field of Classification Search

USPC ..... 441/61, 63, 64

See application file for complete search history.

(56) References Cited

U.S. PATENT DOCUMENTS

| | | | | |
|---|---|---|---|---|
| 3,183,529 | A | 5/1965 | Beuchat | |
| 3,302,223 | A | 2/1967 | Ciccotelli | |
| 3,315,286 | A | 4/1967 | Brion | |
| 3,422,470 | A | 1/1969 | Mares | |
| 3,521,312 | A | 7/1970 | Ganev | |
| 3,922,741 | A | 12/1975 | Semeia | |
| 3,978,537 | A | 9/1976 | Shamlian | |
| 4,025,977 | A | 5/1977 | Cronin | |
| 4,264,994 | A | 5/1981 | Carbone | |
| D266,265 | S | 9/1982 | Bowden | |
| 4,538,480 | A | 9/1985 | Trindle | |
| 4,642,056 | A | 2/1987 | Keivanjah | |
| 4,657,515 | A | 4/1987 | Ciccotelli | |
| 4,677,769 | A | 7/1987 | Ahmad | |
| 4,689,029 | A | 8/1987 | Ciccotelli | |
| 4,738,645 | A | 4/1988 | Garofalo | |
| 4,752,259 | A | 6/1988 | Tackett et al. | |
| 4,775,343 | A | 10/1988 | Lamont | |
| 4,807,372 | A | 2/1989 | McCall | |
| 4,869,696 | A | 9/1989 | Ciccotelli | |
| 4,887,985 | A | 12/1989 | Garofalo | |
| 5,041,039 | A | 8/1991 | Chang | |
| 5,163,859 | A | 11/1992 | Beltrani | |
| 5,242,321 | A | 9/1993 | Gil | |
| 5,292,272 | A | 3/1994 | Grim | |
| 5,295,701 | A | 3/1994 | Reiber | |
| 5,303,940 | A | 4/1994 | Brandner | |
| 5,304,081 | A | 4/1994 | Takizawa | |
| 5,324,219 | A | 6/1994 | Beltrani | |
| 5,331,752 | A | 7/1994 | Johnson | |
| D355,012 | S | 1/1995 | Robertson | |
| 5,401,196 | A | 3/1995 | Triantafyllou | |
| 5,443,593 | A | 8/1995 | Garofalo | |
| 5,447,457 | A | 9/1995 | Kamitani | |
| 5,452,907 | A | 9/1995 | Meibock | |
| 5,507,506 | A | 4/1996 | Shadroui | |
| 5,527,196 | A | 6/1996 | Harkins | |
| 5,531,621 | A | 7/1996 | Johnson | |
| 5,545,067 | A | 8/1996 | Garofalo | |
| 5,551,728 | A | 9/1996 | Barthel | |
| 5,572,806 | A | 11/1996 | Osawa | |
| 5,588,890 | A | 12/1996 | Garofalo | |
| 5,593,333 | A | 1/1997 | Johnson | |
| 5,607,334 | A | 3/1997 | Garofalo | |
| 5,630,775 | A | 5/1997 | Raasch | |
| 5,632,662 | A | 5/1997 | Cadorette | |
| 5,683,279 | A | 11/1997 | Raasch | |
| 5,716,250 | A | 2/1998 | Garofalo | |
| 5,722,867 | A | 3/1998 | LaGrow | |
| 5,746,016 | A | 5/1998 | Freisinger | |
| 5,746,631 | A | 5/1998 | McCarthy | |
| 5,766,050 | A | 6/1998 | Maggi | |
| 5,797,608 | A | 8/1998 | Haldemann | |
| 5,813,889 | A | 9/1998 | Perry | |
| 5,820,428 | A | 10/1998 | Stadler | |
| 5,879,212 | A | 3/1999 | Kennedy | |
| 5,941,747 | A | 8/1999 | Garofalo | |
| 6,053,788 | A | 4/2000 | Garofalo | |
| 6,109,990 | A | 8/2000 | Lundberg | |
| 6,120,038 | A | 9/2000 | Dong | |
| 6,120,336 | A | 9/2000 | Kawai | |
| 6,126,502 | A | 10/2000 | Hull | |
| 6,126,503 | A | 10/2000 | Viale | |
| 6,129,601 | A | 10/2000 | Aucoin | |
| 6,146,224 | A | 11/2000 | McCarthy | |
| 6,155,898 | A * | 12/2000 | Burns | A63B 31/11 441/64 |
| 6,179,675 | B1 | 1/2001 | Godoy | |
| 6,227,923 | B1 * | 5/2001 | Johnson | A63B 31/11 441/61 |
| 6,247,982 | B1 | 6/2001 | Walker | |
| 6,290,561 | B1 | 9/2001 | Garofalo | |
| 6,322,411 | B1 | 11/2001 | Evans | |
| 6,322,412 | B2 | 11/2001 | Viale | |
| 6,364,728 | B1 | 4/2002 | Viale | |
| 6,398,604 | B1 | 6/2002 | Kawashima et al. | |
| 6,401,256 | B1 | 6/2002 | Shreve | |
| 6,540,574 | B2 | 4/2003 | Hashizume | |
| 6,568,973 | B2 | 5/2003 | Testa | |
| 6,568,974 | B2 | 5/2003 | Semeia | |
| 6,568,975 | B1 | 5/2003 | Perry | |
| 6,672,920 | B2 | 1/2004 | Wilson | |
| 6,702,633 | B1 | 3/2004 | Johnson | |
| 6,719,599 | B2 | 4/2004 | McCarthy | |
| 6,758,708 | B2 | 7/2004 | Angelini | |
| 6,814,640 | B1 | 11/2004 | Houck | |
| 6,843,693 | B2 | 1/2005 | McCarthy | |
| 6,884,134 | B2 | 4/2005 | McCarthy | |
| 7,007,626 | B2 | 3/2006 | Hobson | |
| 7,048,601 | B2 | 5/2006 | Sclafani | |
| 7,086,916 | B2 | 8/2006 | Godoy | |
| 7,115,011 | B2 | 10/2006 | Chen | |
| 7,124,476 | B2 | 10/2006 | Garofalo | |
| 7,134,927 | B1 | 11/2006 | Johnson | |
| 7,140,937 | B2 | 11/2006 | Cadorette | |
| 7,159,336 | B2 | 1/2007 | Burns | |
| 7,172,480 | B2 | 2/2007 | Abbott | |

(56) References Cited

U.S. PATENT DOCUMENTS

| | | | | |
|---|---|---|---|---|
| D561,862 | S | 2/2008 | Moyal | |
| D561,863 | S | 2/2008 | Moyal | |
| 7,462,085 | B2 | 12/2008 | Moyal | |
| 7,470,164 | B2 | 12/2008 | Moyal | |
| 7,601,041 | B2 | 10/2009 | McCarthy | |
| 7,815,477 | B2 | 10/2010 | Garofalo | |
| 7,988,510 | B2 | 8/2011 | Beltrani | |
| 8,087,959 | B2 * | 1/2012 | Hsu | A63B 31/11 24/614 |
| 8,376,796 | B1 | 2/2013 | Vock | |
| 8,641,464 | B2 * | 2/2014 | Ortwig | A43B 5/08 441/64 |
| 9,440,114 | B2 | 9/2016 | Ortwig | |
| 9,737,762 | B2 | 8/2017 | Ortwig | |
| 9,770,627 | B2 | 9/2017 | Herring | |
| 10,112,079 | B2 * | 10/2018 | Ortwig | A43B 5/08 |
| 2005/0153607 | A1 * | 7/2005 | Burns | A63B 31/11 441/63 |
| 2005/0221698 | A1 | 10/2005 | Sclafani | |
| 2007/0004295 | A1 | 1/2007 | Rocci | |
| 2007/0032144 | A1 | 2/2007 | Ketterman | |
| 2007/0077831 | A1 | 4/2007 | Kuo | |
| 2008/0185816 | A1 | 8/2008 | Riepler | |
| 2010/0029153 | A1 | 2/2010 | Testa | |
| 2010/0075554 | A1 | 3/2010 | Johnson | |
| 2011/0065343 | A1 * | 3/2011 | Hsu | A63B 31/11 441/63 |
| 2011/0312231 | A1 | 12/2011 | Montemurro | |
| 2013/0059492 | A1 | 3/2013 | Ortwig | |
| 2015/0231449 | A1 | 8/2015 | Ortwig | |
| 2016/0243405 | A1 * | 8/2016 | Herring | A63B 31/11 |

FOREIGN PATENT DOCUMENTS

| | | | |
|---|---|---|---|
| DE | 84 22 316.2 | U1 | 11/1984 |
| DE | 90 17 320.1 | U1 | 4/1991 |
| DE | 40 40 985 | C1 | 6/1992 |
| DE | 296 22 809 | U1 | 8/1997 |
| DE | 196 13 208 | A1 | 10/1997 |
| DE | 196 33 905 | A1 | 10/1997 |
| DE | 196 54 899 | A1 | 11/1997 |
| DE | 197 00 497 | A1 | 7/1998 |
| DE | 197 26 109 | A1 | 7/1998 |
| DE | 101 52 438 | A1 | 4/2003 |
| DE | 10 2011 112980 | A1 | 3/2013 |
| EP | 0 310 828 | B1 | 11/1991 |
| EP | 0 572 853 | A1 | 8/1993 |
| EP | 0 884 073 | A2 | 12/1998 |
| EP | 0 890 375 | A1 | 1/1999 |
| EP | 1 297 869 | A1 | 4/2003 |
| EP | 1 389 483 | B1 | 2/2004 |
| EP | 1 591 145 | A1 | 11/2005 |
| EP | 2 058 032 | A1 | 5/2009 |
| FR | 2 659 534 | A1 | 9/1991 |
| FR | 2 659 862 | A1 | 9/1991 |
| FR | 2 705 245 | A1 | 11/1994 |
| FR | 2 725 880 | A1 | 4/1996 |
| FR | 2 794 374 | A1 | 12/2000 |
| GB | 1 033 304 | A | 6/1966 |
| WO | 88/01523 | A1 | 3/1988 |
| WO | 91/16957 | A1 | 11/1991 |
| WO | 95/03101 | A1 | 2/1995 |
| WO | 97/36655 | A1 | 10/1997 |
| WO | 97/49603 | A1 | 12/1997 |
| WO | 98/30294 | A1 | 7/1998 |
| WO | 99/47013 | A1 | 9/1999 |
| WO | 00/78606 | A1 | 12/2000 |
| WO | 02/47776 | A2 | 6/2002 |
| WO | 2006/058849 | A1 | 6/2006 |
| WO | 2007/138367 | A1 | 12/2007 |
| WO | 2008/087589 | A1 | 7/2008 |
| WO | 2011/080432 | A1 | 7/2011 |
| WO | 2011/123950 | A1 | 10/2011 |
| WO | 2011/134066 | A1 | 11/2011 |
| WO | 2014/056066 | A1 | 4/2014 |
| WO | 2016/086319 | A1 | 6/2016 |
| WO | 2017/124181 | A1 | 7/2017 |

OTHER PUBLICATIONS

Extended European Search Report dated Aug. 1, 2013, in related European Application No. 11 764 992.1, filed Apr. 7, 2011, 5 pages.

International Search Report dated Jul. 12, 2013, issued in related International Application No. PCT/CA2012/000946, filed Oct. 12, 2012, 2 pages.

"Lundblue: Lunocet—Pioneering Biomimetic Propulsion," Product Sheet, Ciamillo Components, Inc., Nicholson, Ga., <http://www.lunocet.com/> [retrieved Jan. 1, 2010], 1 page.

McKenzie, J., "Two Mares Fins: The Volo Power Is Still Strong and the Next Gen X-Stream Is High Tech," Jul. 28, 2011, ScubaGadget, Scuba News Service, <http://www.scubagadget.com/?p=1555> [retrieved Jan. 16, 2013], 4 pages.

"Omega Aquatics Amphibian Fins," Product Information, Soldier Systems: An Industry Daily, Jul. 11, 2008, <http://soldiersystems.net/2008/07/11/omega-aquatics-amphibian-fins/> [retrieved Jan. 17, 2013], 2 pages.

"Open Heel—Mares," Product Information, Mares S.p.A., Rapallo, Italy, <http://www.mares.com/products/fins/open-heel/?region=eu> [retrieved Jan. 16, 2013], 2 pages.

"Scuba Dive Fins," Product Information, Waikiki Dive Centre, Singapore, <http://www.waikikidive.com/TUSA_MARES_FINS.htm> [retrieved Jan. 16, 2013], 7 pages.

"TUSA Fins," Product Information,TUSA (Tabata USA), Tokyo, as early as Jul. 23, 2012, <http://tusa.com/us-en/Tusa/Fins> [retrieved Jul. 12, 2013], 7 pages.

"X-Stream—Open Heel—Mares—Just Add Water," Product Sheet, Mares S.p.A., Rapallo, Italy, <http://www.mares.com/products/tins/open-heel/x-stream/241/?region=eu> [retrieved Nov. 21, 2012], 1 page.

International Search Report dated Mar. 11, 2016, issued in corresponding International Application No. PCT/CA2015/051278, filed Dec. 4, 2015, 4 pages.

Extended European Search Report dated Jul. 10, 2018, issued in corresponding European Application No. 15864622.4, filed Dec. 4, 2015, 7 pages.

International Search Report and Written Opinion dated Apr. 25, 2017, issued in corresponding International Application No. PCT/CA2017/050044, filed Jan. 13, 2017, 9 pages.

"Finclip, Don/Doff Your Scuba Diving Fins the Easiest Way," Mar. 31, 2017, Kickstarter, PBC, <https://www.kickstarter.com/projects/189900848/finclip-don-doff-your-scuba-diving-fins-the-easies> [retrieved Nov. 21, 2017], 3 pages.

International Search Report and Written Opinion dated Jan. 24, 2019, issued in corresponding International Application No. PCT/CA2018/051330, filed Oct. 19, 2018, 9 pages.

* cited by examiner

COUPLEABLE FIN APPARATUSES AND BOOT TOE BODIES

CROSS-REFERENCE TO RELATED APPLICATIONS

This application is a continuation-in-part of U.S. patent application Ser. No. 15/533,367 filed Jun. 5, 2017, which is a national stage entry of PCT international application No. PCT/CA2017/050044 filed Jan. 13, 2017, which claims the benefit of U.S. provisional patent application No. 62/281,890 filed Jan. 22, 2016 and U.S. provisional patent application No. 62/412,603 filed Oct. 25, 2016. Further, PCT international application No. PCT/CA2017/050044 is a continuation-in-part of PCT international application No. PCT/CA2015/051278 filed Dec. 4, 2015, which: claims the benefit of U.S. provisional patent application No. 62/088,387 filed Dec. 5, 2014; is a continuation-in-part of U.S. patent application Ser. No. 14/171,288 (now U.S. Pat. No. 9,737,762) filed Feb. 3, 2014, which is a continuation of U.S. patent application Ser. No. 13/639,446 (now U.S. Pat. No. 8,641,464) filed Oct. 4, 2012, which is a national stage entry of PCT international application No. PCT/CA2011/000395 filed Apr. 7, 2011, which claims the benefit of U.S. provisional patent application No. 61/322,104 filed Apr. 8, 2010; and is a continuation-in-part of U.S. patent application Ser. No. 14/435,084 (now U.S. Pat. No. 9,440,114) filed Apr. 10, 2015, which is a national stage entry of PCT international application No. PCT/CA2012/000946 filed Oct. 12, 2012. Further, PCT international application No. PCT/CA2017/050044 is a continuation-in-part of U.S. patent application Ser. No. 14/171,288, which is a continuation of U.S. patent application Ser. No. 13/639,446, which is a national stage entry of PCT international application No. PCT/CA2011/000395, which claims the benefit of U.S. provisional patent application No. 61/322,104. This application is also a continuation-in-part of U.S. patent application Ser. No. 15/666,206 filed Aug. 1, 2017, which is a continuation of U.S. patent application Ser. No. 14/171,288, which is a continuation of U.S. patent application Ser. No. 13/639,446, which is a national stage entry of PCT international application No. PCT/CA2011/000395, which claims the benefit of U.S. provisional patent application No. 61/322,104.

The entire contents of U.S. provisional patent application No. 61/322,104, of PCT international application No. PCT/CA2011/000395, of U.S. patent application Ser. No. 13/639,446, of PCT international application No. PCT/CA2012/000946, of U.S. patent application Ser. No. 14/171,288, of U.S. provisional patent application No. 62/088,387, of U.S. patent application Ser. No. 14/435,084, of PCT international application No. PCT/CA2015/051278, of U.S. provisional patent application No. 62/281,890, of U.S. provisional patent application No. 62/412,603, of PCT international application No. PCT/CA2015/051278, of PCT international application No. PCT/CA2017/050044, of U.S. patent application Ser. No. 15/533,367, and of U.S. patent application Ser. No. 15/666,206 are incorporated by reference herein in their entireties.

FIELD

This disclosure relates generally to fins, and more particularly to fin apparatuses coupleable to boot toe bodies, boot toe bodies coupleable to fin apparatuses, systems including coupleable fin apparatuses and boot toe bodies, and methods of coupling fin apparatuses and boot toe bodies.

RELATED ART

A user can couple a known fin to each foot of the user. When the user kicks in water, for example, the fins can facilitate generating propulsion in the water.

Many known fins have foot pockets for receiving a foot of a user, but such foot pockets are generally integral to the fin and available only in a small number of standard sizes because, for example, costs to manufacture and distribute entire fins with a large variety of foot sizes and shapes would be very high. Therefore, when a user selects such a fin, the user must also select a single foot pocket size of the fin, often from among a small number of available sizes. Therefore, such foot pockets often do not comfortably fit a foot of a user, and space between the foot and an inside wall of the foot pocket can receive water, disadvantageously adding to drag of the fin in water and limiting the control of the user over the fin. Other known fins include alternatives to foot pockets, but such known alternatives may still require a user to choose from small number of standard sizes because, for example, of potentially high manufacturing and distribution costs for a large variety of foot sizes.

SUMMARY

According to one embodiment, there is disclosed a method of coupling a boot toe body to a fin apparatus comprising a fin body coupled to a boot coupling body, the method comprising: connecting a first boot connector on a first end of the boot coupling body to a first complementary boot connector on a top side of the boot toe body; and connecting a second boot connector on a second end of the boot coupling body to a second complementary boot connector on a bottom side of the boot toe body.

According to another embodiment, there is disclosed a fin apparatus coupleable to a boot toe body, the apparatus comprising: a fin body; and a boot coupling body coupleable to the fin body. The boot coupling body comprises: first and second ends; a first boot connecting means on the first end of the boot coupling body for connecting with a first complementary boot connecting means on a top side of the boot toe body; and a second boot connecting means on the second end of the boot coupling body for connecting with a second complementary boot connecting means on a bottom side of the boot toe body.

According to another embodiment, there is disclosed a boot toe body coupleable to a fin apparatus comprising a fin body coupleable to a boot coupling body comprising first and second ends, the boot toe body comprising: a first boot connecting means on a top side of the boot toe body for connecting with a first complementary boot connecting means on the first end of the boot coupling body; and a second boot connecting means on a bottom side of the boot toe body for connecting with a second complementary boot connecting means on the second end of the boot coupling body.

According to another embodiment, there is disclosed a fin system comprising the apparatus and the boot toe body.

According to another embodiment, there is disclosed a fin apparatus coupleable to a boot toe body, the apparatus comprising: a fin body; and a boot coupling body coupleable to the fin body. The boot coupling body comprises: first and second ends; a first boot connector on the first end of the boot coupling body for connecting with a first complementary boot connector on a top side of the boot toe body; and a second boot connector on the second end of the boot coupling body for connecting with a second complementary boot connector on a bottom side of the boot toe body.

According to another embodiment, there is disclosed a boot toe body coupleable to a fin apparatus coupleable to a boot coupling body comprising first and second ends, the boot toe body comprising: a first boot connector on a top side of the boot toe body for connecting with a first complementary boot connector on the first end of the boot coupling body; and a second boot connector on a bottom side of the boot toe body for connecting with a second complementary boot connector on the second end of the boot coupling body.

According to another embodiment, there is disclosed a fin system comprising the apparatus and the boot toe body.

Other aspects and features will become apparent to those ordinarily skilled in the art upon review of the following description of illustrative embodiments in conjunction with the accompanying figures.

DETAILED DESCRIPTION

Figure 1:
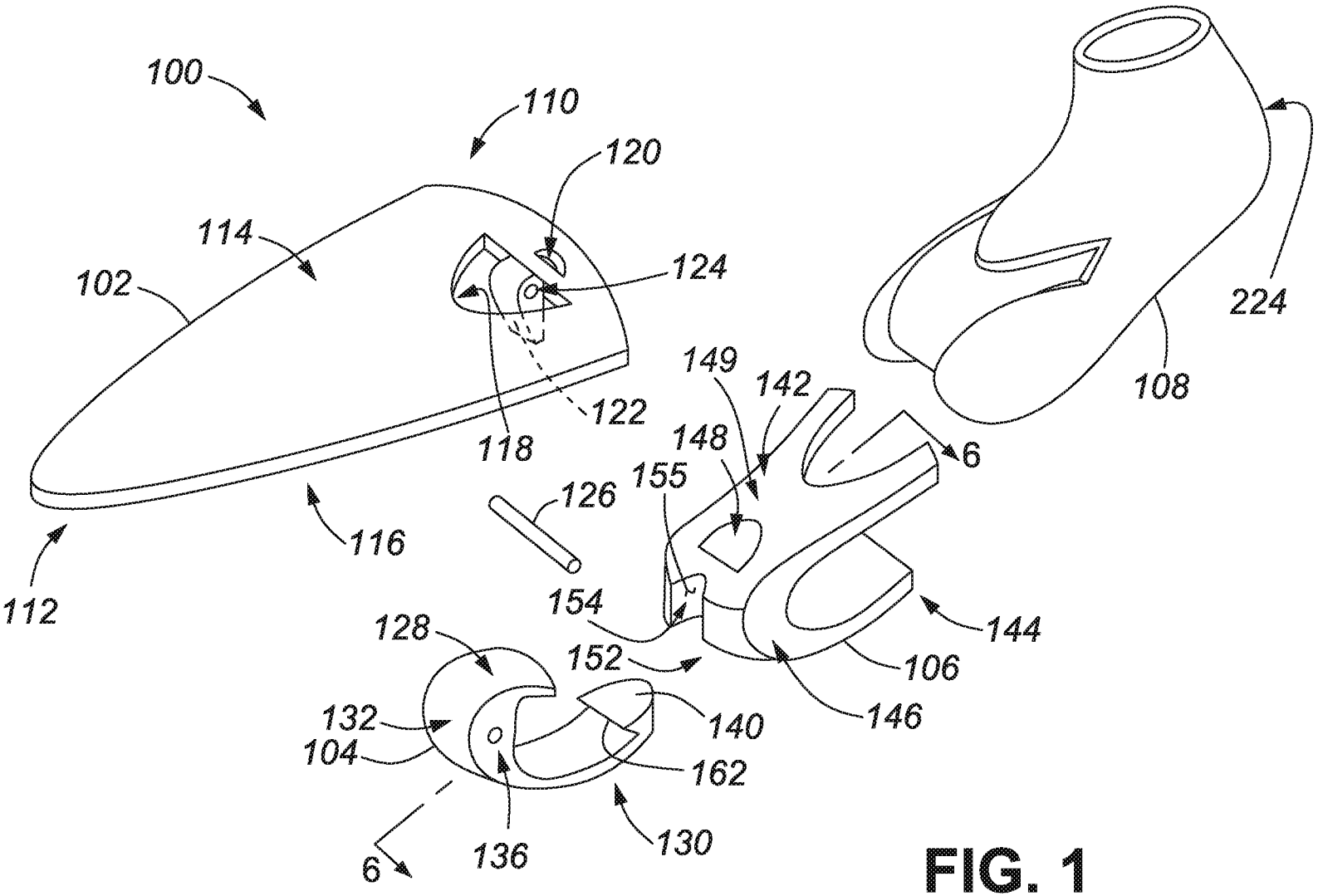
FIG. 1 is an exploded top perspective view of a fin system according to an embodiment.

Referring to FIG. 1, a fin system according to an embodiment is shown generally at 100 and includes a fin body 102, a boot coupling body 104, a boot toe body 106, and a boot 108.

The fin body 102 has a proximal end shown generally at 110 and configured to be coupled to the boot coupling body 104 and the boot toe body 106 as described below. The fin body 102 also has a distal end shown generally at 112 opposite the proximal end 110. The fin body 102 has a top side shown generally at 114 and a bottom side shown generally at 116.

When a user wearing the fin body 102 walks on a surface, the bottom side 116 generally faces downward and therefore generally contacts the surface. In general, the "bottom" side herein refers to a side that faces downward and generally contacts a surface when a user walks on the surface. However, when using the fin body 102 in water, a user may face downward, so a "bottom" side of a fin herein refers to a surface that generally faces upward when in use by a swimmer facing downward. Further, a "bottom view" herein generally refers to a view of such a "bottom" side, so in the case of a fin in use, a "bottom view" herein generally refers to a view from above. Conversely, a "top" side of a fin herein refers to a surface that generally faces downward when in use by a swimmer facing downward, and a "top view" herein generally refers to a view of such a "top" side, so in the case of a fin in use, a "top view" herein generally refers to a view from below.

The fin body 102 also defines a first through-opening shown generally at 118 and extending between the top side 114 and the bottom side 116, and a second through-opening shown generally at 120 and extending between the top side 114 and the bottom side 116. The fin body 102 includes a retainer 122 positioned in the through-opening 118 and extending out of the bottom side 116. The retainer 122 defines a generally transverse through-opening shown generally at 124 to receive a fastener 126 as described below. The retainer 122 may be made from a relatively rigid thermoplastic material, for example, and the fastener 126 may be a metallic rivet, for example.

Herein, a "relatively rigid thermoplastic material" may refer to a thermoplastic material having a modulus of elasticity of about 100 megapascals (MPa) to about 500 MPa, for example. The parts described herein may be made from various materials including thermoplastic materials such as thermoplastic polyurethane, polypropylene, polyamides, thermoplastic elastomers, styrene-butadiene-styrene, styrene-ethylene-butadiene-styrene, ethylene, polyolefine, acetal resin, polyoxymethylene plastic such as DELRIN™ or DELRIN 107™, and/or combinations of two or more thereof, for example. These thermoplastic materials may also be fiber-infused, and/or include composite matrix materials including glass and/or carbon fibers, for example.

Figure 2:
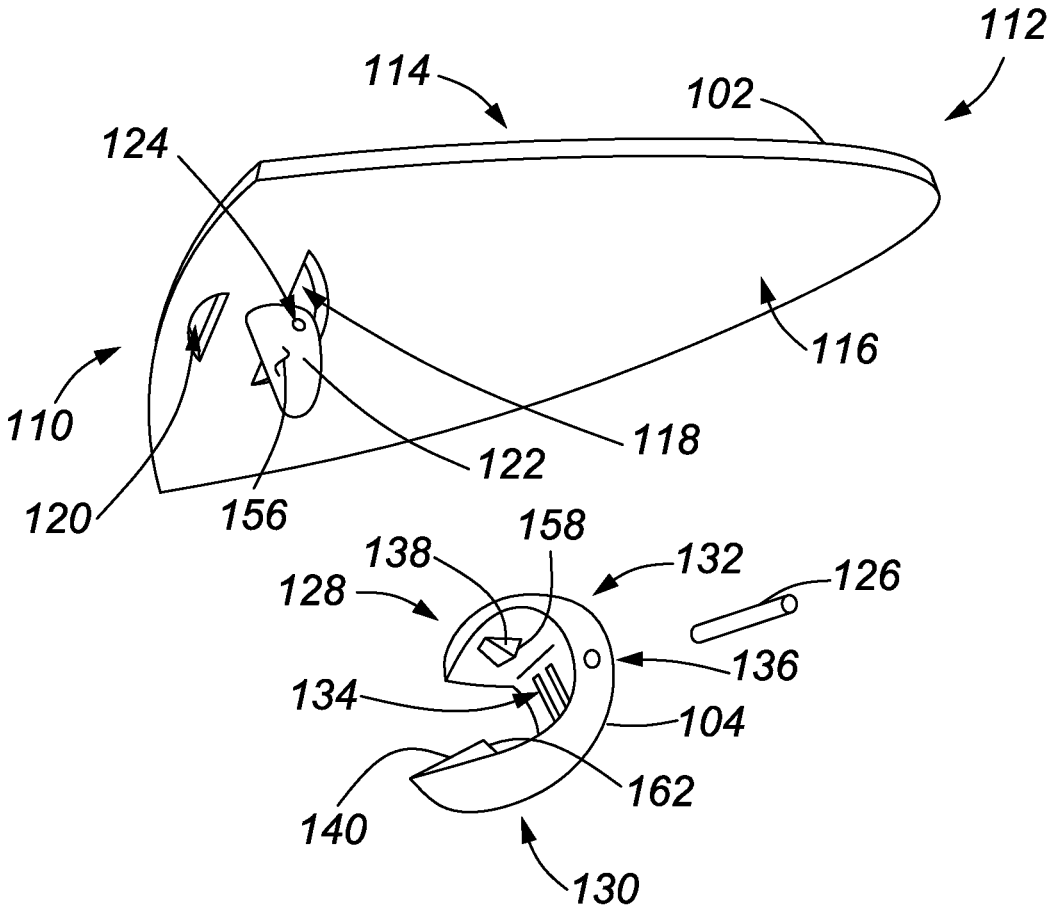
FIG. 2 is an exploded bottom perspective view of a fin apparatus including a fin body, a boot coupling body, and a fastener of the fin system of FIG. 1.

Referring to FIGS. 1 and 2, the boot coupling body 104 is curved in a generally-semi-circular shape having a top portion shown generally at 128, a bottom portion shown generally at 130, and an intermediate portion shown generally at 132 and extending between the top portion 128 and the bottom portion 130.

Figure 3:
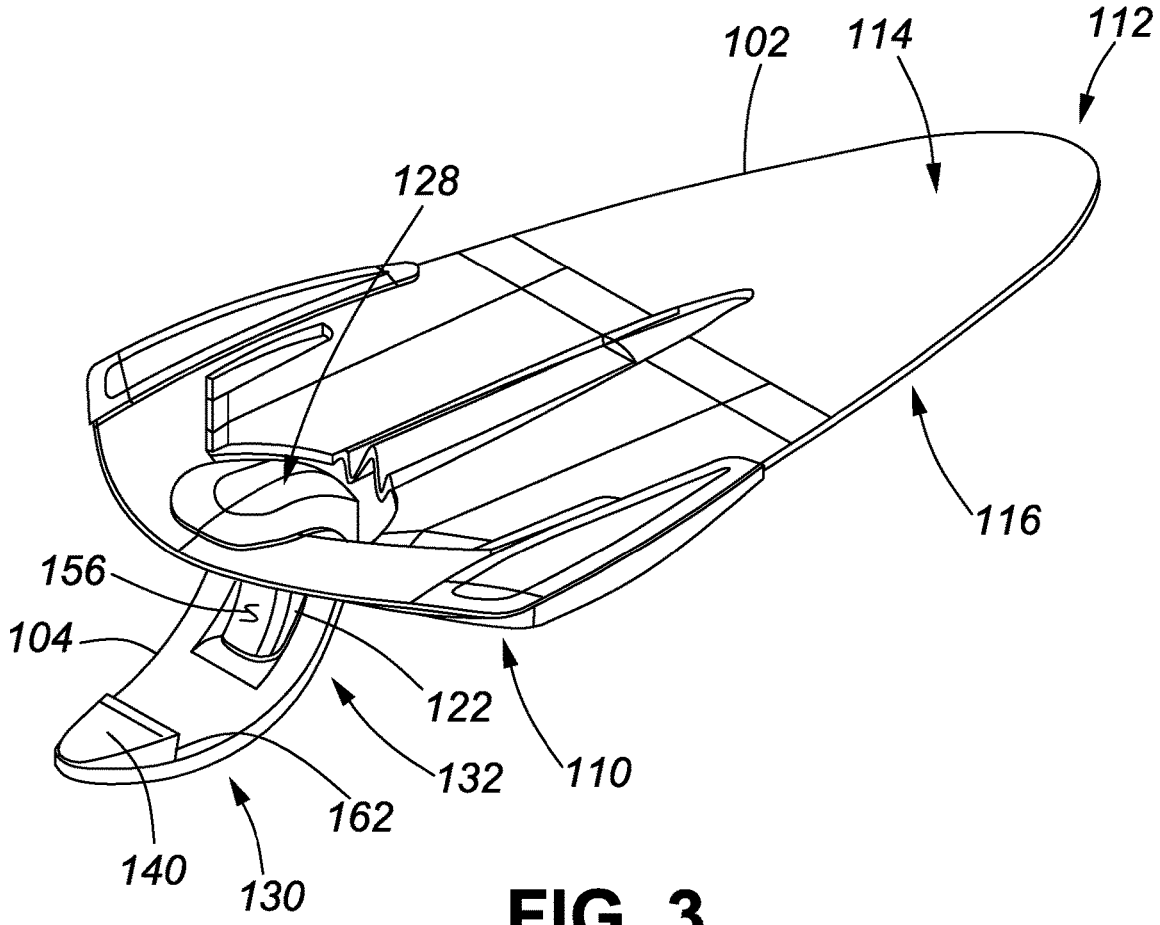
FIG. 3 is a top perspective view of the fin apparatus of FIG. 2.
Figure 4:
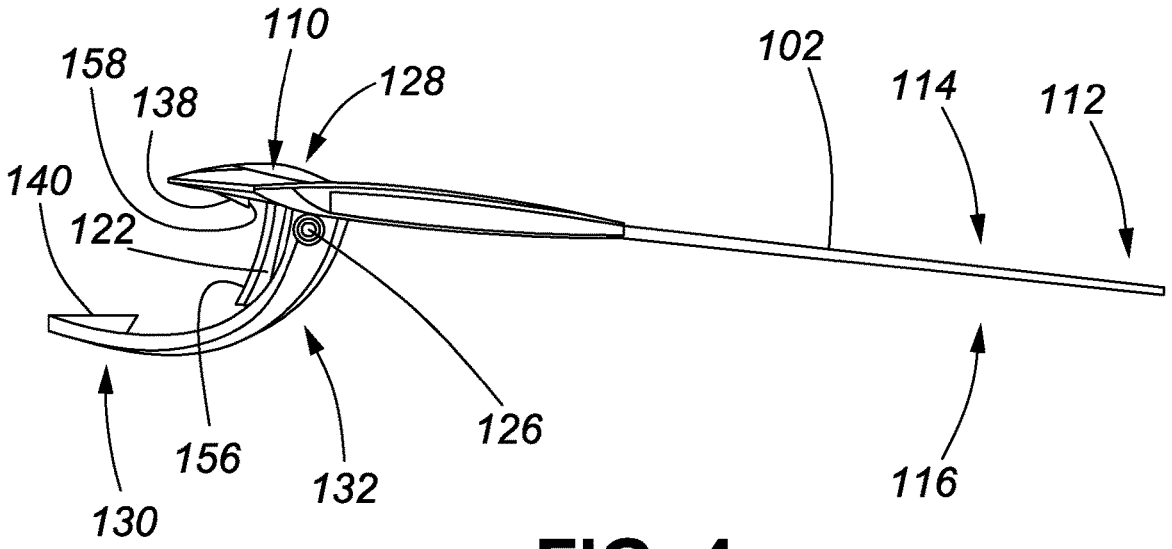
FIG. 4 is a side view of the fin apparatus of FIG. 2.
Figure 5:
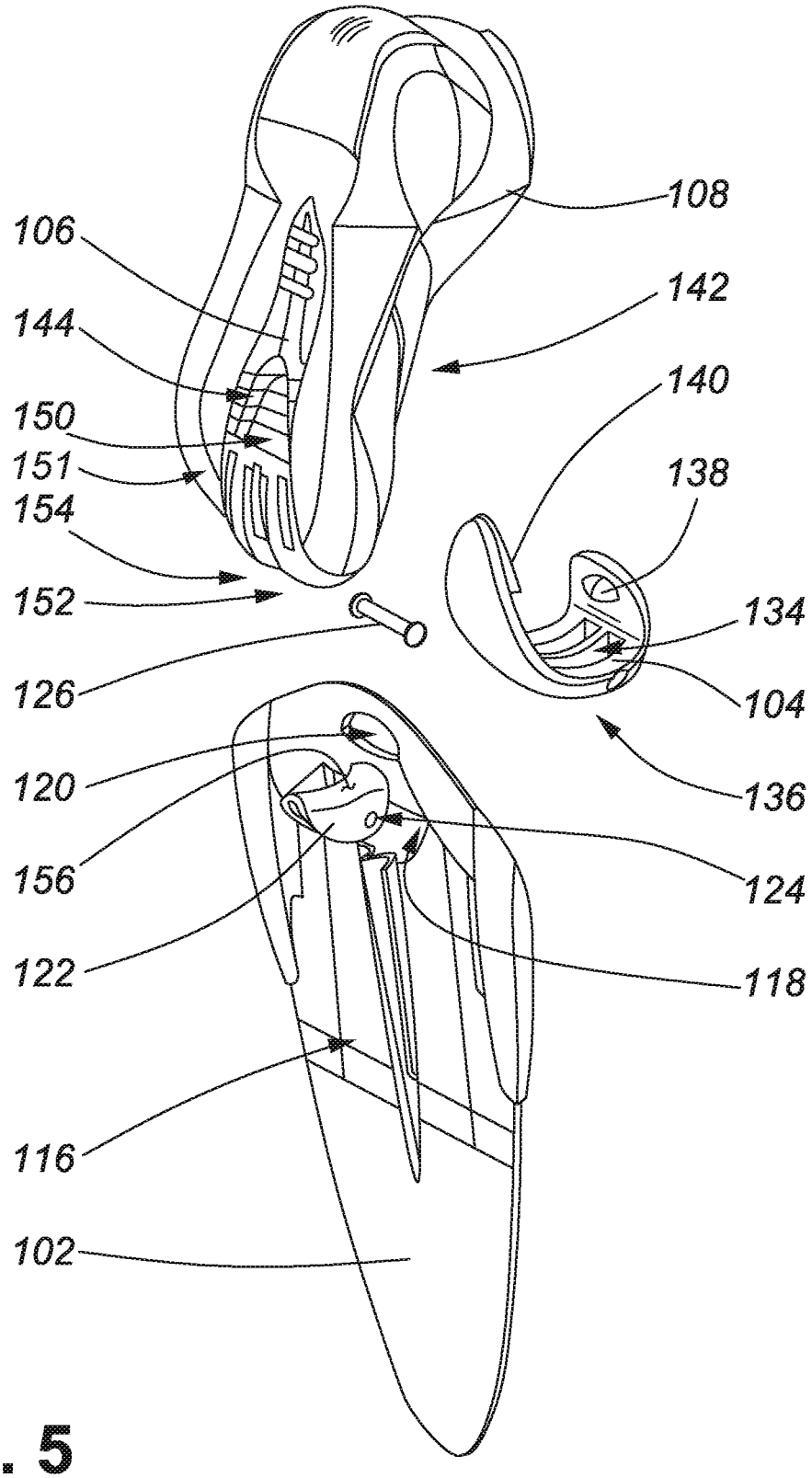
FIG. 5 is an exploded bottom perspective view of the fin system of FIG. 1.

The intermediate portion 132 defines a receptacle shown generally at 134 open to a space between the top portion 128 and the bottom portion 130. The receptacle 134 is sized to receive a portion of the retainer 122 as shown in FIGS. 3 and 4. As shown in FIG. 5, a distal side of the retainer 122 has two spaced-apart lobes, so the receptacle 134 includes two spaced-apart recesses (as shown in FIG. 2) to receive respective lobes of the retainer 122. The intermediate portion 132 also defines a generally transverse through-opening shown generally at 136 and sized to receive the fastener 126.

Still referring to FIGS. 1 and 2, the top portion 128 defines a holder (or a holding body) 138 extending into the space between the top portion 128 and the bottom portion 130, and the bottom portion 130 defines a clasp (or boot clasp) 140 extending into the space between the top portion 128 and the bottom portion 130. The boot coupling body 104 is thus a unitary body having the holder 138 and the clasp 140.

Referring to FIGS. 1-4, the through-opening 118 is sized to receive a portion of the intermediate portion 132 with the top portion 128 on the top side 114 of the fin body 102, and with the bottom portion 130 on the bottom side 116 of the fin body 102. As shown in FIGS. 3 and 4, the boot coupling body 104 may be positioned with the intermediate portion 132 in the through-opening 118 such that the through-opening 124 is transversely aligned with the through-opening 136 such that the fastener 126 may be received in the through-opening 124 and in the through-opening 136. In that position, the holder 138 extends through the through-opening 120 and extends out of the bottom side 116 of the fin body 102. The fastener 126 may couple the fin body 102 to the boot coupling body 104, but in alternative embodiments, such a fastener may be omitted if such a fin body and boot coupling body may interlock or otherwise be coupled without such a fastener. Herein, a "fin apparatus" may refer to the assembly of the fin body 102 and the boot coupling body 104 as shown in FIGS. 3 and 4. In other embodiments, a fin apparatus may include more or fewer parts, and may be integrally formed as a single unitary body.

Referring to FIGS. 1 and 5, the boot toe body 106 is curved and has a top portion shown generally at 142, a bottom portion shown generally at 144, and an intermediate portion shown generally at 146 between the top portion 142 and the bottom portion 144. The top portion 142 defines a receptacle shown generally at 148 on a top side shown generally at 149 of the boot toe body 106 and open to the top side 149 of the boot toe body 106, and the bottom portion 144 defines a receptacle shown generally at 150 on a bottom side shown generally at 151 of the boot toe body 106 and open to the bottom side 151 of the boot toe body 106. On a front end shown generally at 152, the intermediate portion 146 defines a recess shown generally at 154 and extending between the top and bottom sides of the boot toe body 106. The recess 154 defines a front surface 155 that is complementary to a retaining surface 156 on the retainer 122 so that the recess 154 may receive a portion of the retainer 122 when the retaining surface 156 contacts the front surface 155.

Figure 6:
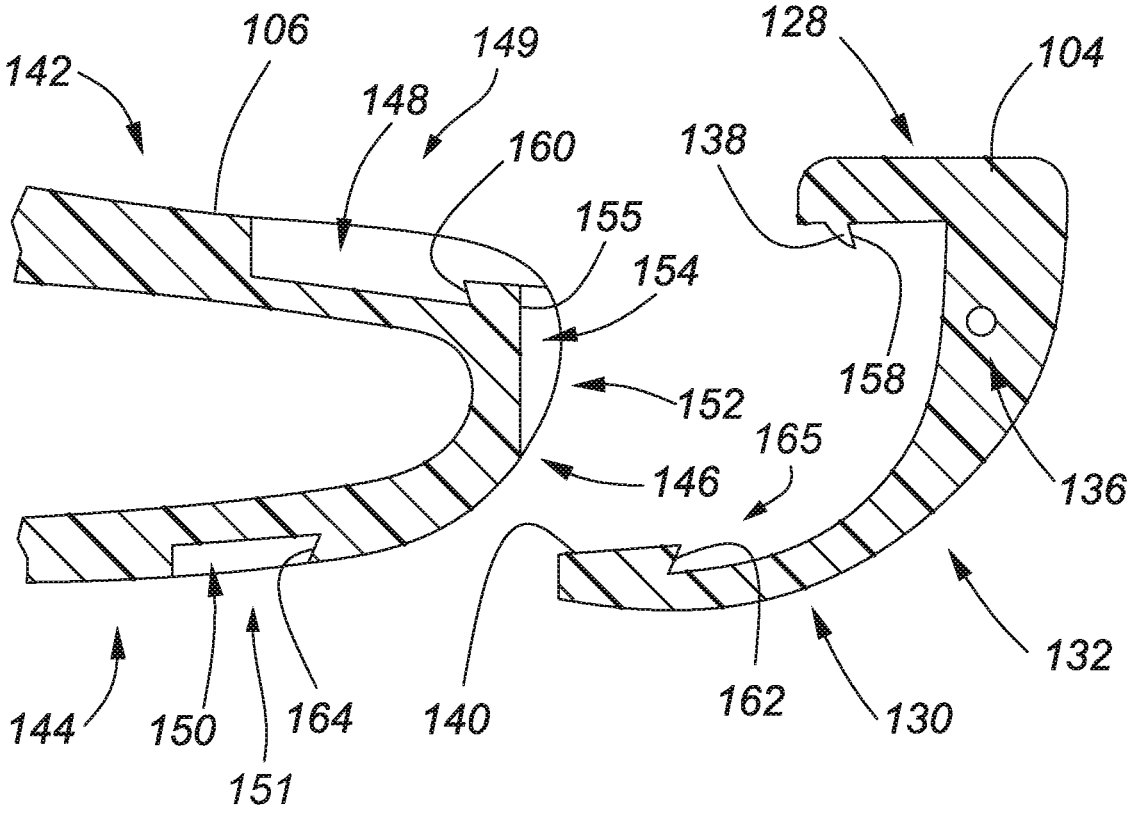
FIG. 6 is a partial side cross-sectional view of the boot coupling body and of a boot toe body of the fin system of FIG. 1, taken along the line 6-6 shown in FIG. 1.

Referring to FIG. 6, the holder 138 defines a retaining surface (or a holding surface) 158 complementary to a retaining surface 160 in the receptacle 148 and on the top side 149 of the boot toe body 106. Further, the clasp 140 defines a retaining surface 162 complementary to a retaining surface 164 in the receptacle 150 and on the bottom side 151 of the boot toe body 106. The retaining surface 162 is on a top side shown generally at 165 of the bottom portion 130 of the boot coupling body 104. Absent any external forces, the intermediate portion 132 is curved such that a curved inner surface of the intermediate portion 132 (facing into the space between the top portion 128 and the bottom portion 130) has a curvature that is greater than a curvature of a complementary outer surface on the front end 152 of the boot toe body 106. However, the boot coupling body 104 is resiliently deformable, and as described below, coupling the boot toe body 106 involves resiliently deforming the boot coupling body 104 such that the curvature of the curved inner surface of the intermediate portion 132 decreases to a curvature closer to the curvature of the complementary outer surface on the front end 152 of the boot toe body 106, and such that a separation distance between the holder 138 and the clasp 140 increases.

Figure 7:
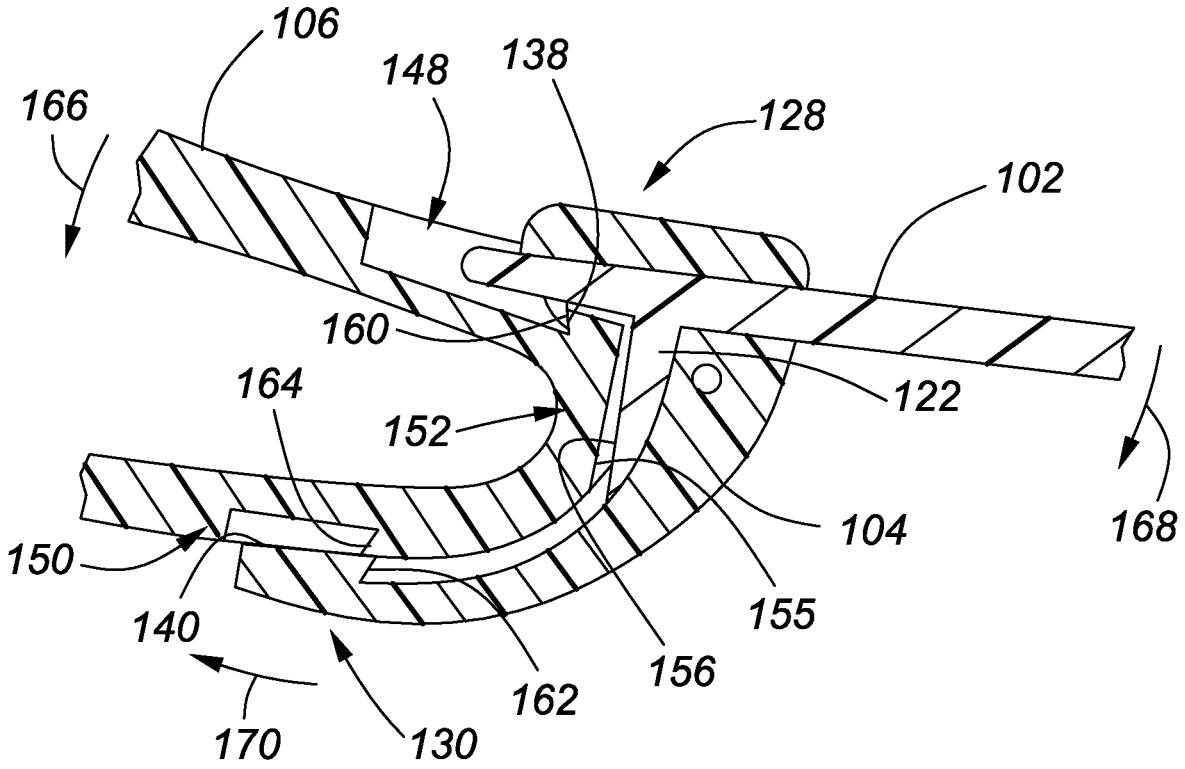
FIG. 7 is a partial side cross-sectional view of the boot coupling body and the boot toe body of FIG. 1 in a first stage of coupling the boot coupling body to the boot toe body.

Referring to FIG. 7, the front end 152 of the boot toe body 106 may be received in the space between the top portion 128 and the bottom portion 130 with the holder 138 received in the receptacle 148 such that the retaining surface 158 contacts the retaining surface 160. When the retaining surface 158 contacts the retaining surface 160, the boot toe body 106 is pivotable relative to the boot coupling body 104, and the boot coupling body 104 is pivotable relative to the boot toe body 106, about a generally transverse axis defined by the point of contact of the retaining surface 158 on the retaining surface 160. If the boot toe body 106 is pivoted about that axis of rotation in the direction of the arrow 166, or if the boot coupling body 104 is rotated about that axis of rotation in the direction of the arrow 168, or both, then the clasp 140 and the retaining surface 162 approach the receptacle 150 by moving in the direction of the arrow 170.

Figure 8:
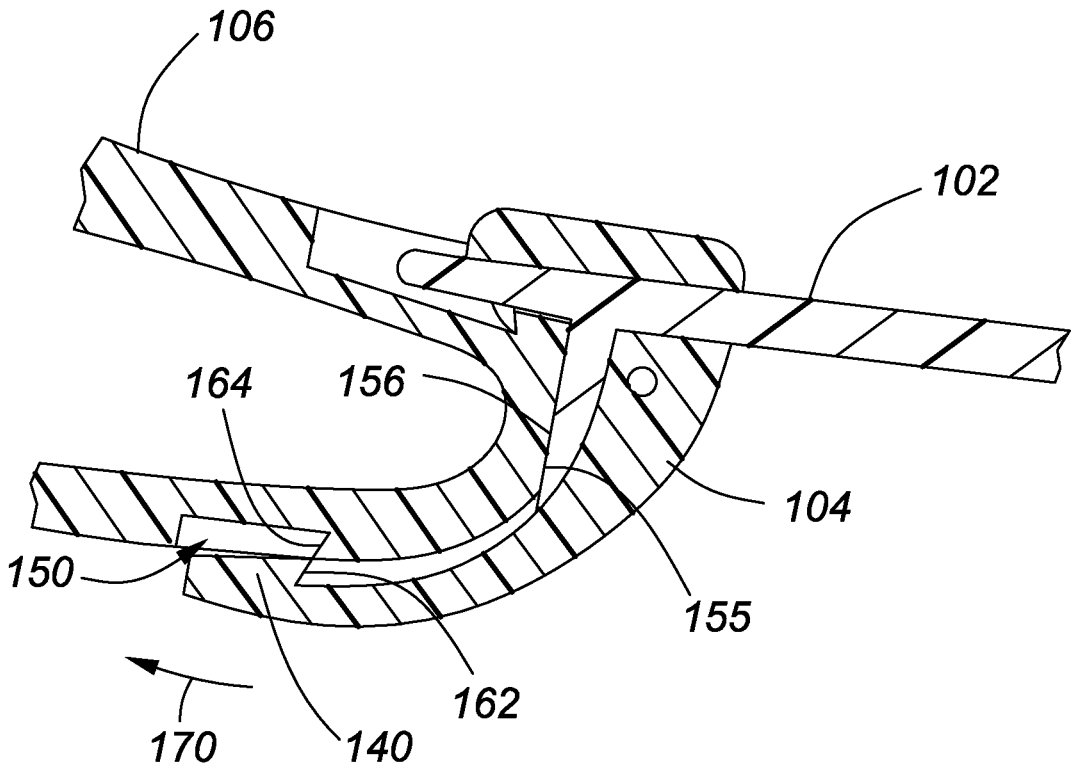
FIG. 8 is a partial side cross-sectional view of the boot coupling body and the boot toe body of FIG. 1 in a second stage of coupling the boot coupling body to the boot toe body.

FIG. 8 illustrates the clasp 140 closer to the receptacle 150, having moved in the direction of the arrow 170 relative to the position shown in FIG. 7. The boot coupling body 104 is more resiliently deformable than the boot toe body 106. Therefore, as the clasp 140 moves from the position shown in FIG. 7 closer to the receptacle 150 as shown in FIG. 8, the boot coupling body 104 is resiliently deformed such that the curvature of the curved inner surface of the intermediate portion 132 decreases to a curvature closer to the curvature of the complementary outer surface on the front end 152 of the boot toe body 106, and such that the separation distance between the holder 138 and the clasp 140 increases.

Figure 9:
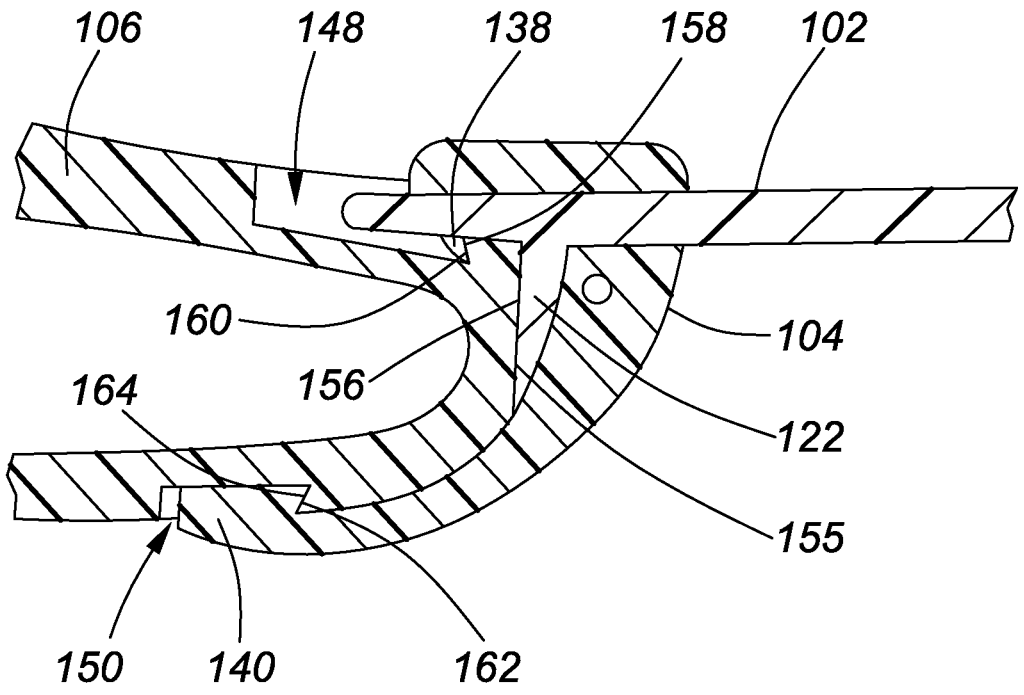
FIG. 9 is a partial side cross-sectional view of the boot coupling body of FIG. 1 coupled to the boot toe body of FIG. 1.

Because the boot coupling body 104 has been resiliently deformed to increase the separation distance between the holder 138 and the clasp 140, the boot coupling body 104 resiliently urges the clasp 140 in a direction generally towards the holder 138. Therefore, as shown in FIG. 9, when the retaining surface 162 moves in the direction of the arrow 170 past the retaining surface 164, the receptacle 150 receives the clasp 140 with the retaining surface 162 in contact with the retaining surface 164, so the retaining surface 162 is a retaining surface for contacting the retaining surface 164 of the receptacle 150 (which is a complementary boot connector) to connect the clasp 140 (which is a boot connector) to the receptacle 150. The retaining surfaces 158, 160, 162, and 164 are positioned to retain the holder 138 and the clasp 140 against movement in a direction towards the fin body 102, and the clasp 140 is thus connected to the boot toe body 106 at the receptacle 150, while simultaneously the holder 138 is connected to the boot toe body 106 at the receptacle 148 with the retaining surface 158 in contact with the retaining surface 160. In various embodiments, a "receptacle" need not be a recess, but may include other structures that define at least one retaining surface to function as a connector.

The holder 138, the clasp 140, the receptacle 148, and the receptacle 150 thus function as connectors (or as boot connectors). The holder 138 is a first boot connector, and the receptacle 148 is a first complementary boot connector. The clasp 140 is a second boot connector, and the receptacle 150 is a second complementary boot connector. The retaining surface 164 is a retaining surface of the receptacle 150, which is a second complementary boot connector. When the holder 138 is connected to the boot toe body 106 at the receptacle 148 and when the clasp 140 is connected to the boot toe body 106 at the receptacle 150, the front surface 155 in the recess 154 contacts the retaining surface 156 of the retainer 122, and the holder 138 and the clasp 140 are positioned to position the front surface 155 against the retaining surface 156. Although the boot toe body 106 resiliently deforms the boot coupling body 104, the retainer 122 is more rigid and is not significantly resiliently deformed by the boot toe body 106, so the boot toe body 106 may be firmly retained against the retainer 122. The holder 138, the clasp 140, and the retainer 122 thus cooperate to retain the boot toe body 106 against moving relative to the boot coupling body 104 to couple the boot toe body 106 to the boot coupling body 104. Therefore, the holder 138 is a means for connecting the boot coupling body 104 (and thus the fin body 102 when the fin body 102 is coupled to the boot coupling body 104) to the boot toe body 106 at a first complementary boot connector (the receptacle 148) of the boot toe body 106 on the top side 149 of the boot toe body 106, and the clasp 140 is a means for connecting the boot coupling body 104 (and thus the fin body 102 when the fin body 102 is coupled to the boot coupling body 104) to the boot toe body 106 at a second complementary boot connector (the receptacle 150) of the boot toe body 106 on the bottom side 151 of the boot toe body 106, the clasp 140 including the retaining surface 162 on the top side 165 of the bottom portion 130 of the boot coupling body 104 for contacting the retaining surface 164 of the second complementary boot connector (the receptacle 150). Further, because the front surface 155 is complementary to the retaining surface 156, the retainer cooperates with the front end 152 of the boot toe body 106 to align the boot toe body 106 to the boot coupling body 104 and inhibit lateral and rotational movement of the boot toe body 106 relative to the boot coupling body 104. In summary, the boot coupling body 104 and the boot toe body 106 may cooperate to align the boot toe body 106 automatically to the boot coupling body 104, which may facilitate coupling the boot toe body 106 to the boot coupling body 104.

The embodiment shown in FIGS. 1-9 may facilitate a simple and intuitive method of coupling and decoupling a fin apparatus to a boot because a user may couple a fin apparatus to a boot by "stepping in" to the boot coupling body 104 of a fin apparatus with one hand or no hands at all.

In some embodiments, the boot coupling body may be permanently coupled to the boot toe body as shown in FIG. 9. However, in other embodiments, the boot coupling body may be decoupleable from the boot toe body.

Figure 10:
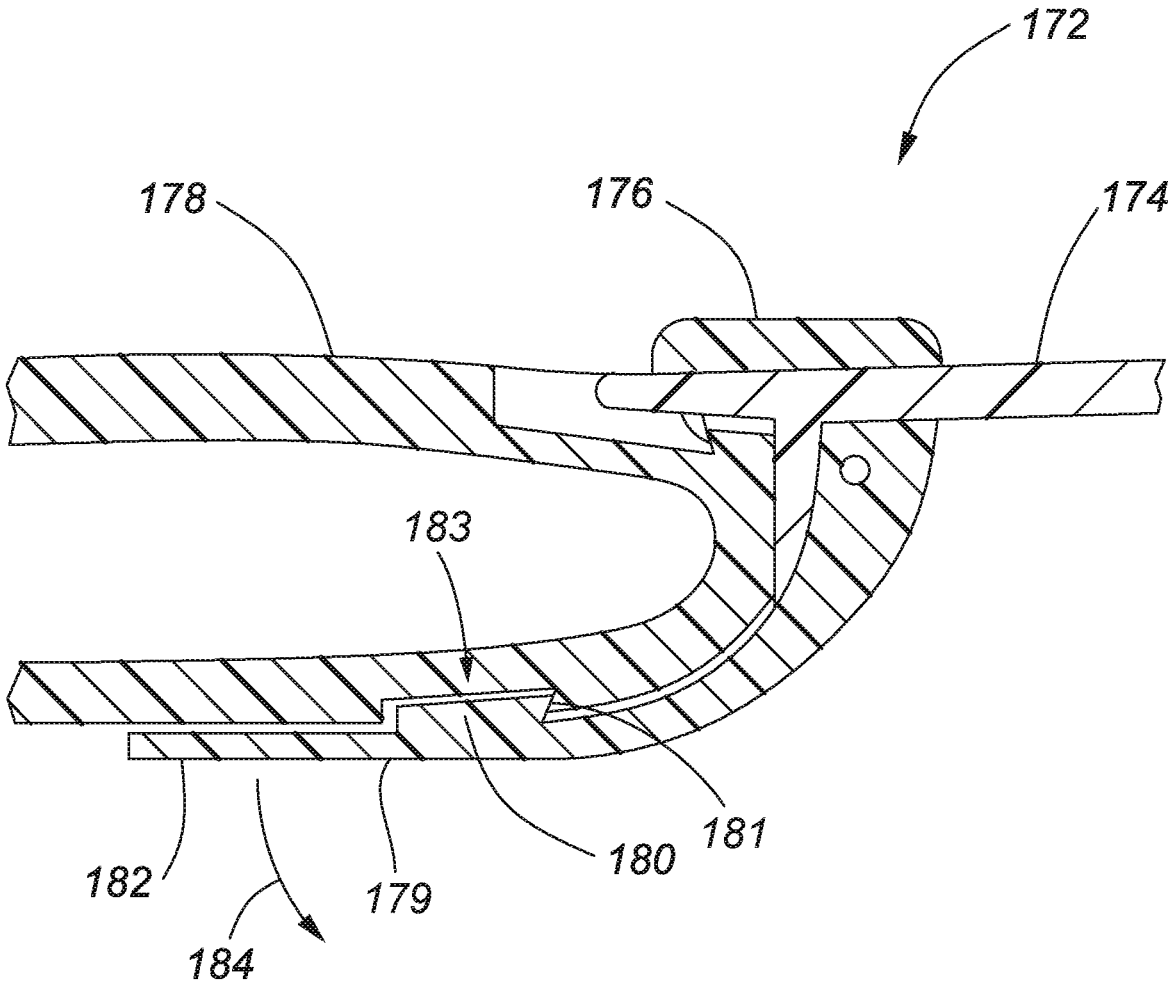
FIG. 10 is a partial side cross-sectional view of a boot coupling body and a boot toe body according to another embodiment.
Figure 41:
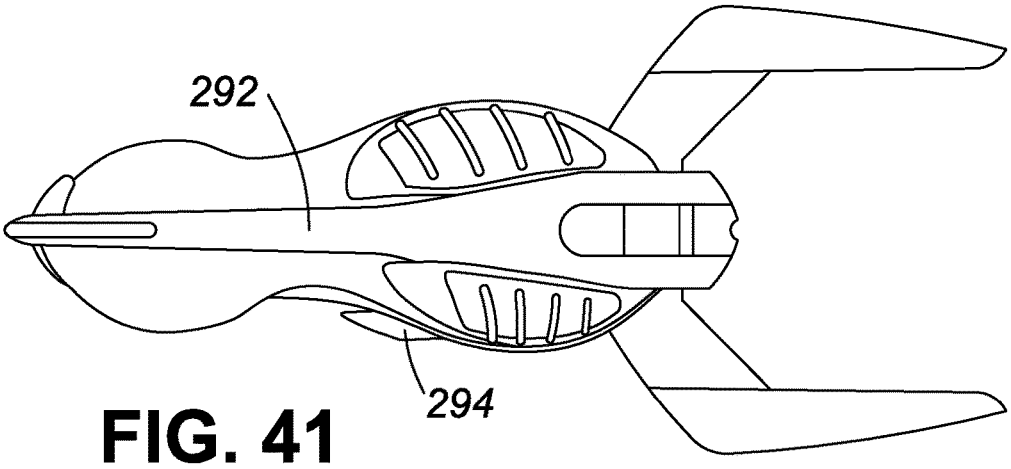
FIG. 41 is a bottom view of a boot, a boot coupling body, and part of a fin body according to another embodiment.
Figure 42:
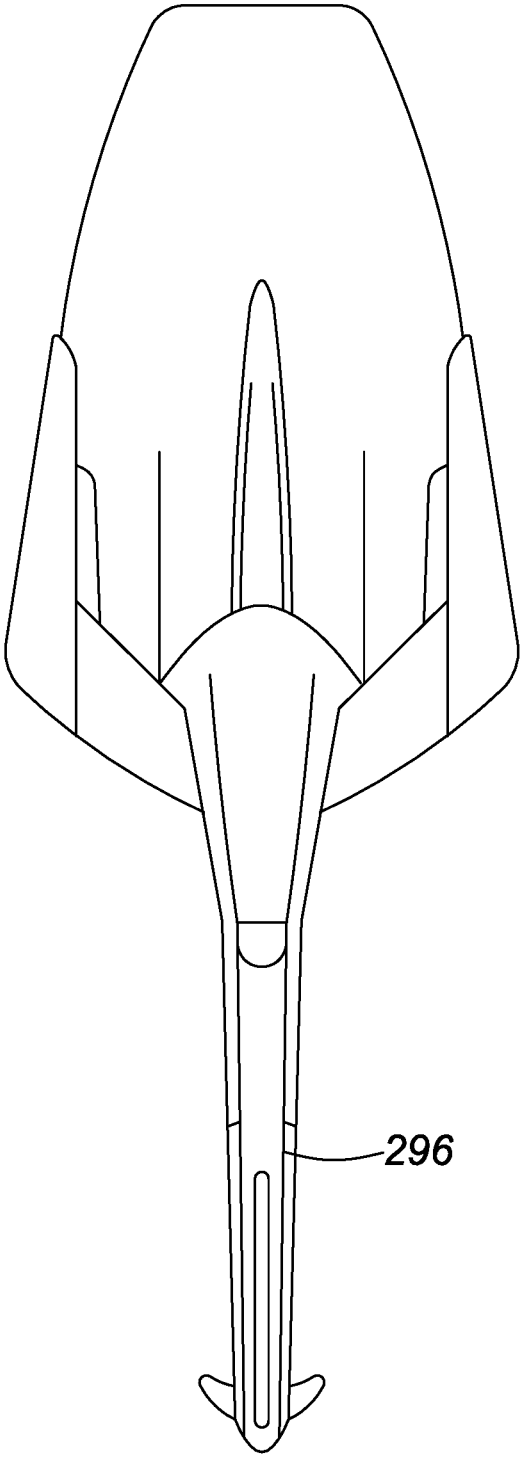
FIG. 42 is a bottom view of a boot coupling body and a fin body according to another embodiment.

Referring to FIG. 10, a fin system according to another embodiment is shown generally at 172 and includes a fin body 174, a boot coupling body 176, and a boot toe body 178. The fin body 174 is substantially the same as the fin body 102, and the boot toe body 178 is substantially the same as the boot toe body 106. The boot coupling body 176 is substantially the same as the boot coupling body 104, and a bottom portion 179 of the boot coupling body 176 includes a clasp (or boot clasp or boot connector) 180 that includes a retaining surface 181 on a top side shown generally at 183 of the bottom portion 179 of the boot coupling body 176 and that is substantially the same as the clasp 140 (so that the retaining surface 181 is a retaining surface for contacting a retaining surface of a complementary boot connector on a bottom side of the boot toe body 178 to connect the clasp 180, which is a boot connector, to the complementary boot connector on the bottom side of the boot toe body 178, and so that the clasp 180 is a means for connecting the fin body 174 and the boot coupling body 176 to the boot toe body 178 at a complementary boot connector of the boot toe body 178 on the bottom side of the boot toe body 178), the clasp 180 including the retaining surface 181 on the top side 183 of the bottom portion 179 of the boot coupling body 176 for contacting a retaining surface of the complementary boot connector on the bottom side of the boot toe body 178, except that the boot coupling body 176 includes a rigid lever 182 coupled to the clasp 180 and extending posterior to the clasp 180. Moving the lever 182 in the direction 184 away from the boot toe body 178 transfers a force from the lever 182 to the clasp 180 to release or decouple the boot coupling body 176 (and thus the fin body 174 coupled to the boot coupling body 176) from the boot toe body 178 because a portion of the boot coupling body 176 anterior of the clasp 180 is flexible enough to allow the clasp 180 to exit from a receptacle or complementary boot connector of the boot toe body 178 in response to the force from the lever 182 away from the boot toe body 178. The lever 182 may include a safety lock (not shown) to prevent accidental release. For example, FIG. 41 illustrates a rigid lever (or monobar) 292 including a safety lock 294. The boot coupling body of FIG. 41 may be described as "excenter with safety". Also, FIG. 42 illustrates a rigid lever 296 according to another embodiment, in which the lever 296 includes a heel coupling body as described below.

Figure 13:
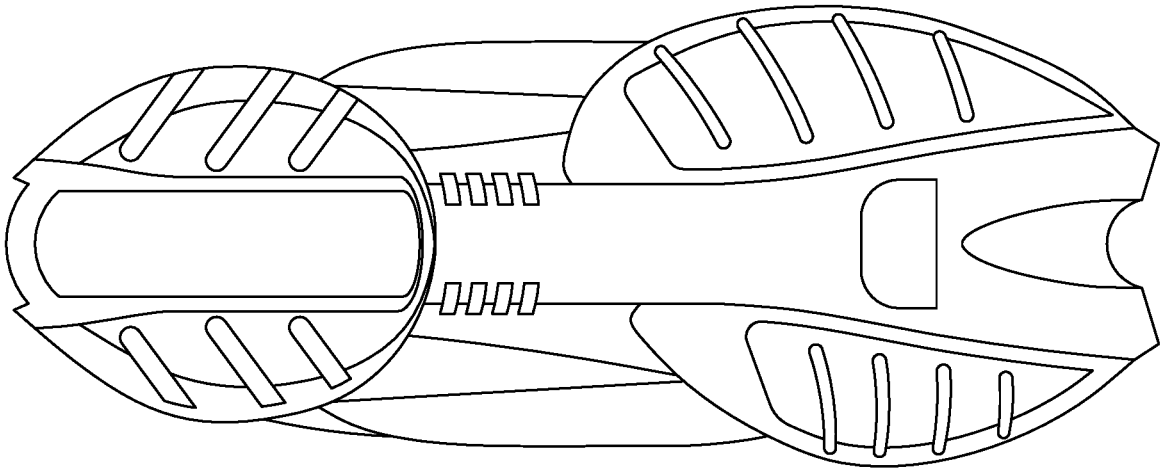
FIG. 13 is a bottom view of a boot toe body according to another embodiment.

As shown in FIG. 5, the boot toe body 106 may be coupled to the boot 108. For example, the boot toe body 106 may be formed by injection molding, and the boot 108 may be made of a material such as neoprene and sewn, adhered, or otherwise fastened to the boot toe body 106. Alternatively, the boot toe body 106 and the boot 108 may be integrally formed by multi-stage injection molding, for example. In some embodiments, a boot toe body may extend to locations well beyond a toe region (as shown in FIG. 13, for example) and may include, for example, some or all of an entire boot.

Figure 11:
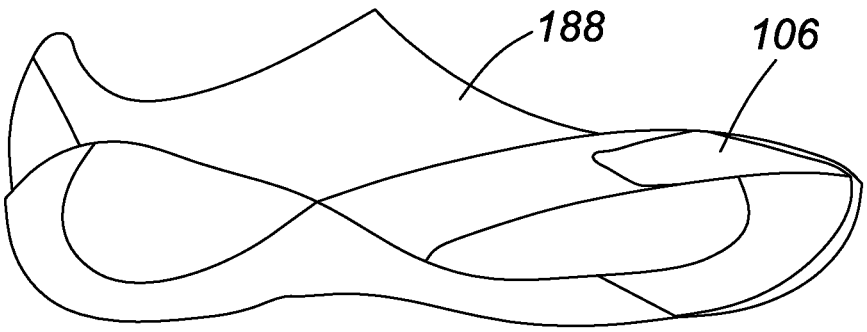
FIG. 11 is a side view of a boot system according to another embodiment.
Figure 12:
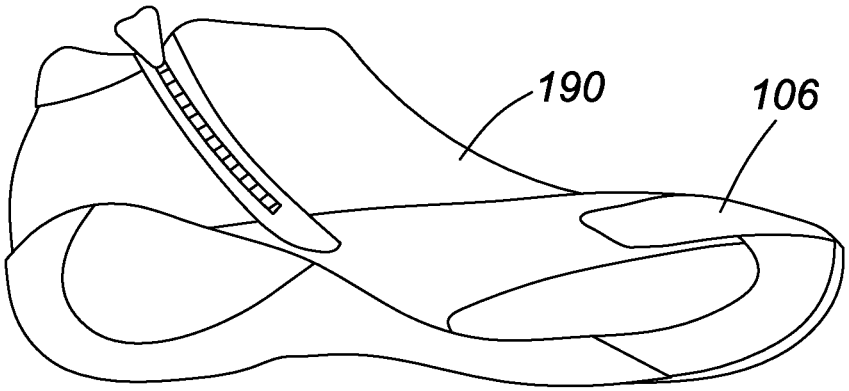
FIG. 12 is a side view of a boot system according to another embodiment.
Figure 14:
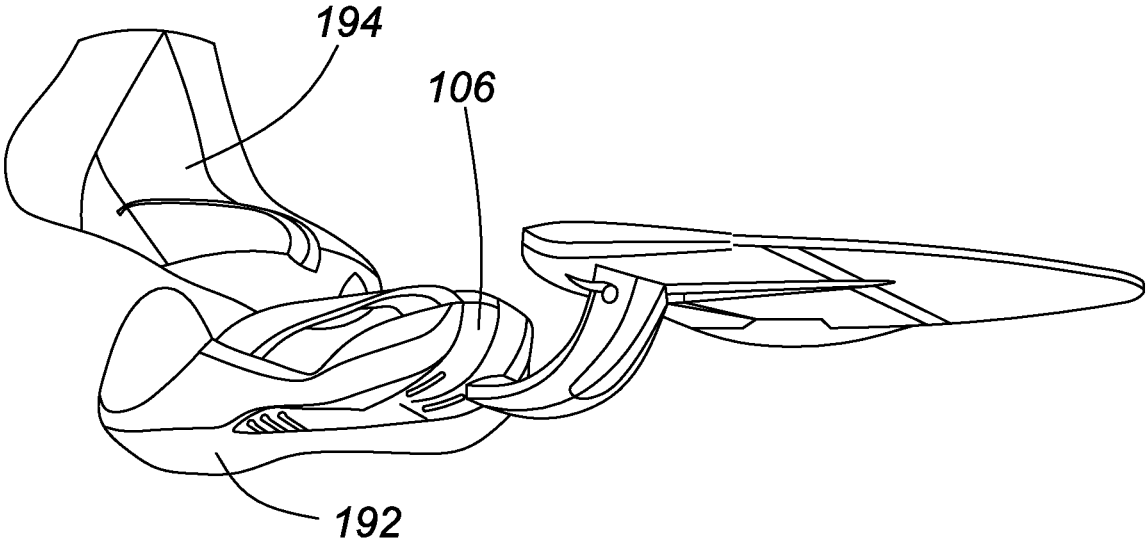
FIG. 14 is an exploded bottom perspective view of a fin system according to another embodiment.

In general, boot toe bodies described herein may be molded into or otherwise formed in one or a small number of sizes, and then coupled to boots of varying sizes and materials. Therefore, one or a small number of sizes of boot toe bodies may be manufactured to facilitate coupling to fin apparatuses such as the fin apparatuses described herein. Manufacturing boot toe bodies in one or a small number of sizes may reduce manufacturing costs when compared to other boot binding systems because the one or small number of sizes of boot toe bodies may be coupled to a large variety of different boots. For example, boots may be manufactured by a number of manufacturers in a large number of varieties that may vary by foot size and shape, by material, by ankle support, and in many other ways without requiring separate tools or injection molds to manufacture different toe boot bodies for each variety of boot. For example, the boot toe body 106 may be coupled to a low-ankle boot 188 as shown in FIG. 11, or to a high-ankle boot 190 as shown in FIG. 12. Further, referring to FIG. 14, the boot toe body 106 may be coupled to a boot shell 192, and the boot shell 192 may be configured to receive and couple to a boot 194.

Further, boots described herein may, for example, be similar to boots that were described and illustrated in U.S. provisional patent application No. 61/322,104 filed on Apr. 8, 2010, or that were described and illustrated in U.S. patent application Ser. No. 13/639,446.

Figure 15:
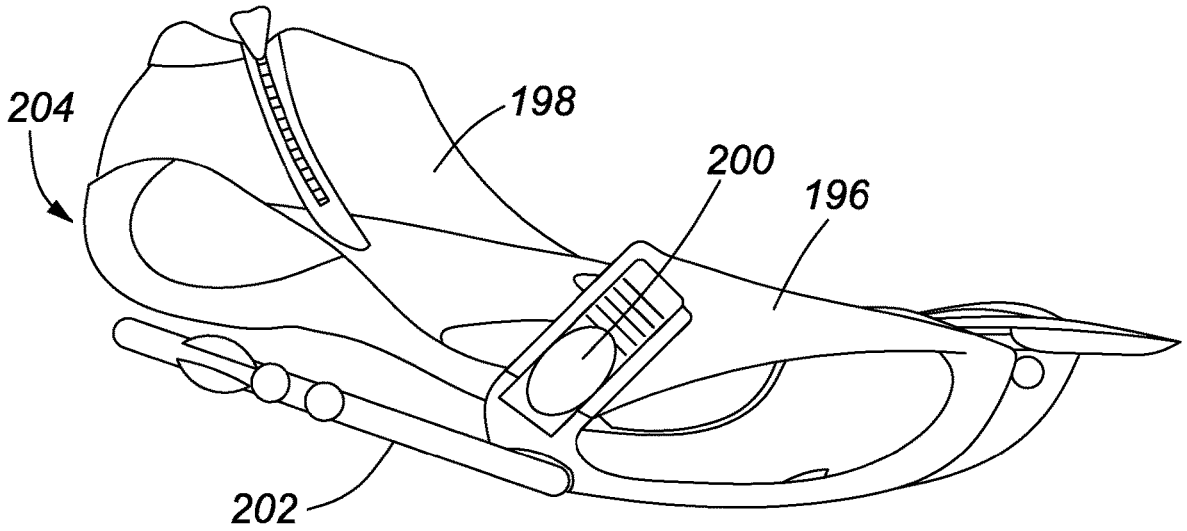
FIG. 15 is a partial side view of a fin system according to another embodiment.

Referring to FIG. 15, another embodiment includes a boot toe body 196 that is similar to the boot toe body 106, except that the boot toe body 196 is configured to be attachably and detachably coupled to a boot 198. For example, the boot toe body 196 may include a height adjustment mechanism 200 to adjust a height of a receptacle of the boot toe body 196 to fit a particular boot 198. The boot toe body 196 may also include a heel coupling body 202 having a third boot connector configured to be coupled to a heel region shown generally at 204 of the boot 198. The heel coupling body 202 may be adjustable in length to accommodate different lengths and sizes of the boot 198, thus adjusting a separation distance between the first and second boot connectors and the boot third connector. The boot toe body 196 may facilitate coupling a fin apparatus to a dry suit or to a user's preferred boot, for example.

Figure 40:
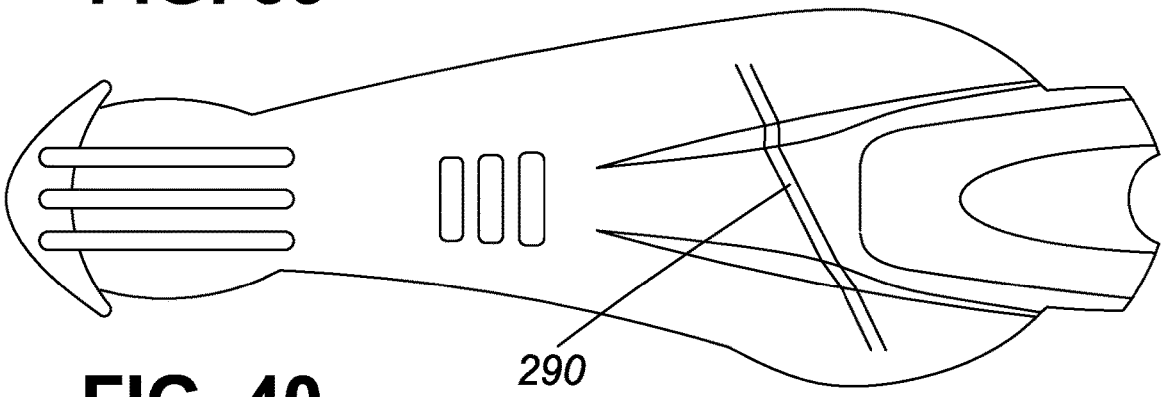
FIG. 40 is a bottom view of a boot coupling body according to another embodiment.

Further, boots and boot toe bodies as described herein may include sole bodies such as the sole bodies described and illustrated in PCT international application no. PCT/CA2012/000946. Further, "boot" herein is not limited to any particular footwear, and may include shoes and other footwear, and also prosthetic limbs for example. FIG. 40 illustrates a boot toe body according to another embodiment, in which a hinge 290 permits greater flexibility between a toe portion and a heel portion of the boot toe body.

Figure 16:
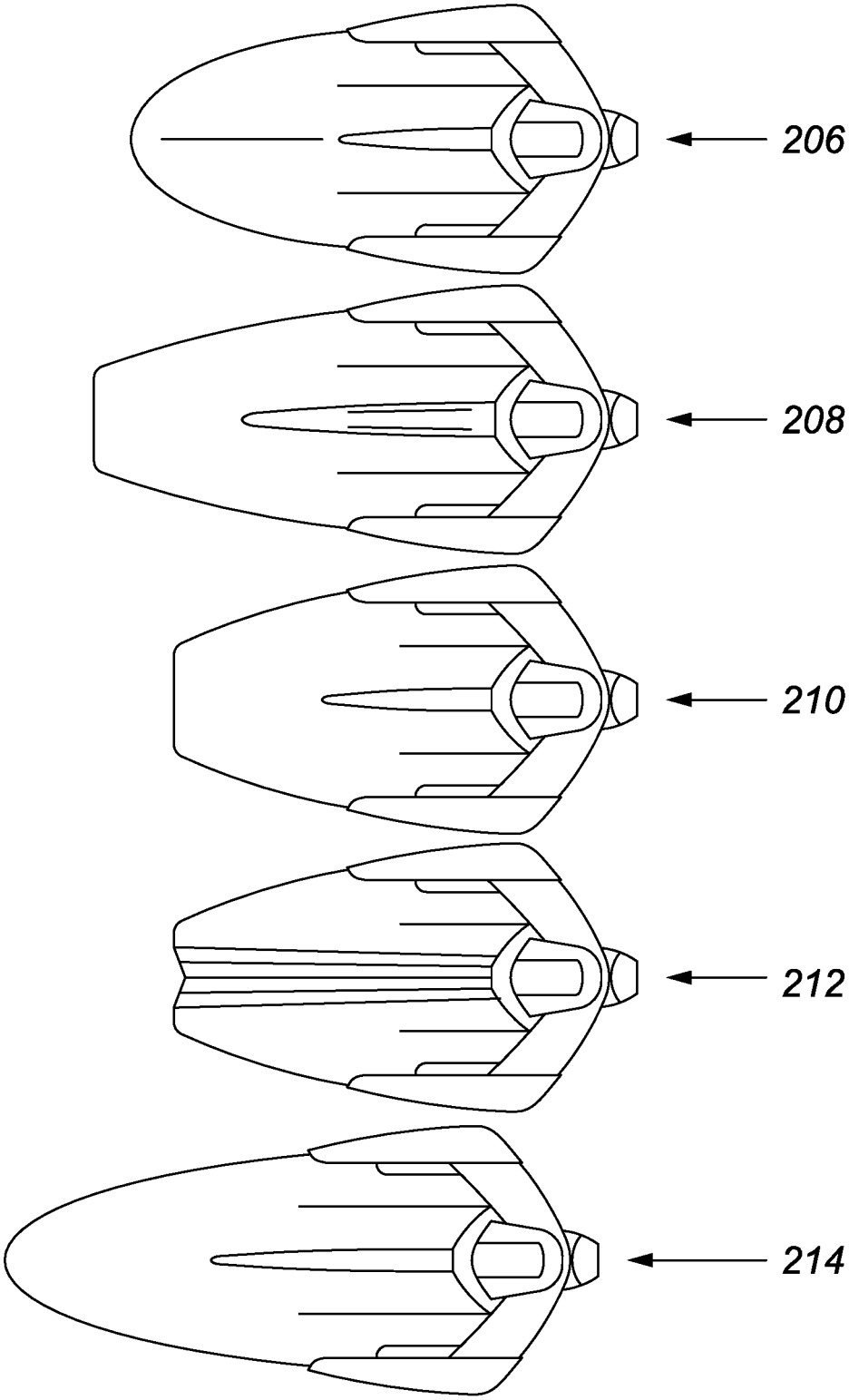
FIG. 16 is top views of fin apparatuses according to other embodiments.

Further, fin apparatuses may vary in many ways, such as in length, in width, in shape, in material, and in flexibility, for example. Fin apparatuses described herein may, for example, be similar to fin apparatuses (or "flippers") that were described and illustrated in U.S. provisional patent application No. 61/322,104, or that were described and illustrated in U.S. patent application Ser. No. 13/639,446. FIG. 16 illustrates fin apparatuses 206, 208, 210, 212, and 214 according to other embodiments.

Figure 17:
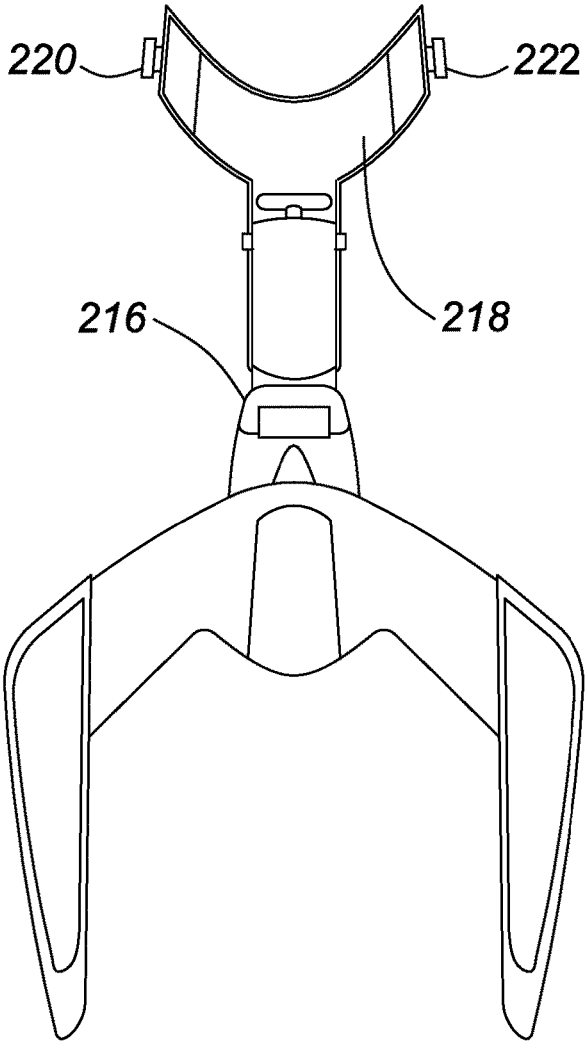
FIG. 17 is a bottom view of a boot coupling body and part of a fin body according to another embodiment.

Referring to FIG. 17, another embodiment includes a boot coupling body 216 that is similar to the boot coupling bodies described herein, but includes a heel coupling body 218. The heel coupling body 218 includes lateral posts 220 and 222, which are configured to be attached to a coil spring strap (not shown) for extending between the lateral posts 220 and 222 and behind a heel region of a boot, such as the heel region 204 of the boot 198 or a heel region shown generally at 224 of the boot 108.

Figure 18:
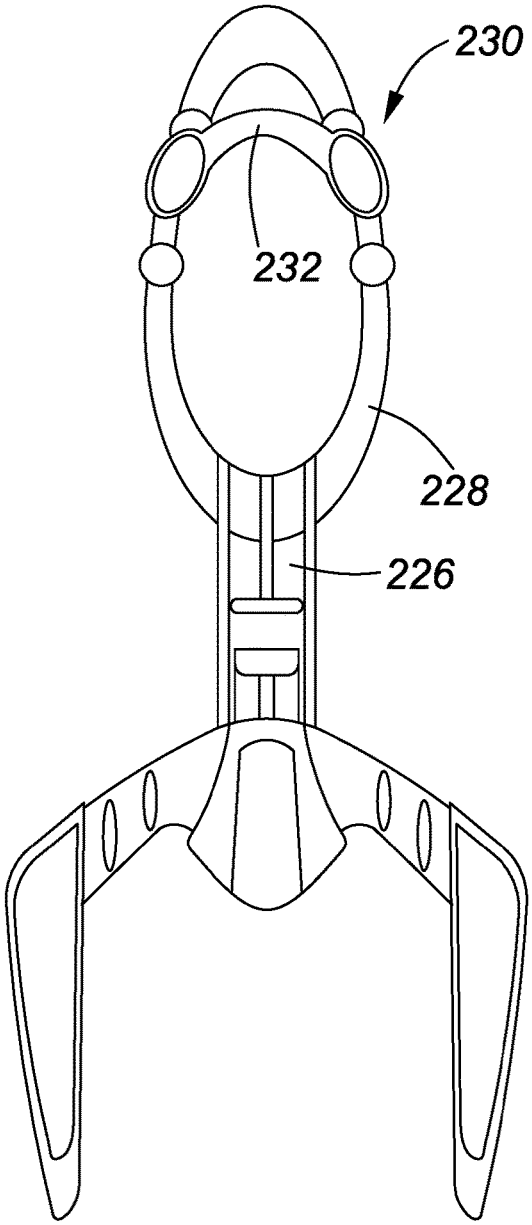
FIG. 18 is a bottom view of a boot coupling body and part of a fin body according to another embodiment.
Figure 37:
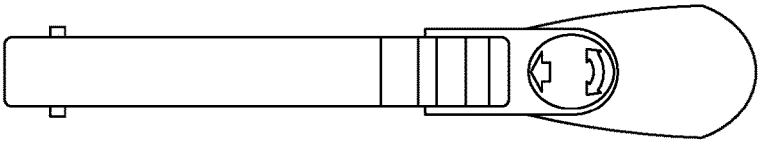
FIG. 37 is a bottom view of a boot coupling body according to another embodiment.

Referring to FIG. 18, another embodiment includes a boot coupling body 226, which is similar to the boot coupling bodies described herein, but includes a heel coupling body 228. The heel coupling body 228 has a loop shape with a posterior portion shown generally at 230. At the posterior portion 230, the heel coupling body 228 includes a connector (or boot connector) 232 that can be received in a receptacle on a heel end of a boot, such as the receptacle 1050 shown in FIG. 37 of PCT international application no. PCT/CA2011/000395 for example. The loop of the heel coupling body 228 may be resiliently deformable to stretch the posterior portion 230 around a heel portion of a boot, and the loop portion of the heel coupling body 228 may be adjustable in length.

Figure 19:
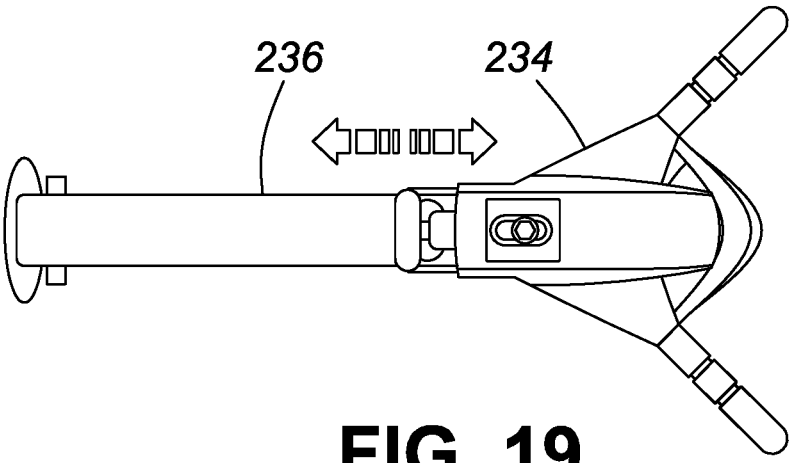
FIG. 19 is a bottom view of a boot coupling body and part of a fin body according to another embodiment.
Figure 20:
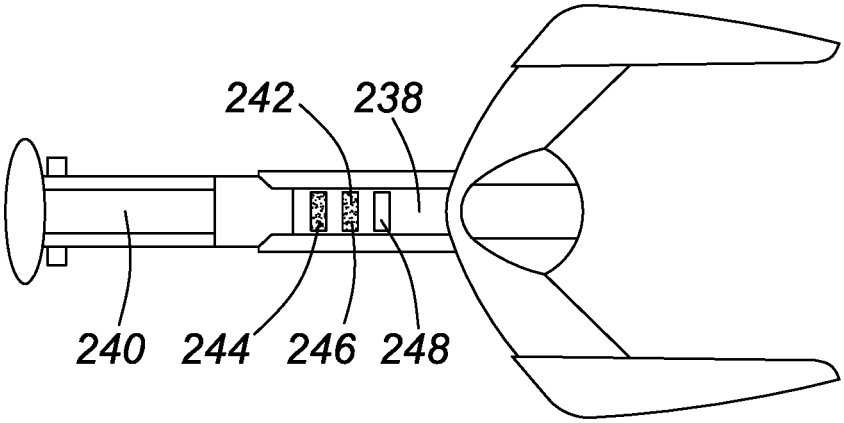
FIG. 20 is a bottom view of a boot coupling body and part of a fin body according to another embodiment.
Figure 21:
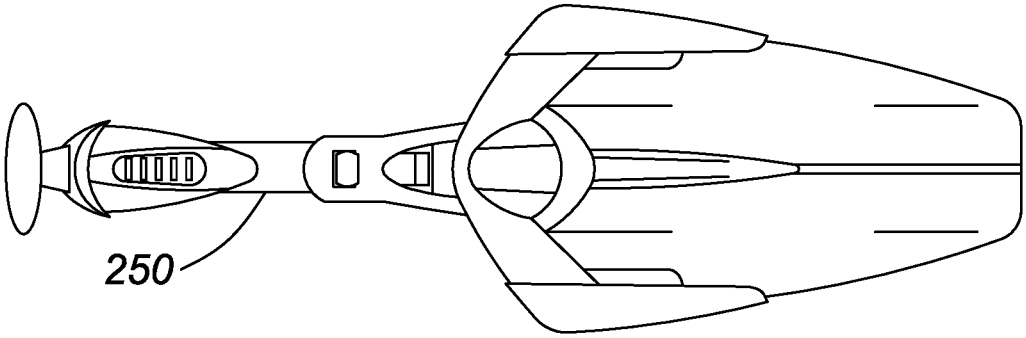
FIG. 21 is a bottom view of a boot coupling body and a fin body according to another embodiment.

FIGS. 19 to 21 and 35 to 39 illustrate length adjustment in other embodiments. FIG. 19 illustrates a boot coupling body having a resiliently extendable heel coupling body 236. The boot coupling body of FIG. 19 may be described as "prelatch-pull-secure". FIGS. 35 to 39 also illustrate boot coupling bodies having resiliently extendable heel coupling bodies. FIG. 20 illustrates a boot coupling body 238 having a heel coupling body 240 that is adjustable in length by positioning a connector 242 in different holes 244, 246, and 248 of the boot coupling body 238. The boot coupling body 238 may be described as "length adjust/ratchet". FIGS. 35, 36, 37, and 39 also illustrate boot coupling bodies having heel coupling bodies that are adjustable in length. FIG. 21 illustrates an exchangeable semi-rigid heel coupling body 250. The boot coupling body 250 has a heel snap/length adjust semirigid bar or exchangeable semirigid bar/heel strap adjustment for fine tuning.

Figure 22:
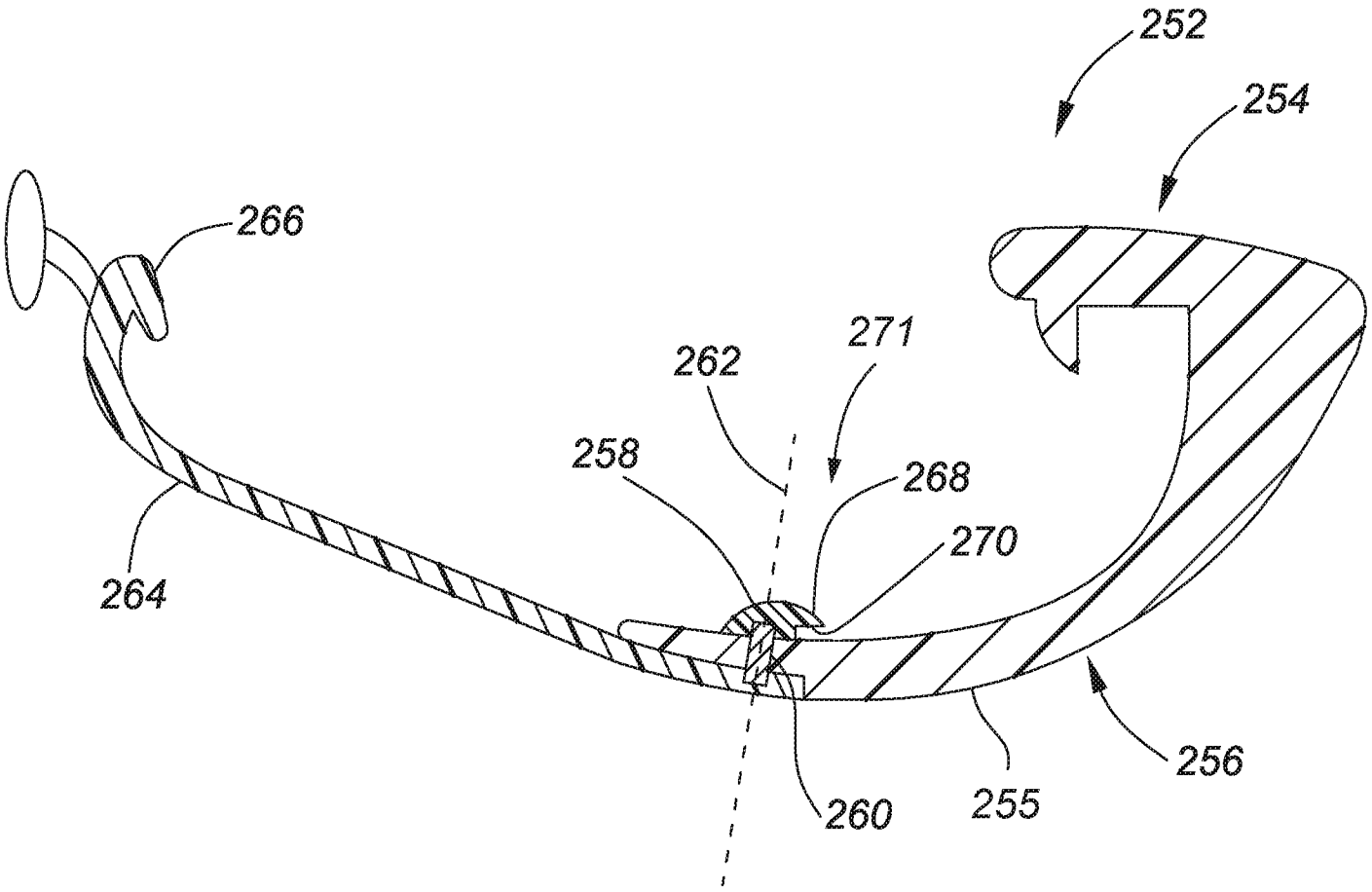
FIG. 22 is a side cross-sectional view of a boot coupling body according to another embodiment.

Referring to FIG. 22, a boot coupling body according to another embodiment is shown generally at 252 and is similar to the boot coupling bodies described above. The boot coupling body 252 has a top side shown generally at 254 and a bottom portion 255 on a bottom side shown generally at 256. The bottom portion 255 of the boot coupling body 252 has a clasp (or boot clasp or boot connector) 258 that is coupled to the boot coupling body 252 by a generally cylindrical fastener 260 that is coupled to the boot coupling body 252 to rotate around an axis of rotation 262 extending between the top side 254 and the bottom side 256 of the boot coupling body 252. The clasp 258 is thus coupled to the boot coupling body 252 for rotation around the axis of rotation 262. The boot coupling body 252 also includes a heel coupling body 264 including a connector (or boot connector) 266 connectable to a heel end of a boot. The heel coupling body 264 is also coupled to the fastener 260 for rotation about the axis of rotation 262. Therefore, rotation of the heel coupling body 264 about the axis of rotation 262 transfers a torque to the fastener 260 and to the clasp 258, thereby rotating the clasp 258 about the axis of rotation 262 in response to rotation of the heel coupling body 264 around the axis of rotation 262. The clasp 258 defines a retainer 268 having a retaining surface 270 facing towards the bottom side 256 of the boot coupling body 252. The retaining surface 270 is on a top side shown generally at 271 of the bottom portion 255 of the boot coupling body 252.

Figure 23:
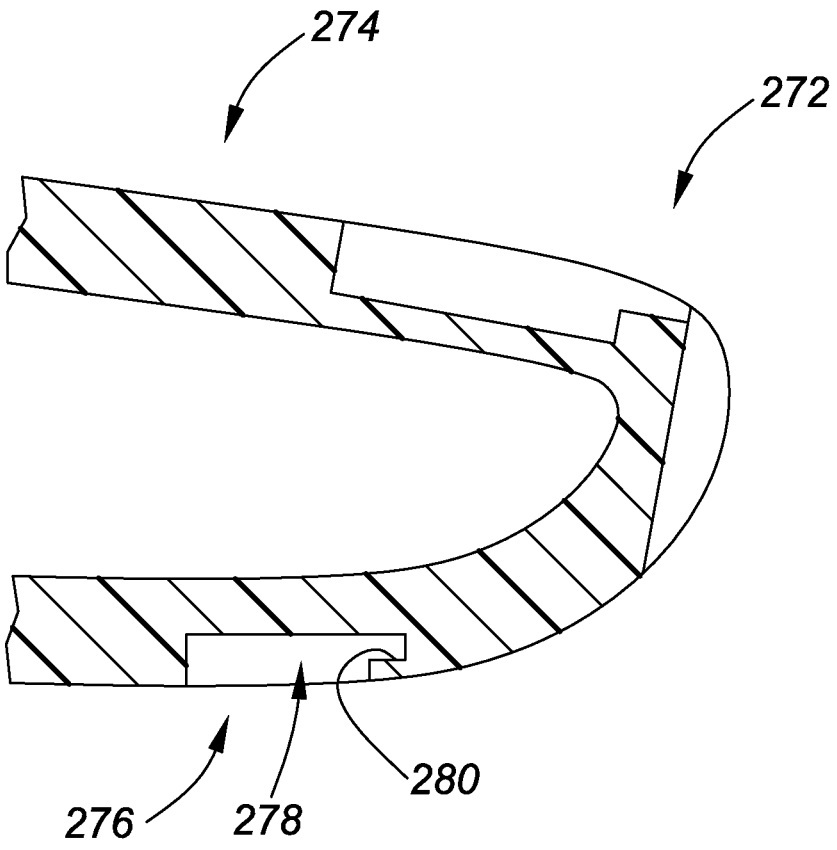
FIG. 23 is a side cross-sectional view of a boot toe body according to the embodiment of FIG. 22.

Referring to FIG. 23, a boot toe body 272 according to the embodiment of FIG. 22 is similar to the boot toe bodies described above and has a top side shown generally at 274 and a bottom side shown generally at 276. On the bottom side 276, the boot toe body 272 defines a receptacle 278 defining a retaining surface 280 on the bottom side 276 of the boot toe body 272 and facing the top side 274 of the boot toe body 272.

Figure 24:
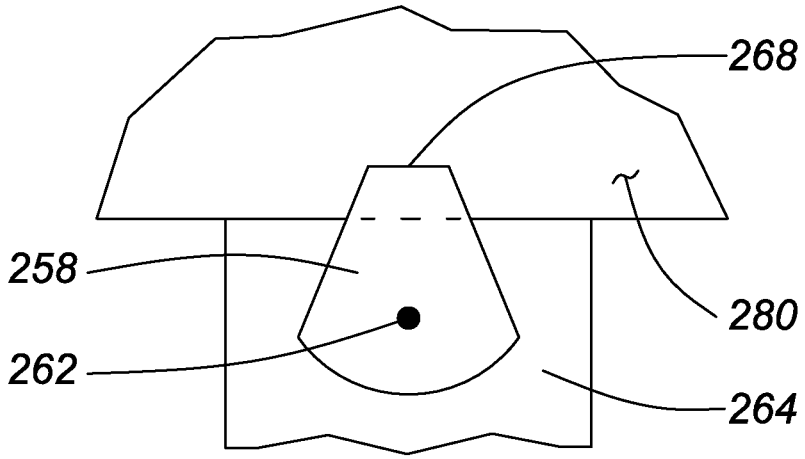
FIG. 24 is a partial top view of the boot coupling body and the boot toe body of FIGS. 22 and 23, with a clasp of the boot coupling body in a coupling position.
Figure 25:
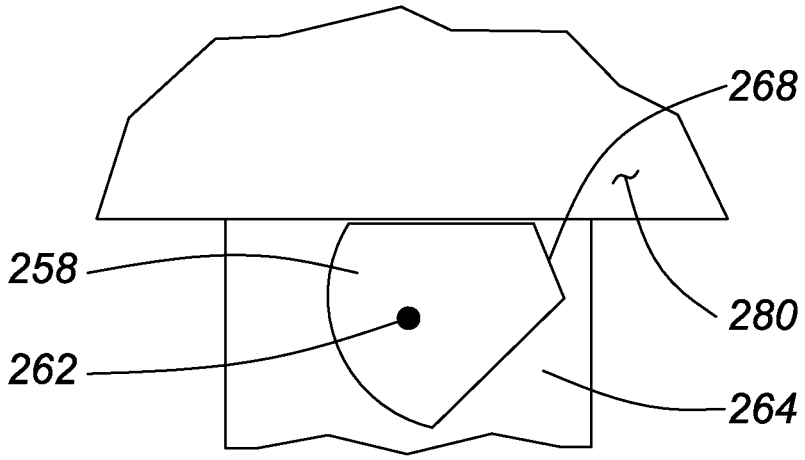
FIG. 25 is a partial top view of the boot coupling body and the boot toe body of FIGS. 22 and 23, with the clasp of the boot coupling body in a decoupling position.

Referring to FIGS. 24 and 25, when the clasp 258 is rotated about the axis of rotation 262 such that the retainer 268 is above the retaining surface 280, the retaining surface 270 contacts the retaining surface 280 to retain the clasp 258 in the receptacle 278, and the clasp 258 thus functions as a connector (or as a boot connector) to connect the boot coupling body 252 to the boot toe body 272. The clasp 258 is thus a boot connector, and the receptacle 278 is thus a complementary boot connector, so the retaining surface 270 is a retaining surface for contacting the retaining surface 280 of the receptacle 278 (which is a complementary boot connector) to connect the clasp 258 (which is a boot connector) to the receptacle 278, and the retaining surface 280 is a retaining surface of the receptacle 278, which is a complementary boot connector. Further, the clasp 258 is therefore a means for connecting a fin body (coupled to the boot coupling body 252) to the boot toe body 272 at a complementary boot connector (the receptacle 278) of the boot toe body 272 on the bottom side 276 of the boot toe body 272, the clasp 258 including the retaining surface 270 on the top side 271 of the bottom portion 255 of the boot coupling body 252 for contacting the retaining surface 280 of the complementary boot connector (the receptacle 278). However, when the clasp 258 is rotated about the axis of rotation 262 such that the retainer 268 is no longer positioned over the retaining surface 280, then the clasp 258 no longer connects the boot coupling body 252 to the boot toe body 272 at the receptacle 278, and the boot coupling body 252 is thus decoupled from the boot toe body 272.

Figure 26:
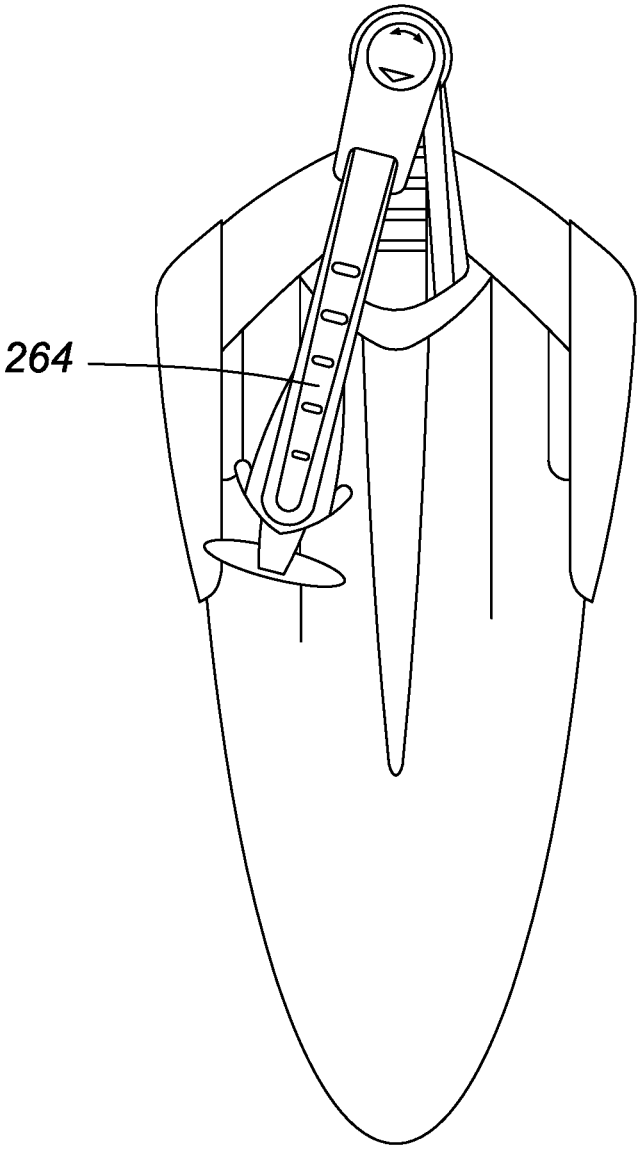
FIG. 26 is a bottom view of a fin apparatus including the boot coupling body of FIG. 22, with a heel coupling body of the boot coupling body in a stowed position.
Figure 28:
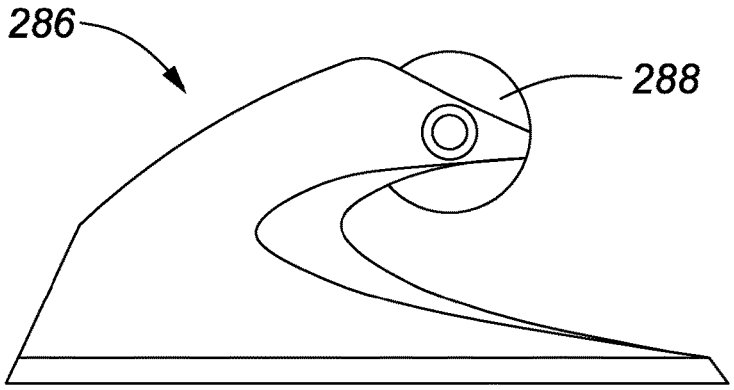
FIG. 28 is a side view of a clasp according to another embodiment.
Figure 29:
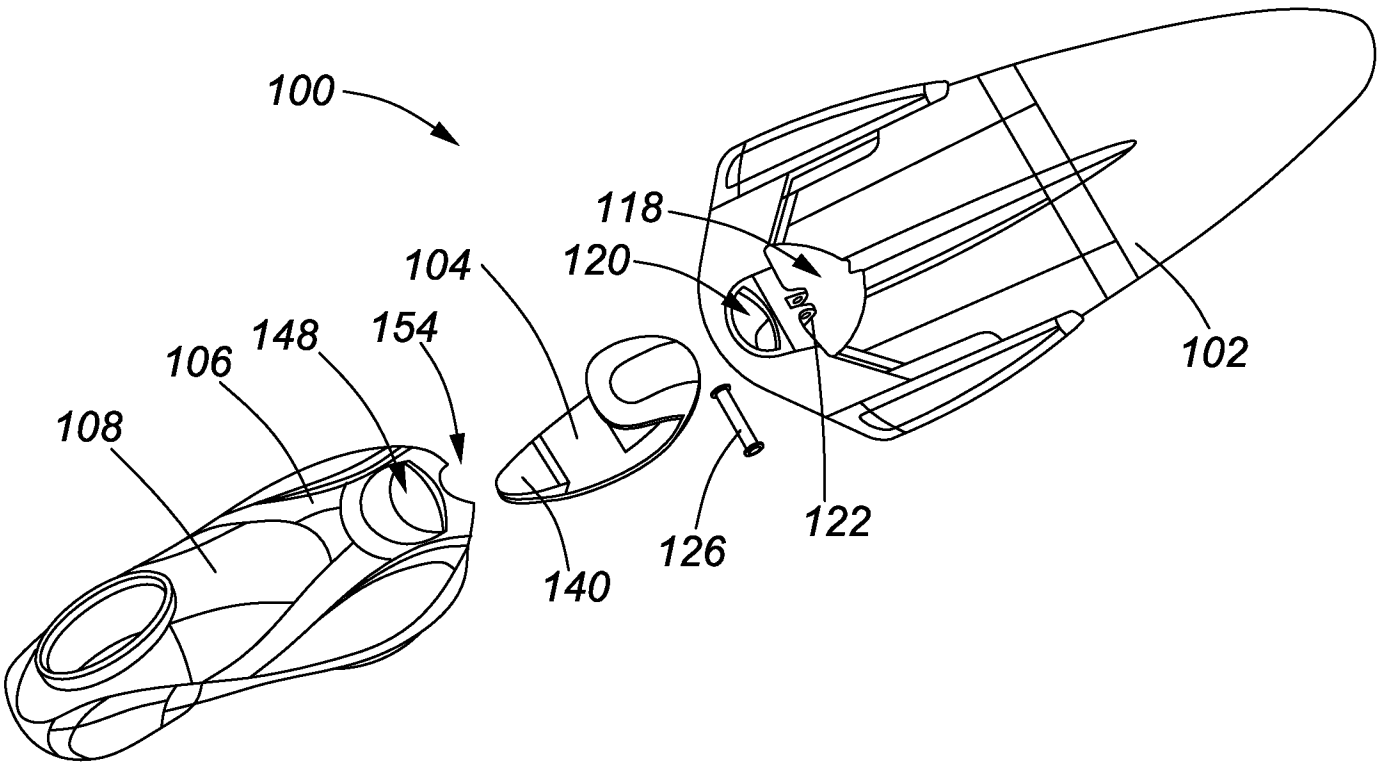
FIG. 29 is another exploded top perspective view of the fin system of FIG. 1.
Figure 30:
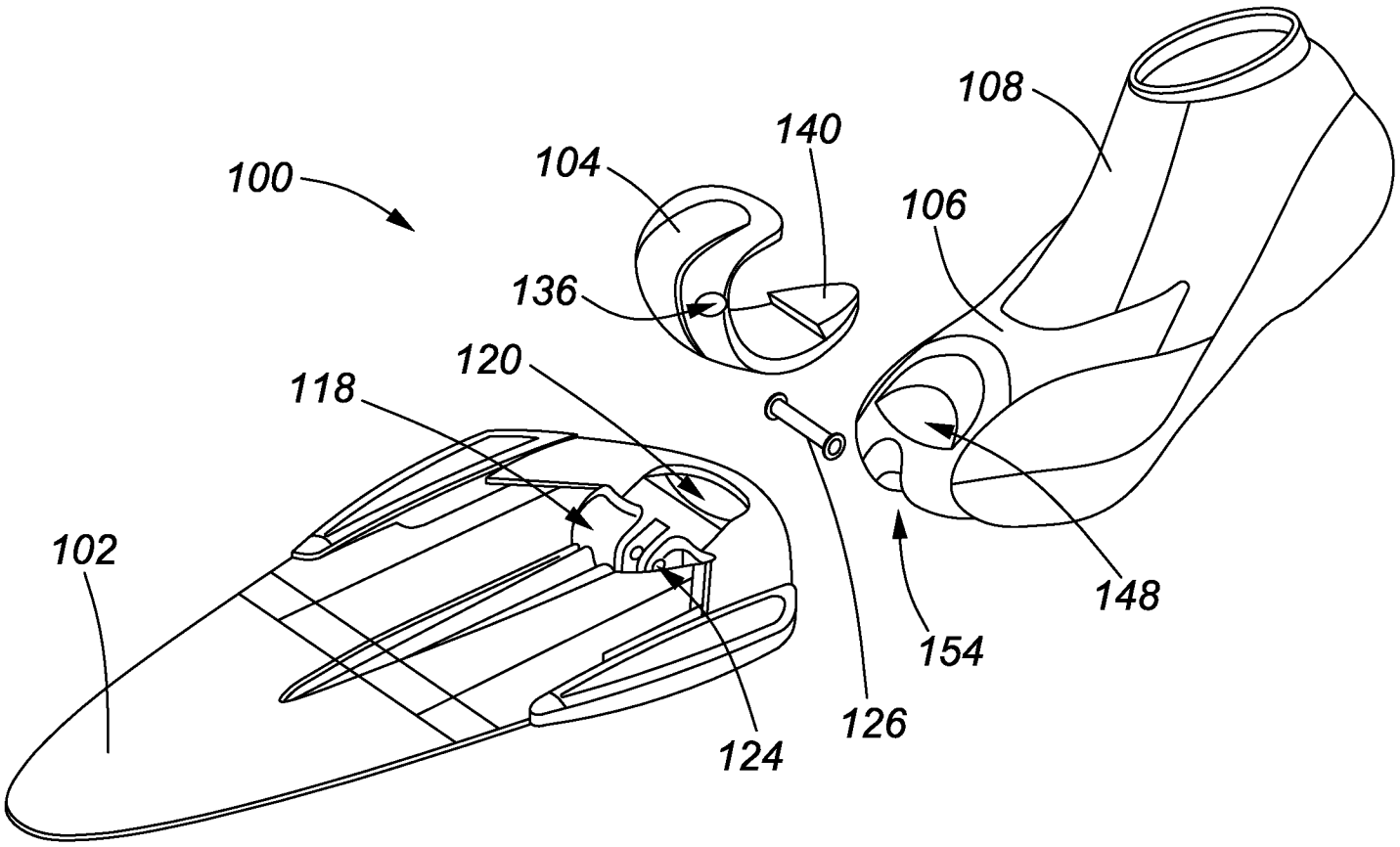
FIG. 30 is another exploded top perspective view of the fin system of FIG. 1.
Figure 31:
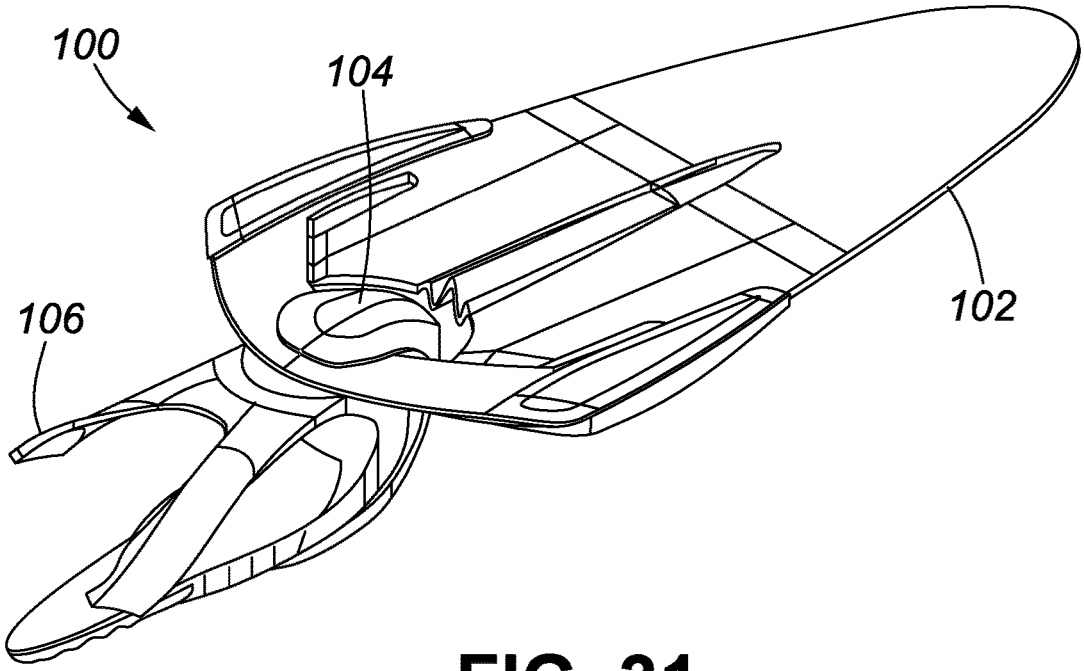
FIG. 31 is a top perspective view of the fin apparatus and the boot toe body of the fin system of FIG. 1.
Figure 32:
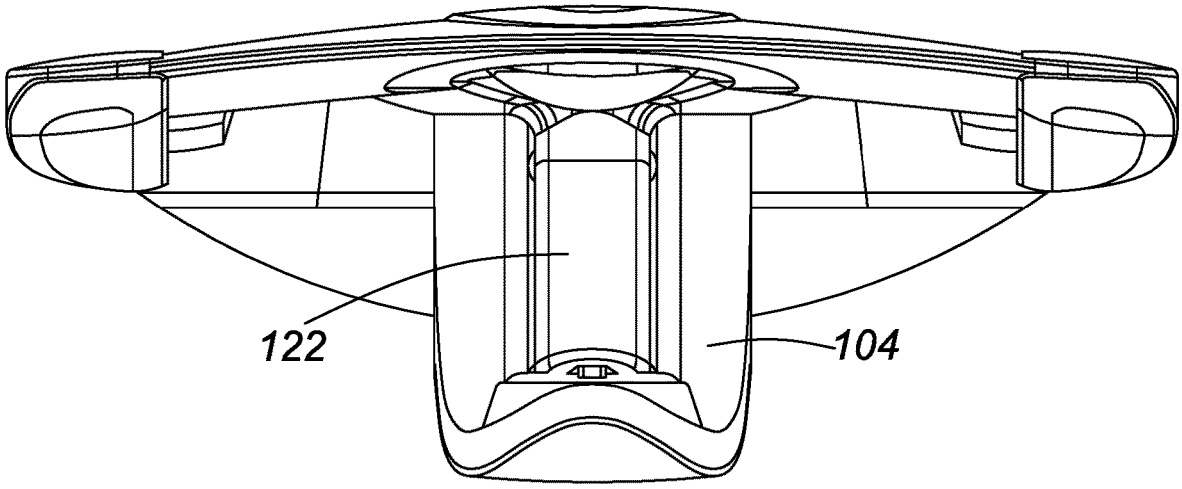
FIG. 32 is a proximal end view of the fin apparatus of the fin system of FIG. 1.
Figure 33:
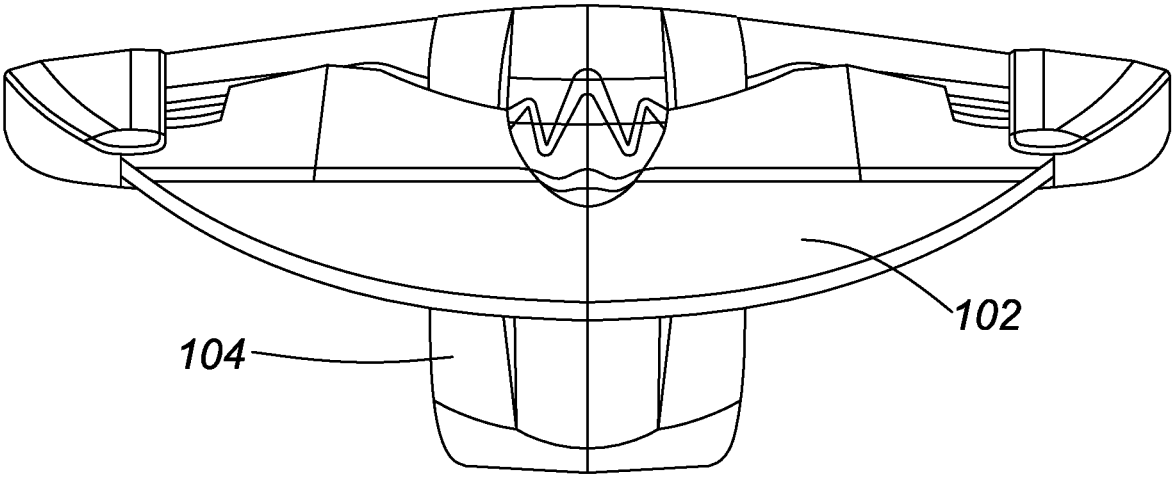
FIG. 33 is a distal end view of the fin apparatus of the fin system of FIG. 1.
Figure 34:
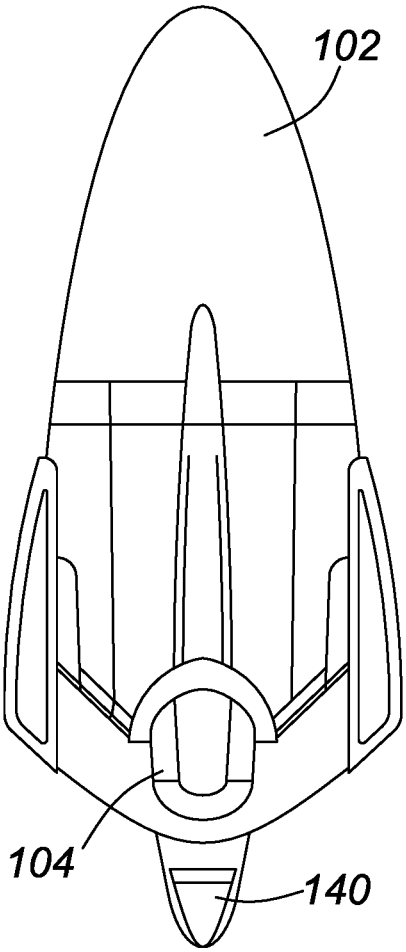
FIG. 34 is a top view of the fin apparatus and the boot toe body of the fin system of FIG. 1.
Figure 35:
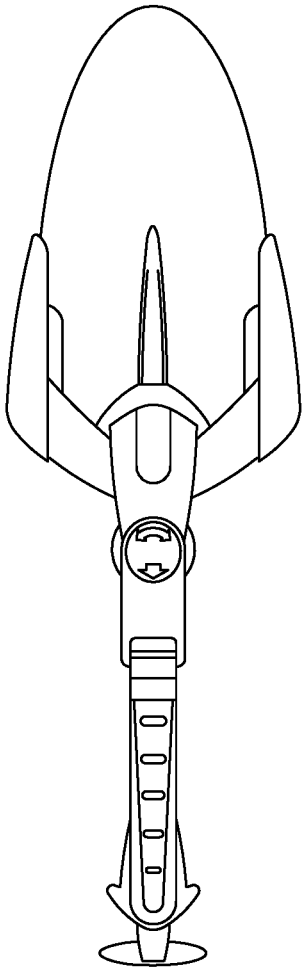
FIG. 35 is a bottom view of a boot coupling body and a fin body according to another embodiment.
Figure 36:
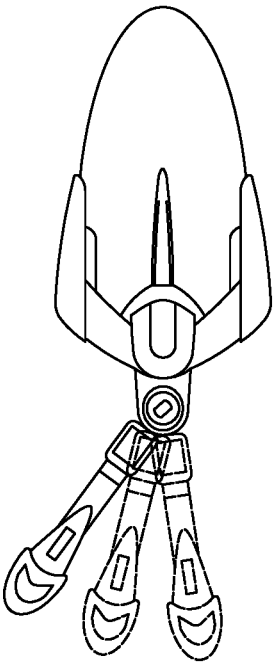
FIG. 36 is a bottom view of a boot coupling body and a fin body according to another embodiment.

In some embodiments, the clasp 258 may be made of a material such as polytetrafluoroetheylene (or TEFLON™), or may include an insert of such material, to reduce friction and facilitate sliding on the retaining surface 280. FIG. 28 illustrates a clasp (or boot clasp) shown generally at 286 according to another embodiment. The clasp 286 includes a roller (or reel) 288 to facilitate snapping over the retaining surface 280. The roller 288 may also be made of a material such as polytetrafluoroetheylene (or TEFLON™), or may include an insert of such material, to reduce friction and facilitate sliding on the retaining surface 280. The roller 288 may also have an elliptical cross-sectional shape to facilitate snapping over the retaining surface 280, for example to facilitate snapping a fin apparatus into a boot toe body when the clasp 286 is in a coupling position (similar to the position shown in FIG. 24) or a partial coupling position (between positions similar to the positions shown in FIGS. 24 and 25), for example for snapping in when in use in water. Referring to FIG. 26, the heel coupling body 264 may be rotated into a stowed position towards a distal end of the fin to facilitate storing or transporting the fin apparatus. FIGS. 35 to 39 illustrate other embodiments including rotatable clasps coupled to heel coupling bodies.

The embodiment of FIGS. 22-26 may facilitate a simple and intuitive method of coupling and decoupling a fin apparatus to a boot because a user may couple a fin apparatus to a boot, with only one hand and in a single action, by rotating the heel coupling body 264 to a position where the heel coupling body 264 is connected to a heel portion of the boot, and the user may decouple the fin apparatus from the boot, again with only one hand and in a single action, by rotating the heel coupling body 264 to a position where the heel coupling body 264 is disconnected to a heel portion of the boot. The heel coupling body 264 may include a safety lock (not shown) to prevent accidental release.

Figure 27:
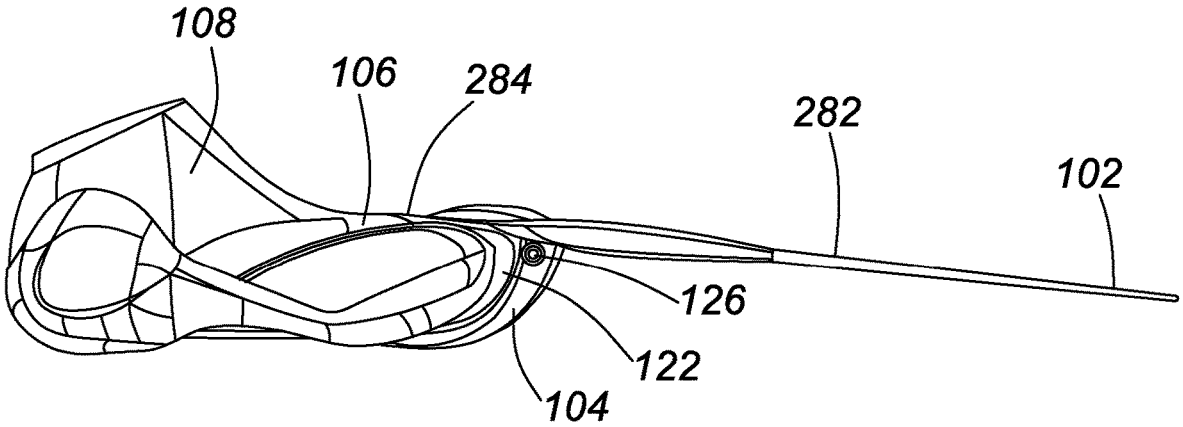
FIG. 27 is a side view of the fin system of FIG. 1.

Referring to FIG. 27, the fin system of FIG. 1 is shown assembled, and a top surface 282 of the fin body 102 is generally coplanar with a top surface 284 of the boot toe body 106. As indicated above, a swimmer using fin systems, such as the fin systems described above, often faces downward when swimming, so that the top surface 282 and the top surface 284 face generally downward when in use. Also, a swimmer's strongest kick is often a downward kick, so a swimmer's propulsion often depends largely on forceful downward kicks. During downward kicks, water flows over the top surface 284 and the top surface 282, and in some embodiments, positioning the top surface 282 generally coplanar with the top surface 284 may enable more laminar and efficient flow of water from the top surface 284 to the top surface 282 during such downward kicks. Therefore, positioning the fin body 102 with the top surface 282 generally coplanar with the top surface 284, as shown in the embodiments described above, may permit more efficient fluid flow than when compared to other fin systems.

Figure 43:
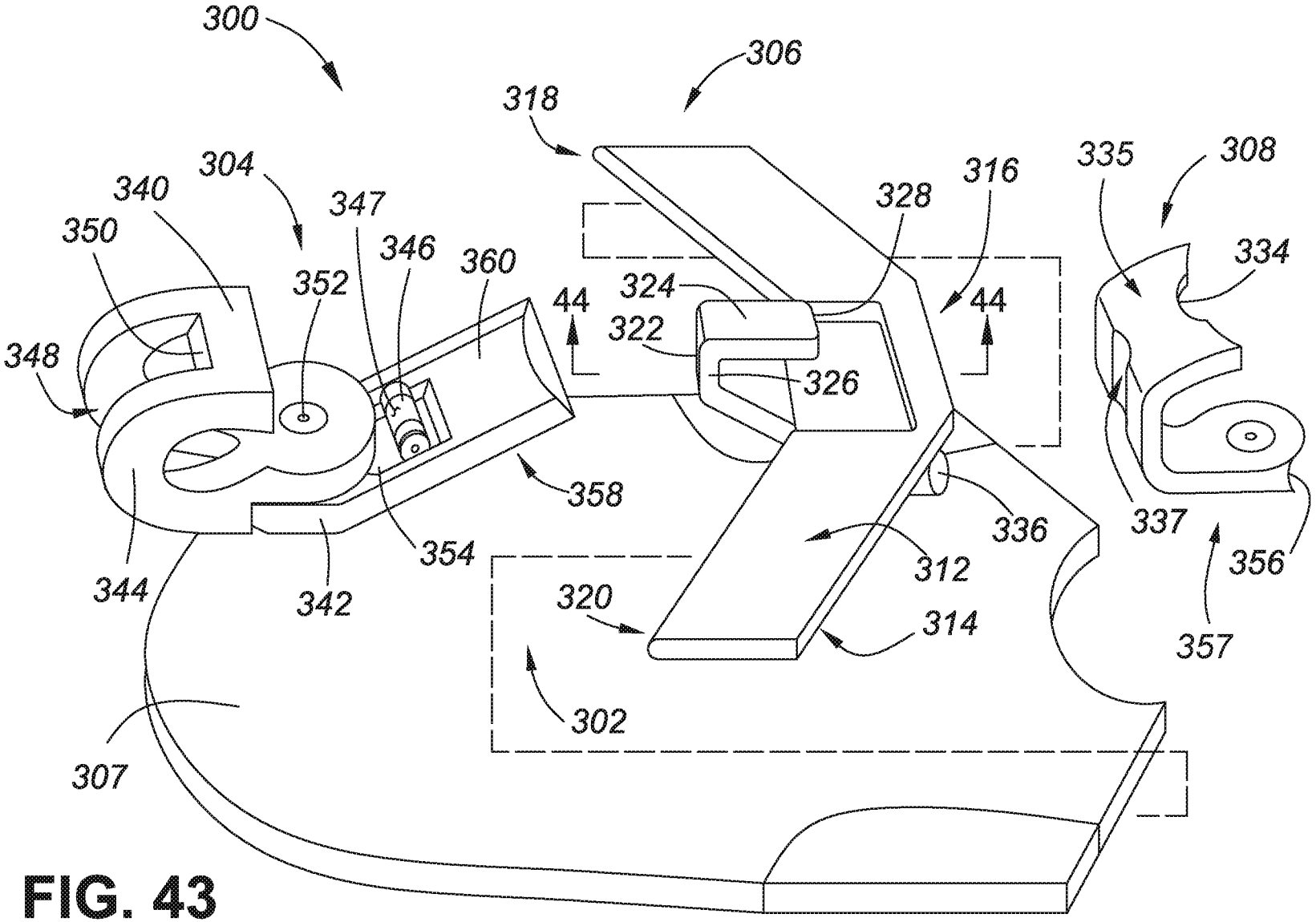
FIG. 43 is an exploded top perspective view of a fin system according to another embodiment.

Referring to FIG. 43, a fin system according to another embodiment is shown generally at 300 and includes a boot coupling body shown generally at 302. The boot coupling body 302 includes a coupling body 304 and a fin frame 306. The fin system 300 also includes a boot toe body 308 attachable to a boot (not shown). The fin frame 306 may be integrally, permanently, detachably, or non-detachably coupled to a fin body 307, and when the fin frame 306 is coupled to the fin body 307, the fin frame 306 and the fin body 307 may together function substantially the same as other fin bodies described above, such as the fin body 102 or the fin bodies shown in FIGS. 16, 21, 26, 35, 36, and 42 for example. Still further, other fin bodies described above, such as the fin body 102 or the fin bodies shown in FIGS. 16, 21, 26, 35, 36, and 42 for example, may be understood to include a fin frame (similar to the fin frame 306, for example) detachably or non-detachably coupled to a fin body (similar to the fin body 307, for example), and boot coupling bodies such as those described herein may be detachably coupled to such fin frames.

The fin frame 306 has a top side shown generally at 312, a bottom side shown generally at 314, a proximal end shown generally at 316, distal ends shown generally at 318 and 320, and a retaining member (or fin retaining member) 322 extending longitudinally away from the proximal end 316 and laterally centered between the two distal ends 318 and 320. The retaining member 322 also rises out from the top side 312 of the fin frame before curving in a generally semi-circular shape towards the proximal end 316. The retaining member 322 includes a top portion 324 and an intermediate portion 326. The top portion 324 of the retaining member 322 defines a retaining surface (or fin retaining surface) 328. The retaining member 322 is resiliently deformable such that exerting a downward force on the top portion 324 will reduce the space between the top portion 324 and the top side 312 of the fin frame 306.

Figure 44:
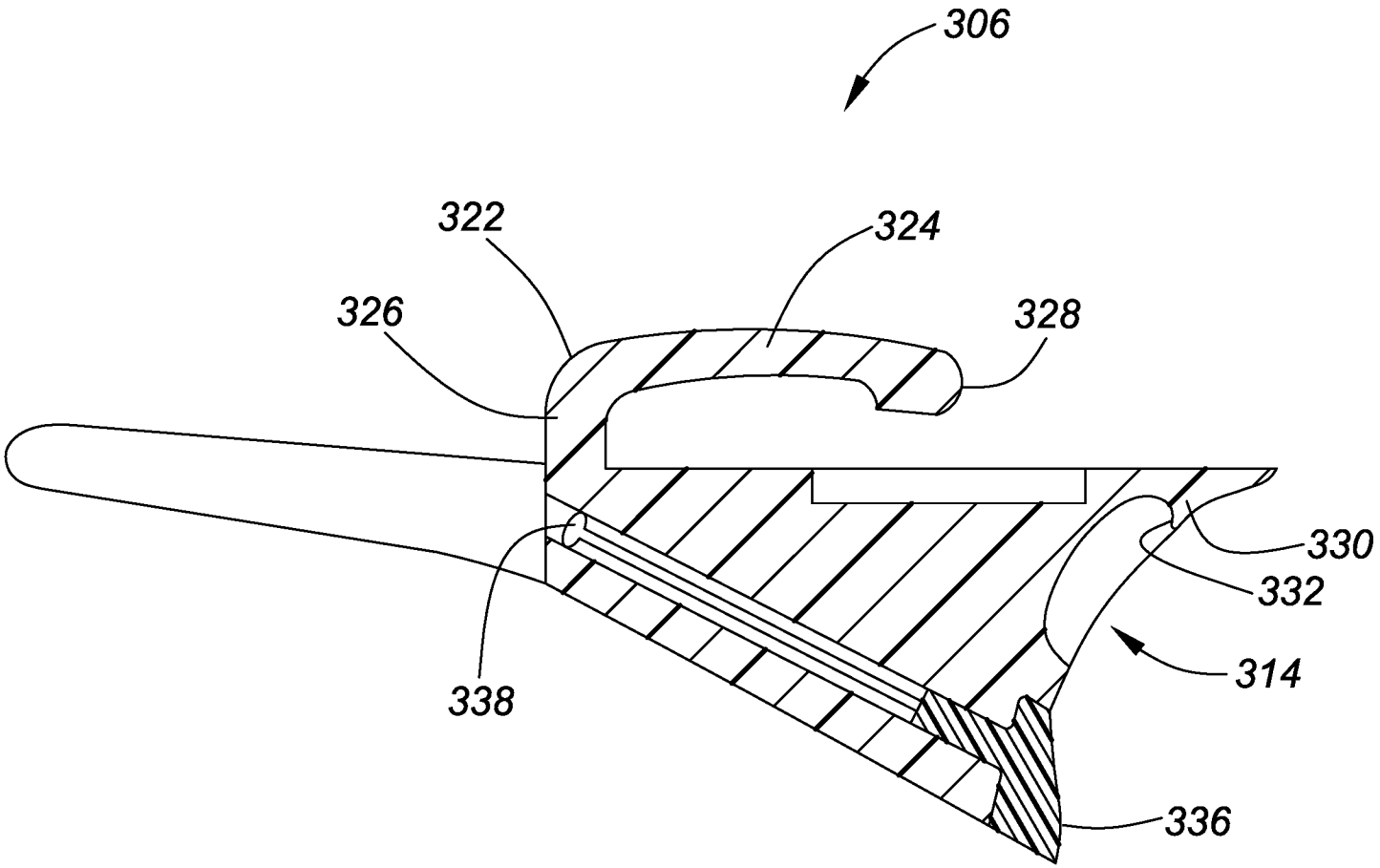
FIG. 44 is a side cross-sectional view of a fin frame of the fin system of FIG. 43, taken along the line 44-44 shown in FIG. 43.

Referring to FIGS. 43 and 44, the fin frame 306 also includes a holder (or a holding body or a first boot connector) 330 extending downward into a space from the bottom side 314 of the proximal end 316 of the fin frame 306. The holder 330 defines a retaining surface (or a holding surface) 332 complementary to a retaining surface (or a first complementary boot connector) 334 defined on a top side shown generally at 335 of the boot toe body 308. The fin frame 306 also defines an adjustable retaining surface 336 sized to be received in a corresponding recess 337 on the boot toe body 308. A position of the adjustable retaining surface 336 can be adjusted so as to adjust an amount by which the adjustable retaining surface 336 extends away from the remainder of the fin frame 306. In the embodiment shown, the position of the adjustable retaining surface 336 is adjusted using adjustment means including a threaded member 338 running through the center of the fin frame 306. Around the adjustable retaining surface 336 and below the holder 330, the fin frame 306 defines tapered surfaces so that when the boot toe body 308 approaches the fin frame 306, the fin frame 306 may automatically be centered or aligned relative to the boot toe body 308, which may facilitate coupling the boot toe body 308 to the boot coupling body 302 in a hands-free motion by "stepping in" as described below.

The coupling body 304 is similar to the boot coupling body 252 shown in FIG. 22, being curved in a generally-semi-circular shape having a top portion 340, a bottom portion 342, and an intermediate portion 344 extending between the top portion 340 and the bottom portion 342, and a clasp (or boot clasp or second boot connector) 346 on the bottom portion 342 of the coupling body 304 (and thus on a bottom portion 345 of the boot coupling body 302, which, as indicated above, includes the coupling body 304). A retaining surface 347 of the clasp 346 is on a top side shown generally at 349 of the bottom portion 345 of the boot coupling body 302. The intermediate portion 344 defines a through-hole 348 sized to receive the retaining member 322 of the fin frame 306. The through-hole 348 defines a retaining surface (or fin retaining surface) 350 complementary to the retaining surface 328 of the retaining member 322 such that when the retaining member 322 is received in the through-hole 348 of the coupling body 304, the retaining surfaces 350 and 328 act as connectors (or as boot connectors) to couple the fin frame 306 to the coupling body 304. Further, the retaining surfaces 350 and 328 may be separated from each other to allow the retaining member 322 to be removed from the through-hole 348 to detach the fin frame 306 from the coupling body 304. The boot coupling body 302 of the embodiment shown may thus include the fin frame 306 coupled (or detachably couplable) to the coupling body 304.

Figure 45:
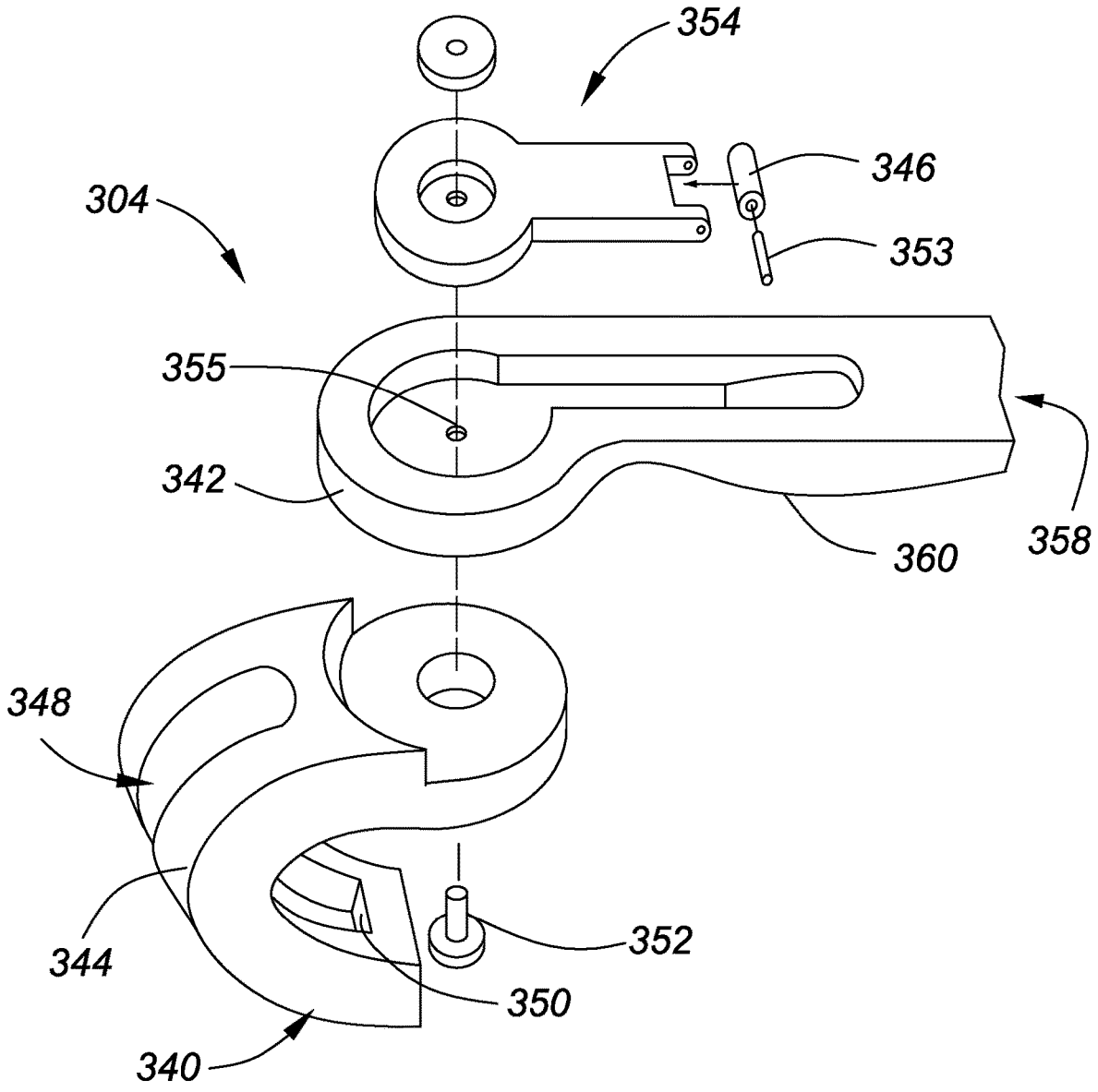
FIG. 45 is an exploded bottom perspective view of a coupling body of the fin system of FIG. 43.

Referring to FIG. 45, the clasp 346 of the coupling body 304 is coupled to a support body 354 with a cylindrical fastener 353 to permit the clasp 346 to rotate relative to the support body 354. The support body 354 is coupled to the bottom portion 342 and to the coupling body 304 with a fastener 352 such that the bottom portion 342, and thus the support body 354 and the clasp 346, can rotate about an axis of rotation 355 defined by the fastener 352. The support body 354 is resiliently deformable to allow the clasp 346 to move resiliently away from a resting position in a downward direction. The boot coupling body 302 is thus resiliently deformable (at least by resilient deformation of the support body 354, which also functions as a spring) to vary a separation distance between the holder 330 and the clasp 346. Clasp 346 is sized to be received by a retaining surface (or second complementary boot connector, or retaining surface of a second complementary boot connector) 356 on a bottom side shown generally at 357 of the boot toe body 308 such that the retaining surface 347 on the clasp 346 is positionable against the retaining surface 356 of the boot toe body 308 to connect the clasp 346 to the retaining surface 356, so the retaining surface 347 is a retaining surface for contacting the retaining surface 356 (which is a second complementary boot connector) to connect the clasp 346 (which is a second boot connector) to the retaining surface 356.

The coupling body 304 also has an aligning member shown generally at 358, which is rotationally coupled to the support body 354 such that rotation of the aligning member 358 around the axis of rotation 355 causes similar rotation of the support body 354 around the axis of rotation 355. The aligning member 358 therefore facilitates causing rotation of the clasp 346 around the axis of rotation 355. The aligning member 358 also defines a curved retaining surface 360 and which extends longitudinally beyond the clasp 346 and is sized to be received by a longitudinal recess in the sole of a boot or a boot toe body such as boot toe body 308 (as shown in FIG. 13, for example). In some embodiments, the aligning member 358 may be replaced by rigid lever 182 in FIG. 10 or a heel coupling body such as heel coupling body 202 in FIG. 15 or any of the heel coupling bodies shown in FIGS. 17-22. In embodiments including a heel coupling body, the heel coupling body may also be rotatably coupled to the clasp 346 for rotation around the axis of rotation 355, and thus when the heel coupling body is coupled to a connector (or boot connector) on a heel of a boot, the heel coupling body may prevent movement of the clasp 346, which may prevent release of the clasp 346 from the retaining surface 356 and thus prevent release of the boot coupling body 302 from the boot toe body 308.

Figure 46:
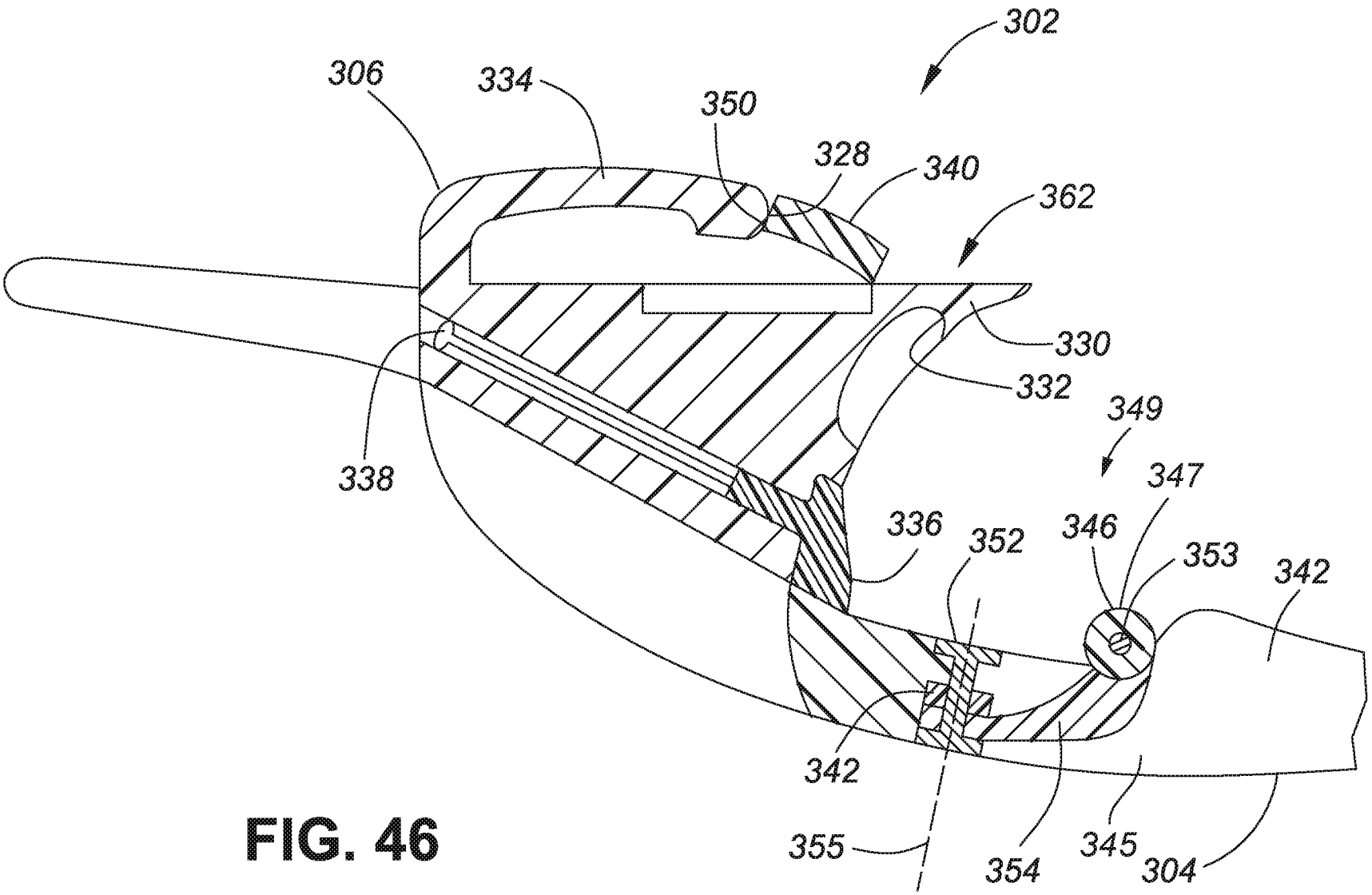
FIG. 46 is a cross-sectional view of a boot coupling body including the fin frame and the coupling body of the fin system of FIG. 43.

When the boot coupling body 302 is assembled with the fin frame 306 coupled to the coupling body 304 with the retaining member 322 received in the through-hole 348 as shown in FIG. 46, a top portion shown generally at 362 of the boot coupling body 302 (which, as indicated above, includes the coupling body 304 and the fin frame 306) includes the holder 330 and the retaining surface 332, so the holder 330 and the retaining surface 332 are on the top portion 362 of the boot coupling body 302. Further, when the boot coupling body 302 is assembled with the fin frame 306 coupled to the coupling body 304 with the retaining member 322 received in the through-hole 348 as shown in FIG. 46, a user, wearing a boot including or coupled to the boot toe body 308, can connect a connector or first boot connector (the retaining surface 332) to a complementary connector or first complementary boot connector (the retaining surface 334 shown in FIG. 43) and then exert a force downward onto the clasp 346, causing resilient deformation of the support body 354 as the clasp 346 moves resiliently downward until the clasp 346 rolls over the edge of retaining surface 356 and "snaps" into place against the clasp 346 as the support body 354 resiliently urges the clasp 346 upward again, thereby connecting the clasp 346 to the retaining surface 356. The clasp 346 is thus a roller, and the boot toe body 308 may thus be coupled to the boot coupling body 302 in a hands-free motion by "stepping in" to the boot coupling body 302. Therefore, the holder 330 is a means for connecting the fin body 307 (when coupled to the boot coupling body 302, which includes the coupling body 304 and the fin frame 306) to the boot toe body 308 at a first complementary boot connector (the retaining surface 334) of the boot toe body 308 on the top side 335 of the boot toe body 308, and the clasp 346 is a means for connecting the fin body 307 (when coupled to the boot coupling body 302, which includes the coupling body 304 and the fin frame 306) to the boot toe body 308 at a second complementary boot connector (the retaining surface 356) of the boot toe body 308 on the bottom side 357 of the boot toe body 308, the clasp 346 including the retaining surface 347 on the top side 349 of the bottom portion 345 of the boot coupling body 302 for contacting the retaining surface 356 (which is a second complementary boot connector).

Alternatively, the user, wearing a boot including or coupled to the boot toe body 308, can connect a connector or first boot connector (the holder 330) to a complementary connector or first complementary boot connector (the retaining surface 334 shown in FIG. 43) when the clasp 346 is rotated about the axis of rotation 355 into a position in which the clasp 346 can approach the retaining surface 356 without contacting the retaining surface 356, and then the clasp 346 may be rotated about the axis of rotation 355 into a position in which the clasp 346 is connected to the retaining surface 356. As shown in FIG. 46, the axis of rotation 355 has an angle that is inclined on the top side away from the fin frame 306 and on the bottom side towards the fin frame 306, and such an angle causes the clasp 346 to move downward (and thus in a direction away from a top side and into contact with the retaining surface 356) when the clasp 346 is rotated about the axis of rotation 355 in a direction that causes the clasp 346 to be connected to the retaining surface 356.

Either way, once the clasp 346 is connected to the retaining surface 356, the boot toe body 308 is coupled to the boot coupling body 302, and the adjustable retaining surface 336 will be received against a retaining surface in the recess 337, the retaining surface 332 of holder 330 will be received against the retaining surface 334, and the clasp 346 will be received against retaining the surface 356, effectively locking the boot toe body 308 to the boot coupling body 302. Further, the curved retaining surface 360 may be received by a longitudinal recess in the sole of a boot or a boot toe body such as boot toe body 308 (as shown in FIG. 13, for example) when the clasp 346 has "snapped" into place against retaining surface 356.

The embodiment of FIGS. 43-46 may facilitate a simple and intuitive method of coupling and decoupling a fin apparatus to a boot because a user may couple a fin apparatus to a boot including or coupled to a boot toe body by engaging the holder against the retaining surface of the boot toe body, aligning the boot with the boot coupling body by rotating the aligning member such that the boot coupling body is aligned centrally with the boot toe body, and then pivoting the boot toe body relative to the boot coupling body about the generally transverse axis of rotation to cause the clasp and coupling to resiliently deform in the downward direction, causing it to approach the corresponding retaining surface of the boot toe body, until it "snaps" into position against the corresponding retaining surface of the boot toe body. Alternatively, the user may engage the holder against the retaining member 322 of the boot toe body when the clasp is rotated into a position in which the clasp can approach the retaining surface 356 without contacting the retaining surface 356, and then the clasp may be rotated into a position in which the clasp is connected to the retaining surface 356. Either way, the fin apparatus may be coupled to the boot until the clasp is rotated into a position in which the clasp may be separated from the retaining surface 356 to decouple the boot toe body 308 from the boot coupling body 302. As shown in FIG. 46, the axis of rotation 355 has an angle that is inclined on the top side away from the fin frame 306 and on the bottom side towards the fin frame 306, and such an angle causes the clasp 346 to move upward (and thus in a direction towards a top side and out of contact with the retaining surface 356) when the clasp 346 is rotated about the axis of rotation 355 in a direction that causes the clasp 346 to be separated from the retaining surface 356.

Figure 47:
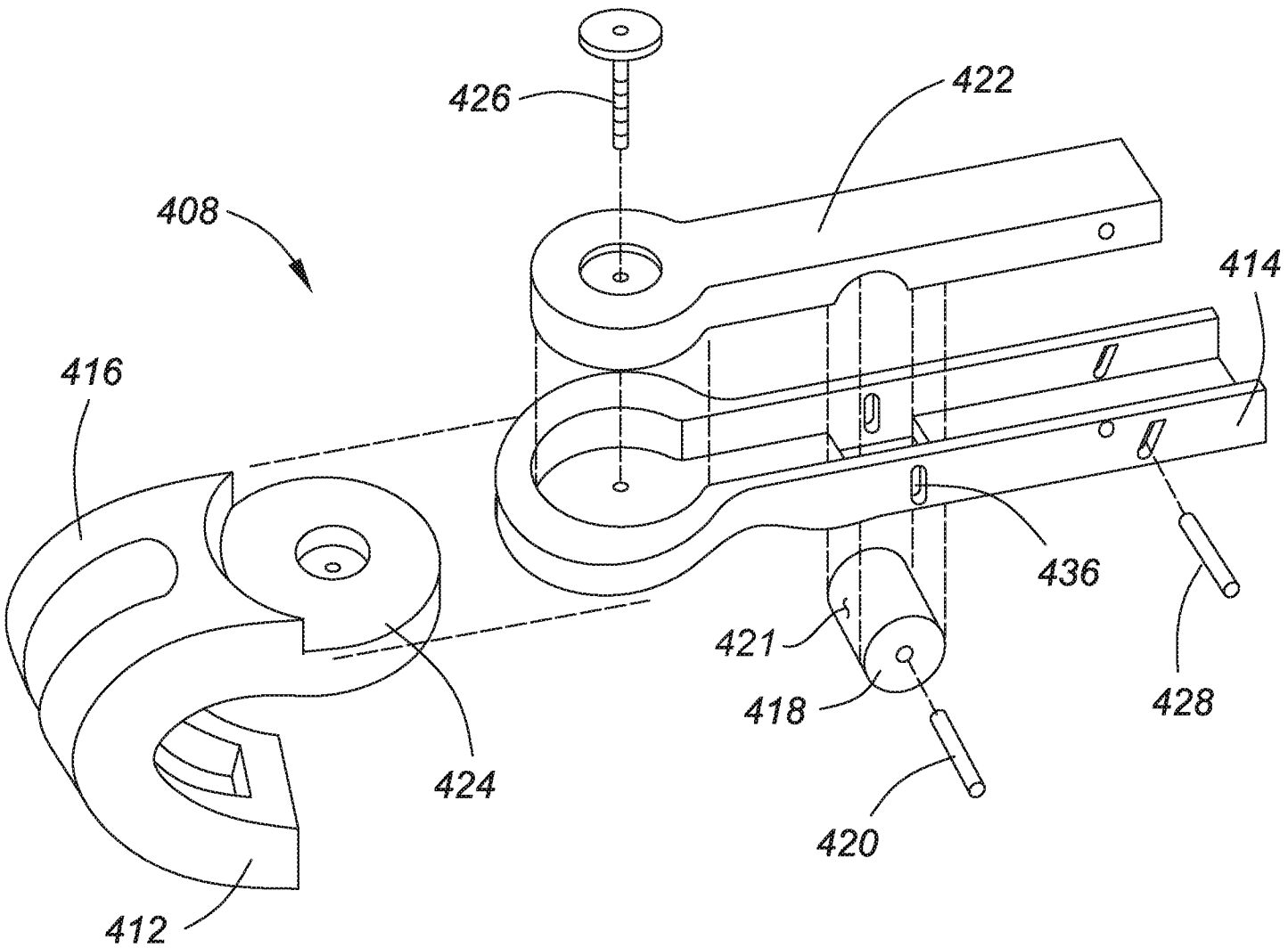
FIG. 47 is an exploded bottom perspective view of a coupling body according to another embodiment.
Figure 48:
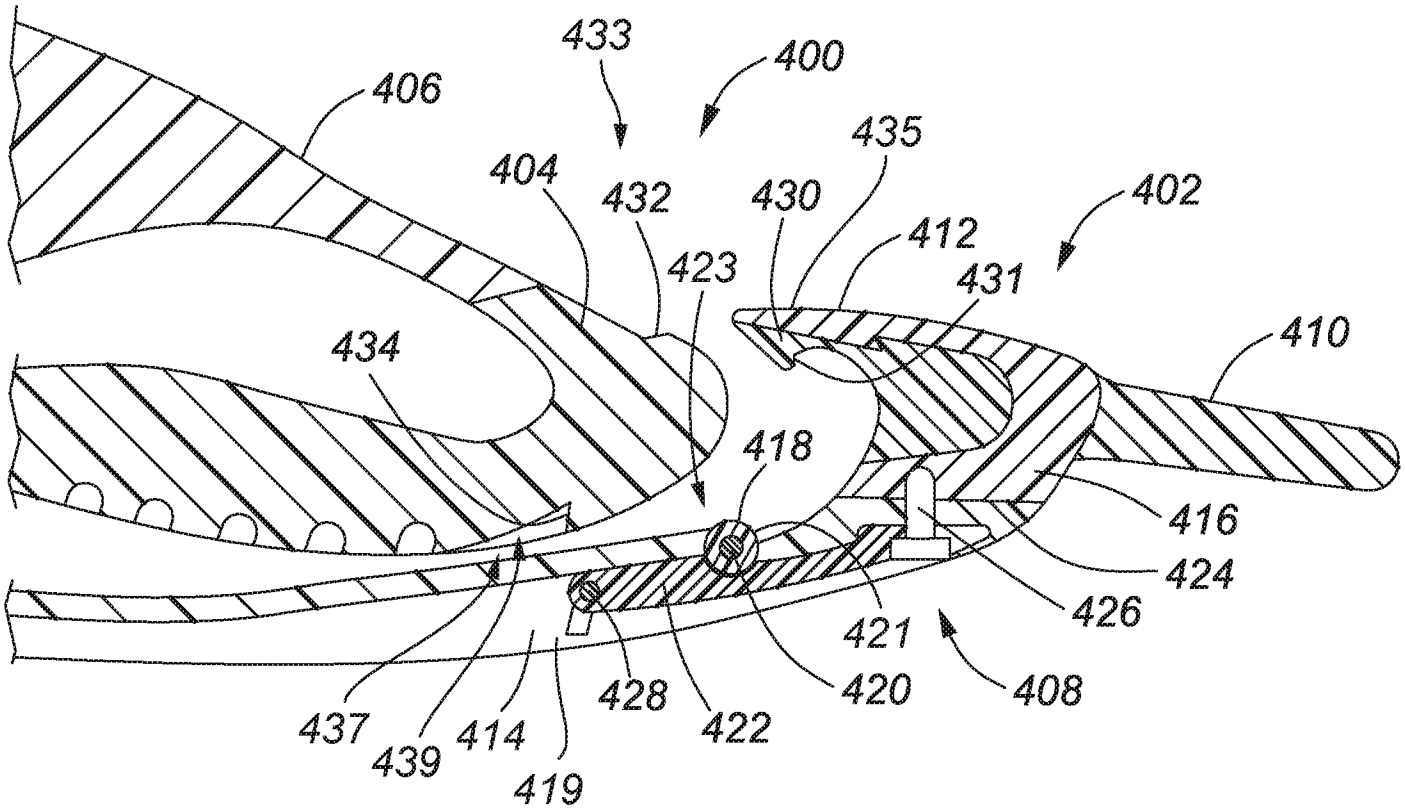
FIG. 48 is a side cross-sectional view of the coupling body of FIG. 47 and a boot toe body according to the embodiment of FIG. 47.

Referring to FIGS. 47 and 48, a fin apparatus 400 according to another embodiment includes a boot coupling body shown generally at 402. The fin apparatus 400 also includes a boot toe body 404 integral to or permanently coupled to the boot 406. In alternative embodiments, the boot toe body 404 may be removably coupled to the boot 406. The boot coupling body 402 includes a coupling body 408 and a fin frame 410. In some embodiments, a fin body (not shown) can be integrally or permanently coupled to the fin frame 410. In other embodiments, a fin body can be removably coupled to the fin frame 410.

In the embodiment shown, the fin frame 410 may be removably coupled to the coupling body 408 to form the boot coupling body 402. In some embodiments, the fin frame 410 may be removably coupled to coupling body 408 using two corresponding retaining surfaces on each of the fin frame 410 and coupling body 408, such as the method described in reference to FIGS. 43-46.

Fin frame 410 defines a holder (or a holding body or a first boot connector) 430 defining a retaining surface (or a holding surface) 431, which may be sized to be received against a retaining surface (or a first complementary boot connector) 432 on a top side shown generally at 433 of the boot toe body 404 when the boot coupling body 402 is coupled to boot toe body 404. A top portion 435 of the boot coupling body 402 (which, as indicated above, includes the fin frame 410) includes the holder 430 and the retaining surface 431.

The coupling body 408 is similar to the boot coupling body 252 described in FIG. 22, being curved in a generally semi-circular shape having a top portion shown generally at 412, a bottom portion 414, and an intermediate portion 416 extending between the top portion 412 and the bottom portion 414, and a clasp (or boot clasp or second boot connector) 418 affixed to the bottom portion 414 of the coupling body 408 (and is thus on a bottom portion 419 of the boot coupling body 402, which, as indicated above, includes the coupling body 408) with a fastener 420. A retaining surface 421 of the clasp 418 is on a top side shown generally at 423 of the bottom portion 419 of the boot coupling body 402. Fastener 420 affixes the clasp 418 by extending laterally through slot 436 and permits rotation of the clasp 418 relative to the bottom portion 414, so the clasp 418 is also a roller. Slot 436 is elongated in a generally vertical orientation, thereby allowing the fastener 420 (and therefore the clasp 418) to move vertically up and down within the slot 436. Clasp 418 can be similar to the clasp 286 shown in FIG. 28.

The bottom portion 414 of the coupling body 408 may extend longitudinally away from the front of the boot 406, and may include a rigid lever such as rigid lever 182 in FIG. 10 or a heel coupling body such as heel coupling body 202 in FIG. 15 or any of the heel coupling bodies recited in FIGS. 17-22. The bottom portion 414 of boot coupling body 408 may be sized to be received in a longitudinal recess, which may be in the sole of boot 406 or on the bottom side of boot toe body 404 (not shown).

The intermediate portion 416 of the coupling body 408 defines a rotational interface 424 about which either the top portion 412 or bottom portion 414 of coupling body 408 may rotate. Fastener 426 acts as a rotational pivot about which such rotation takes place, and also couples together the top portion 412 and bottom portion 414 of the coupling body 408. Rotation of the coupling body 408 when coupled to the fin frame 410 may provide an advantage in storage and protection for the fin apparatus 400 while in transit or while not in use because the bottom portion 414 of coupling body 408 can rotate around so as to be parallel with fin frame 410, thereby reducing the size of the overall apparatus and protecting the bottom portion 414 (which may include a long longitudinal extension such as a heel coupling body or rigid lever).

In the embodiment shown, the clasp 418 is positioned above but not attached to a spring 422, which is made of a resiliently deformable material. Spring 422 is fixed within the bottom portion 414 of the coupling body 408 using fasteners 426 and 428. Clasp 418 will move downward against spring 422 when a downward force is applied to clasp 418. Because spring 422 is resiliently deformable, clasp 418 will return to its original position upon removal of any downward force acting upon it. The boot coupling body 402 is thus resiliently deformable (at least by resilient deformation of the spring 422) to vary a separation distance between the holder 430 and the clasp 418.

The boot toe body 404 defines a retaining surface 432 sized to receive the holder 430. The boot toe body 404 also defines a retaining surface (or retaining surface of a second complementary boot connector) 434 on a bottom side shown generally at 437 of the boot toe body 404 and in a receptacle (or second complementary boot connector) shown generally at 439 on the bottom side 437 of the boot toe body 404, and the retaining surface 434 is a retaining surface of the receptacle 439, which is a second complementary boot connector. The retaining surface 434 is sized to receive the clasp 418 of the coupling body 408 such that the retaining surface 421 of the clasp 418 is positionable against the retaining surface 434 of the boot toe body 404 to couple the boot coupling body 402 to boot toe body 404, so the retaining surface 421 is a retaining surface for contacting the retaining surface 434 of the receptacle 439 (which is a second complementary boot connector) to connect the clasp 418 (which is a second boot connector) to the receptacle 439. Further, the holder 430 is a means for connecting a fin body (coupled to the boot coupling body 402, which includes the coupling body 408 and the fin frame 410) to the boot toe body 404 at a first complementary boot connector (the retaining surface 432) of the boot toe body 404 on the top side 433 of the boot toe body 404, and the clasp 418 is a means for connecting such a fin body to the boot toe body 404 at a second complementary boot connector (the receptacle 439) of the boot toe body 404 on the bottom side 437 of the boot toe body 404, the clasp 418 including the retaining surface 421 on the top side 423 of the bottom portion 419 of the boot coupling body 402 for contacting the retaining surface 434 of the second complementary boot connector (the receptacle 439).

The embodiment shown may facilitate a simple and intuitive method of coupling and decoupling a fin apparatus including at least boot coupling body 402 and boot toe body 404. A user may couple boot coupling body 402 to a boot including a boot toe body 404 by engaging the holder 430 against the retaining surface 432 of the boot toe body 404, aligning the boot toe body 404 with the boot coupling body 402 by rotating the bottom portion 414 around the axis of rotation defined by fastener 426 such that the clasp 418 is aligned with retaining surface 434 of the boot toe body 404, and then pivoting the boot toe body 404 relative to the boot coupling body 402 about a generally transverse axis of rotation formed between the top portion 412 and bottom portion 414 of the coupling body 408 so as to cause the boot toe body 404 to exert a downward force on clasp. The downward force on clasp 418 causes it to move in the downward direction due to the corresponding resilient deformation of spring 422. As the boot toe body 404 further deforms the spring 422, clasp 418 approaches the corresponding retaining surface 434 of the boot toe body 404 until it "snaps" into position against the corresponding retaining surface 434. Alternatively, the user may engage the holder against the retaining surface 432 of the boot toe body when the clasp is rotated into a position in which the clasp can approach the retaining surface 434 without contacting the retaining surface 434, and then the clasp may be rotated into a position in which the clasp is connected to the retaining surface 434. Either way, the fin apparatus may be coupled to the boot until the clasp is rotated into a position in which the clasp may be separated from the retaining surface 434.

Figure 64:
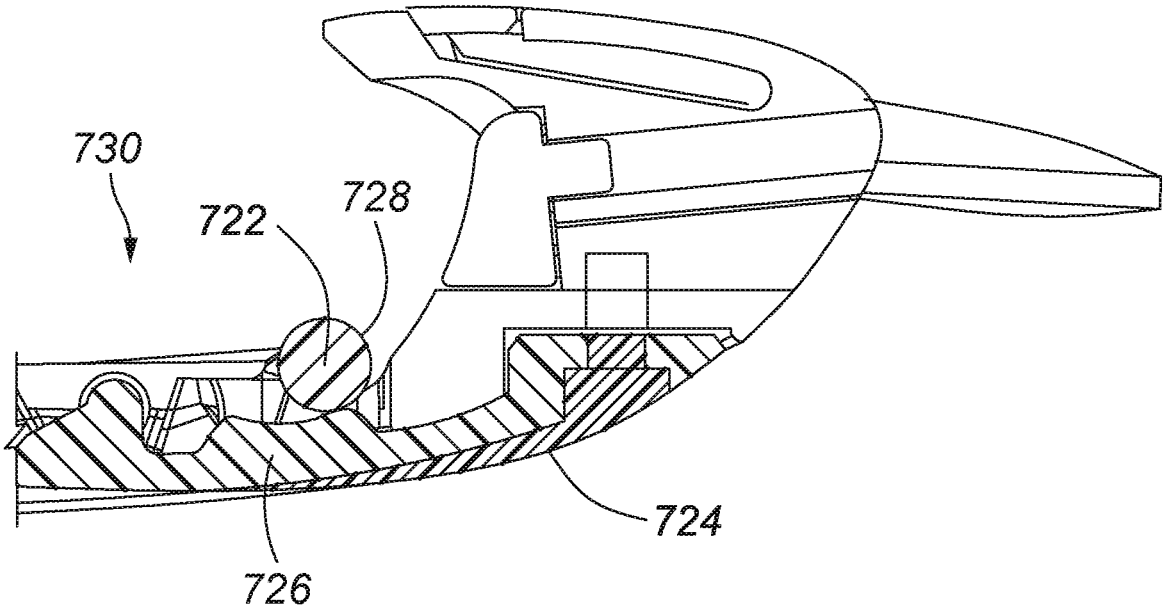
FIG. 64 is a side schematic illustration of a boot coupling body according to another embodiment.

FIG. 64 illustrates a boot coupling body according to another embodiment. The boot coupling body of FIG. 64 is similar to the boot coupling body 402 shown in FIGS. 47 and 48, and a bottom portion 726 of the boot coupling body of FIG. 64 includes a clasp, boot clasp, boot connector, or roller 722 that includes a retaining surface 728 on a top side shown generally at 730 of the bottom portion 726 and that is detached from and can move relative to a spring 724 in a recessed region defined by the spring 724. Springs such as the spring 724 may be thermoplastic leaf springs or other types of springs that may be made from other materials. Because the boot coupling body of FIG. 64 is similar to the boot coupling body 402 shown in FIGS. 47 and 48, the retaining surface 728 is also a retaining surface for contacting a retaining surface of a complementary boot connector on a bottom side of a boot toe body to connect the clasp 722, which is a boot connector, to the complementary boot connector on the bottom side of the boot toe body, and the clasp 722 is a means for connecting a fin body to a boot toe body at a complementary boot connector of the boot toe body on a bottom side of the boot toe body, the clasp 722 including the retaining surface 728 on the top side 730 of the bottom portion 726 for contacting a retaining surface of the complementary boot connector.

Figure 49:
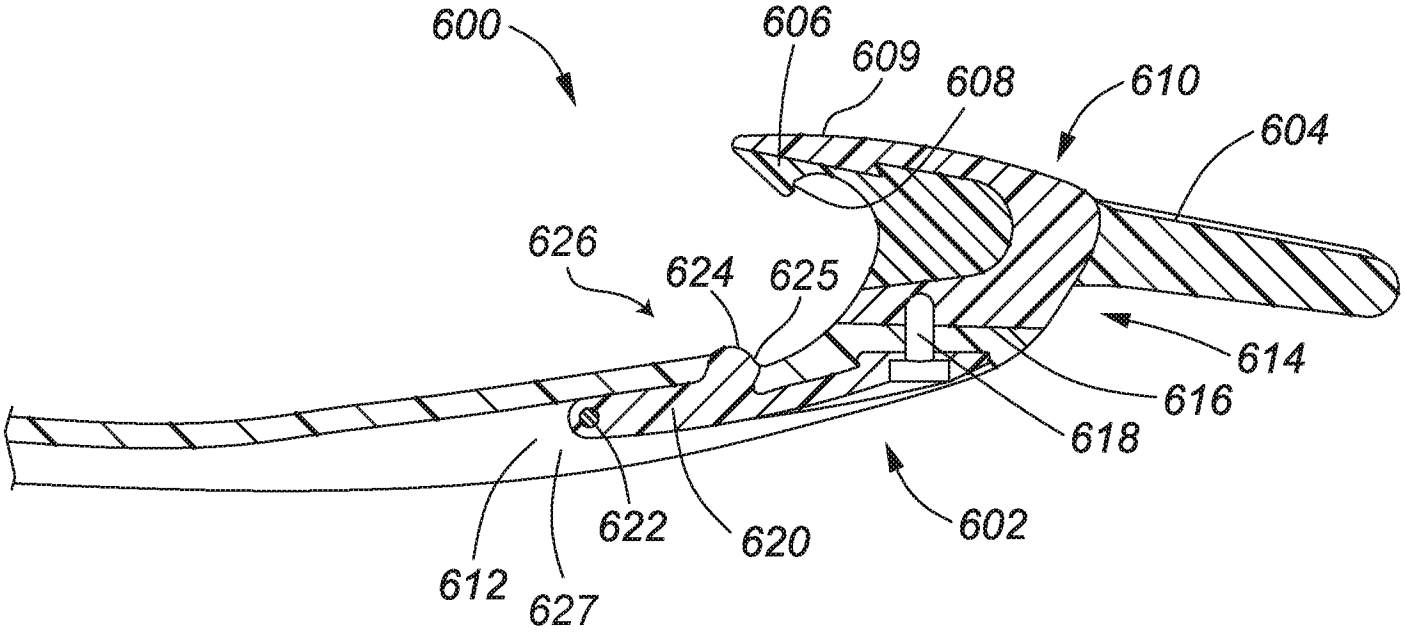
FIG. 49 is a side cross-sectional view of a boot and a heel coupling portion of a boot coupling body according to another embodiment.

Referring to FIG. 49, another embodiment of a boot coupling body 600 is similar to the boot coupling body 402 shown in FIGS. 47 and 48. Boot coupling body 600 includes a coupling body shown generally at 602 and a fin frame 604. In some embodiments, a fin body (not shown) can be integrally or permanently coupled to the fin frame 604. In other embodiments, a fin body can be removably coupled to the fin frame 604.

In the embodiment shown, the fin frame 604 may be removably coupled to the coupling body 602 to form boot coupling body 600. In some embodiments the fin frame 604 may be removably coupled to coupling body 602 using two corresponding retaining surfaces on each of the fin frame 604 and coupling body 602, such as the method described in reference to FIGS. 43-46.

Fin frame 604 defines a holder (or a holding body or a first boot connector) 606 including a retaining surface (or a holding surface) 608, which may be sized to be received against a corresponding retaining surface on a boot toe body in a way similar to that described in reference to FIGS. 47 and 48 so that the holder 606 is a means for connecting a fin body (coupled to the boot coupling body 600, which includes the coupling body 602 and the fin frame 604) to a boot toe body at a first complementary boot connector of the boot toe body on a top side of the boot toe body. A top portion 609 of the boot coupling body 600 (which, as indicated above, includes the fin frame 604) includes the holder 606 and the retaining surface 608.

The coupling body 602 is similar to coupling body 408 shown in FIGS. 47 and 48, being curved in a generally-semi-circular shape having a top portion shown generally at 610, a bottom portion shown generally at 612, and an intermediate portion shown generally at 614 extending between the top portion 610 and the bottom portion 612.

The bottom portion 612 of the coupling body 602 may extend longitudinally away from the front of the fin frame 604, and may include a rigid lever such as the rigid lever 182 in FIG. 10 or a heel coupling body such as the heel coupling body 202 in FIG. 15 or any of the heel coupling bodies recited in FIGS. 17-22.

The intermediate portion 614 of coupling body 602 defines a rotational interface 616 about which either the top portion 610 or bottom portion 612 of coupling body 602 may rotate. Fastener 618 acts as a rotational pivot about which said rotation takes place, and also couples together the top portion 610 and bottom portion 612. Rotation of the coupling body 602 when coupled to the fin frame 604 may provide the same advantage to a fin apparatus including this embodiment as the advantage described in reference to FIGS. 47 and 48.

In the embodiment shown, the spring 620 is fixed within the bottom portion 612 of the coupling body 602 with fasteners 618 and 622. Spring 620 is similar to spring 422 shown in FIGS. 47 and 48, being made of a resiliently deformable material. However, in the embodiment shown, the spring 620 defines an integral hook (or clasp or boot clasp or second boot connector) 624 consisting of or comprising the same resiliently deformable material as the spring 620. In the embodiment shown, the hook 624 and the spring 620 are part of a single body, which may be produced as a single piece using injection molding techniques, for example. Hook 624 is on the bottom portion 612 of the coupling body 602 (and thus on a bottom portion 627 of the boot coupling body 600, which, as indicated above, includes the coupling body 602) and includes a retaining surface 625 on a top side shown generally at 626 of the bottom portion 627 of the boot coupling body 600 so that the hook 624 may function in substantially the same way as clasp 418 shown in FIGS. 47 and 48, in that it may resiliently deform in a downward direction along with spring 620 when a downward force is applied to the top of hook 624, so that the retaining surface 625 is also a retaining surface for contacting a retaining surface of a second complementary boot connector on a bottom side of a boot toe body to connect the clasp 624, which is a second boot connector, to the second complementary boot connector on the bottom side of the boot toe body, and so that the clasp 624 is also a means for connecting a fin body (coupled to the boot coupling body 600, which includes the coupling body 602 and the fin frame 604) to a boot toe body at a second complementary boot connector of the boot toe body on a bottom side of the boot toe body, the clasp 624 including the retaining surface 625 on the top side 626 of the bottom portion 627 of the boot coupling body 600 for contacting a retaining surface of the second complementary boot connector. Because both spring 620 and hook 624 are resiliently deformable, hook 624 may return to its original position upon removal of any downward force acting upon it.

The embodiment shown may facilitate an equivalently simple and intuitive method of coupling and decoupling a fin apparatus including at least boot coupling body 600 to a boot toe body (not shown) similar to the method described in reference to FIGS. 47 and 48. Substituting clasp 418 with the integral hook 624 may provide an advantage to both durability and longevity of coupling body 600. The embodiment shown may also provide an advantage during production and manufacturing of coupling body 602.

Figure 50:
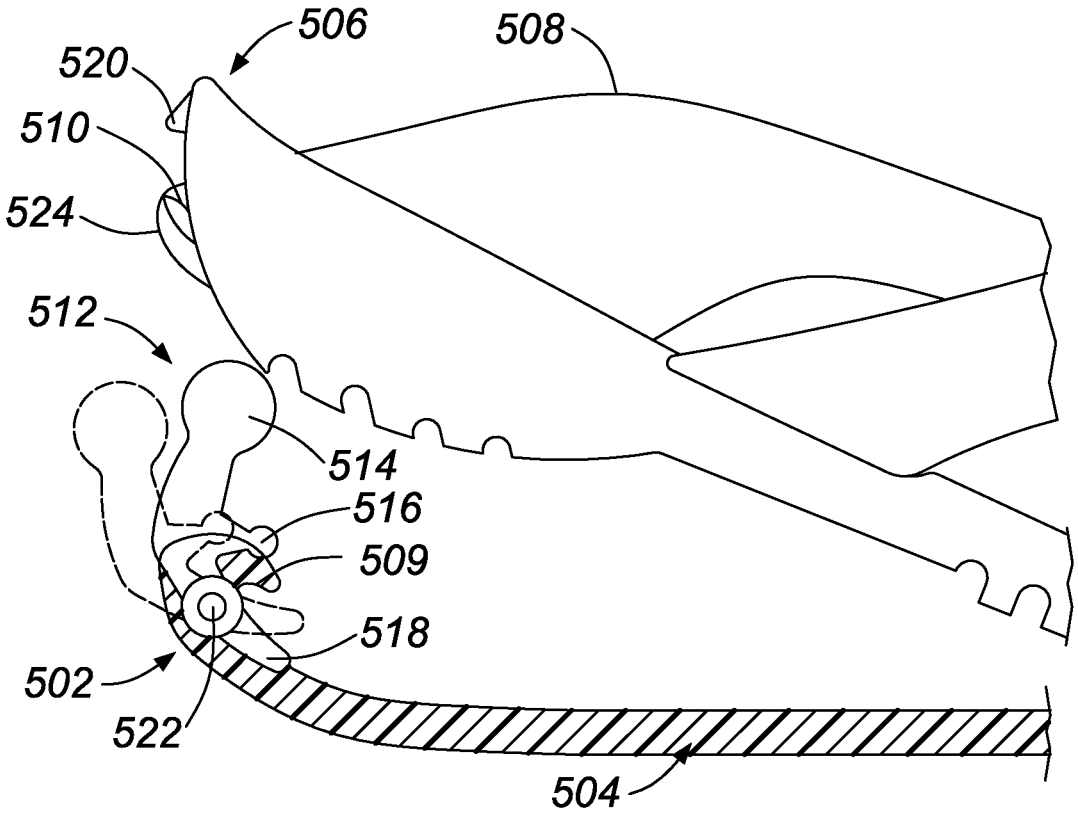
FIG. 50 is a side partial-cross-sectional view of a fin system according to another embodiment.

Referring to FIG. 50, an embodiment of a heel coupling body 502 is shown. Heel coupling body 502 can be an extension of the bottom portion 504 of a boot coupling body described in previous embodiments (not shown), and is designed to couple detachably to a heel portion 506 of boot 508. The boot 508 is not necessarily a complete boot, but may in various embodiments be an open-heel body for receiving a boot or for receiving a foot or prosthetic limb, for example. Heel coupling body 502 includes a retaining surface 509 sized to be received against a corresponding retaining surface 510.

Heel coupling body 502 also defines a lever mechanism shown generally at 512 and including a lever 514, a wedge 516 and an actuator 518. When the retaining surface 509 is received against the corresponding retaining surface 510, the actuator 518 contacts a surface 524 of the boot 508, which causes rotation of the lever mechanism 512 about a fastener 522 in a direction that urges the wedge 516 into a position against a lock 520 that urges the retaining surface 509 against the retaining surface 510 such that the heel coupling body 502 is essentially "locked" in place against the heel portion 506 of boot 508. A user operating the embodiment shown can "unlock" the heel coupling body 502 from the boot 508 by rotating the lever 514 around the fastener 522 in a generally rearwards direction. In doing so, the wedge 516 is removed from contact with the lock 520 and ceases to urge the retaining surface 509 against the retaining surface 510, and the actuator 518 exerts a force against the surface 524, which urges the retaining surface 509 rearwardly away from the retaining surface 510 to move the heel coupling body 502 backwards and out of the "locked" position against the heel portion 506 of the boot 508.

Figure 51:
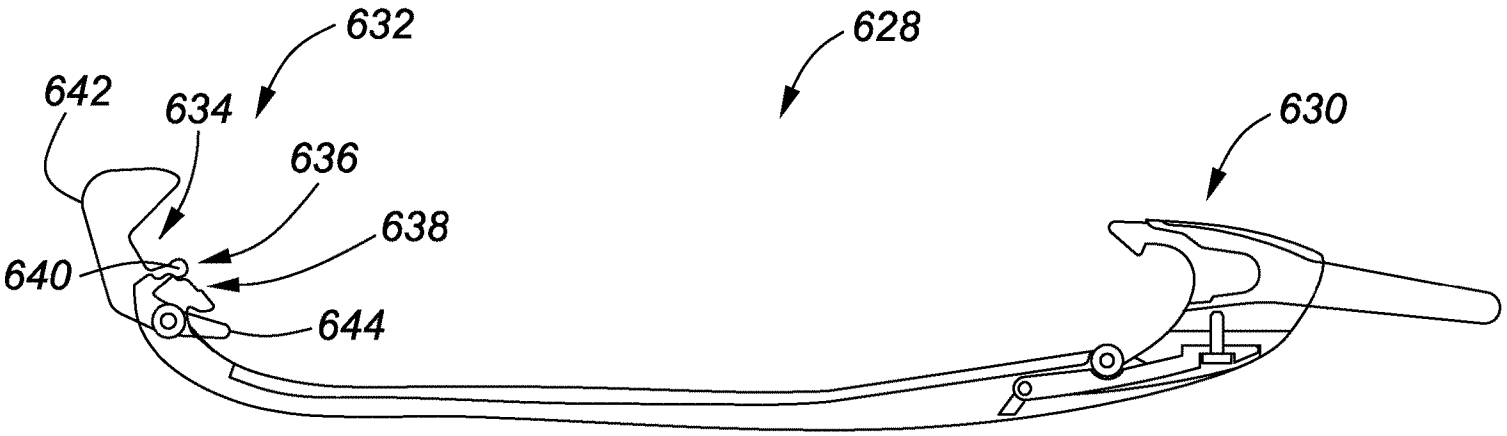
FIG. 51 is a side schematic illustration of a boot coupling body according to another embodiment.

Referring to FIG. 51, a boot coupling body according to another embodiment is shown generally at 628 and includes a toe coupling region shown generally at 630 and substantially the same as the coupling body 408 and the fin frame 410 shown in FIGS. 47 and 48. The boot coupling body 628 also includes a heel coupling body shown generally at 632 that is similar to the heel coupling body 502 shown in FIG. 50, except that the heel coupling body 632 defines recesses shown generally at 634, 636, and 638 to receive a wedge 640 in three positions defined by each of the recesses 634, 636, and 638. A lever 642 and actuator 644 may move the wedge 640 in substantially the same way as the lever 514 and the actuator 518 respectively as described above with reference to FIG. 50, but the wedge 640 is resiliently urged into the recesses 634, 636, and 638, so the wedge more-naturally rests in one of the three positions defined by the recesses 634, 636, and 638.

Figure 52:
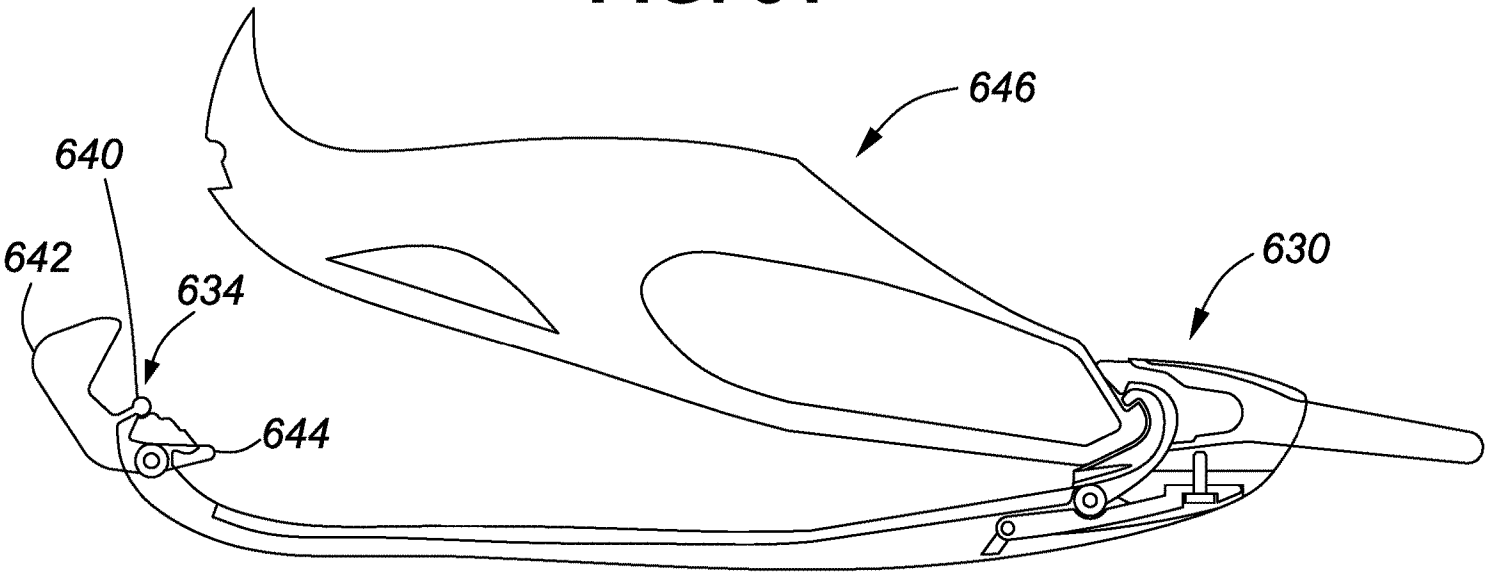
FIG. 52 is a side schematic illustration of a boot coupling body of FIG. 51 with a boot toe body being coupled to the boot coupling body.
Figure 53:
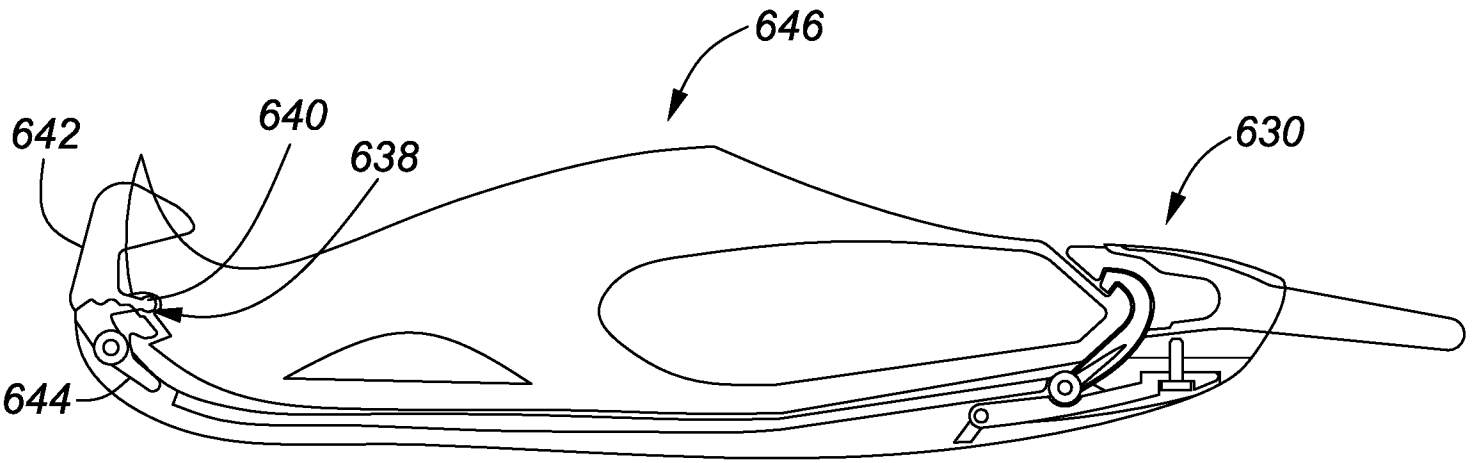
FIG. 53 is a side schematic illustration of the boot coupling body of FIG. 51 with the boot toe body of FIG. 52 coupled to the boot coupling body.
Figure 54:
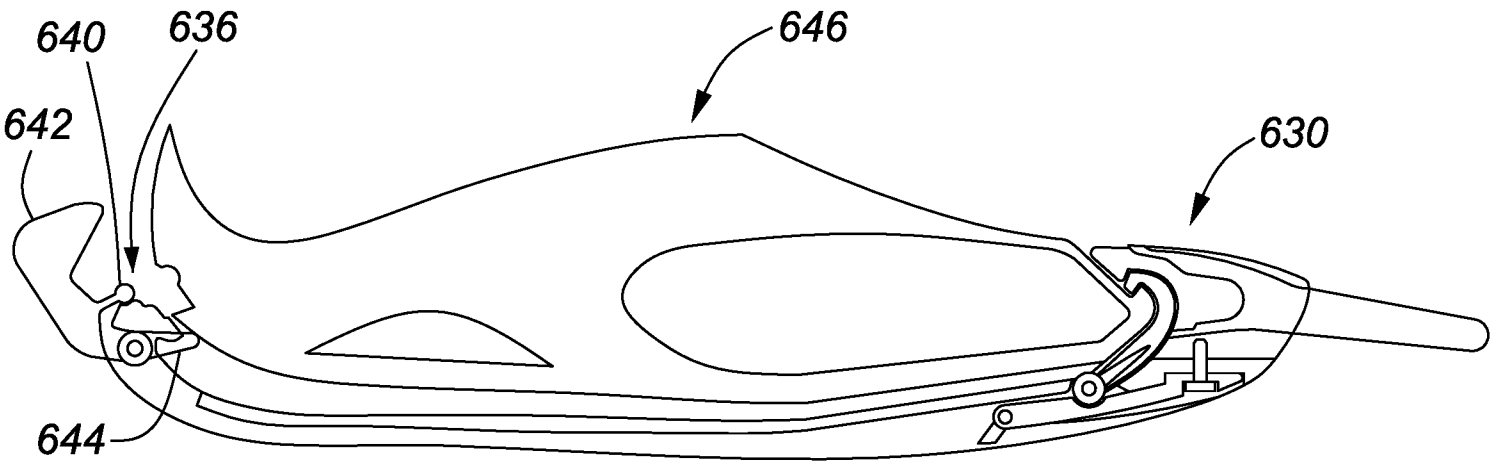
FIG. 54 is a side schematic illustration of the boot toe body of FIG. 52 being ejected from the boot coupling body of FIG. 51.

As shown in FIG. 52, the lever 642 may be moved to position the wedge 640 in the recess 634 to move the wedge 640 into a position to be coupled to a heel region of a boot toe body 646. Then, as shown in FIG. 53, a user may step into the boot coupling body 628 and in doing so transfer a force from a bottom surface of the boot toe body 646 to the actuator 644, which (as described above with reference to FIG. 50) may urge the wedge into the position defined by the recess 638 and lock the heel coupling body 632 to a heel region of the boot toe body 646. Therefore, in various embodiments such as those described herein, connections to a heel region are not necessarily on a boot itself, but may be in on a boot toe body 646 or on any other body that is or that may be coupled to a boot. As shown in FIG. 54, the lever 642 may be pulled away from the heel region of the boot toe body 646 to eject the boot toe body 646 from the boot coupling body 628.

Figure 55:
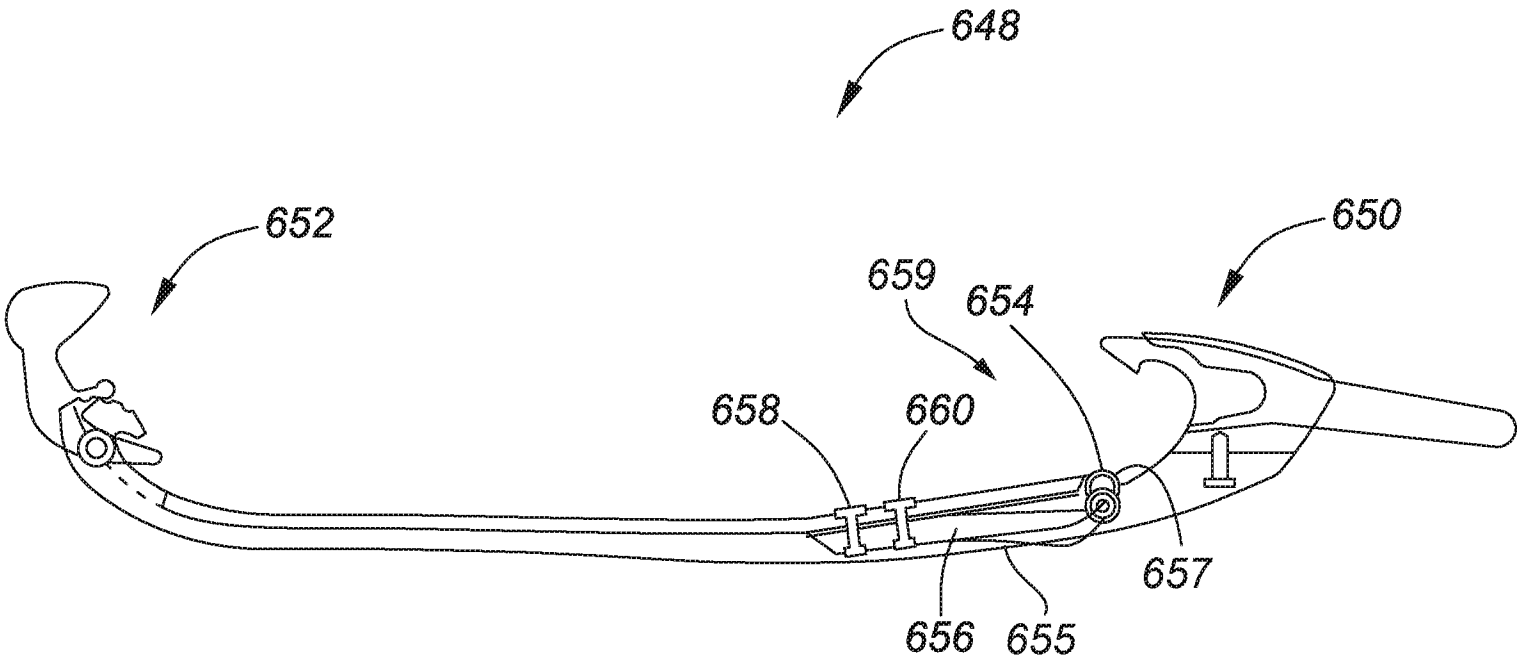
FIG. 55 is a side schematic illustration of a boot coupling body according to another embodiment.

Referring to FIG. 55, a boot coupling body according to another embodiment is shown generally at 648 and includes a toe coupling region shown generally at 650 that is similar to the coupling body 408 and the fin frame 410 as shown in FIGS. 47 and 48. The boot coupling body 648 also includes a heel coupling body shown generally at 652 that is substantially the same as the heel coupling body 632 shown in FIGS. 51-54. The toe coupling region 650 includes a clasp (or boot clasp or boot connector) 654 on a bottom portion 655 of the boot coupling body 648. The clasp 654 includes a retaining surface 657 on a top side shown generally at 659 of the bottom portion 655 of the boot coupling body 648 and is substantially the same as the clasp 418 as shown in FIGS. 47 and 48, but the clasp 654 is coupled or integral to a spring 656 that is held in position by fasteners 658 and 660. The spring 656 is resiliently deformable as shown in FIG. 55 to permit resilient movement of the clasp 654 as shown in FIG.

55 and generally as described above, so that the retaining surface 657 is also a retaining surface for contacting a retaining surface of a complementary boot connector on a bottom side of a boot toe body to connect the clasp 654, which is a boot connector, to the complementary boot connector on the bottom side of the boot toe body, and so that the clasp 654 is also a means for connecting a fin body to a boot toe body at a complementary boot connector of the boot toe body on a bottom side of the boot toe body, the clasp 654 including the retaining surface 657 on the top side 659 of the bottom portion 655 of the boot coupling body 648 for contacting a retaining surface of the complementary boot connector.

Figure 56:
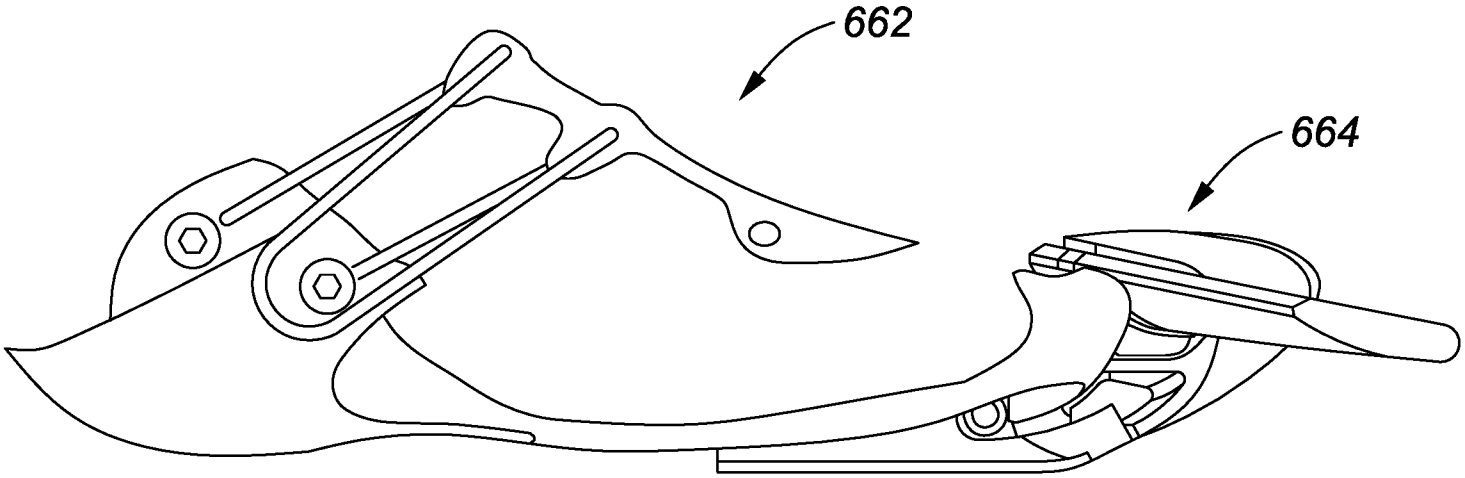
FIG. 56 is a side view of a boot toe body according to another embodiment.
Figure 57:
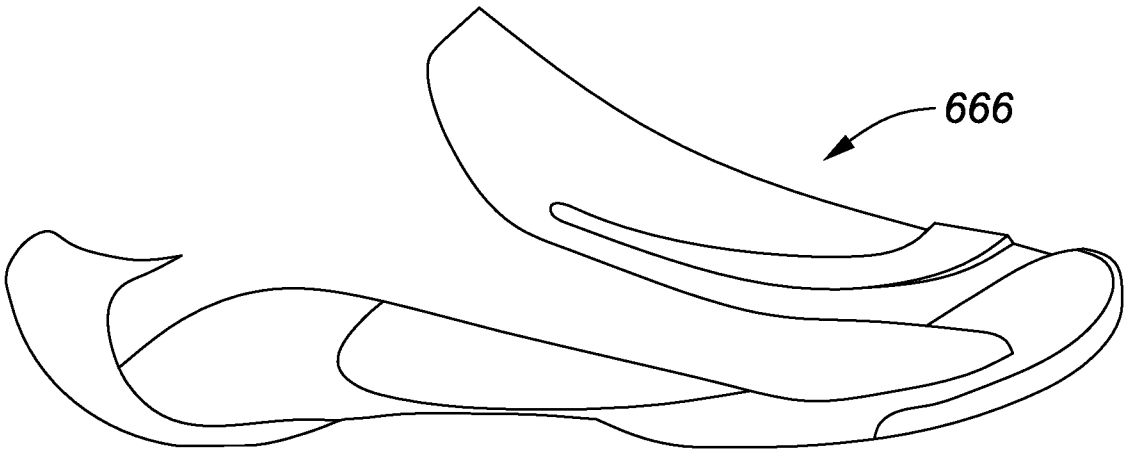
FIG. 57 is a side view of a boot shell that may be coupled to the boot toe body of FIG. 56.
Figure 58:
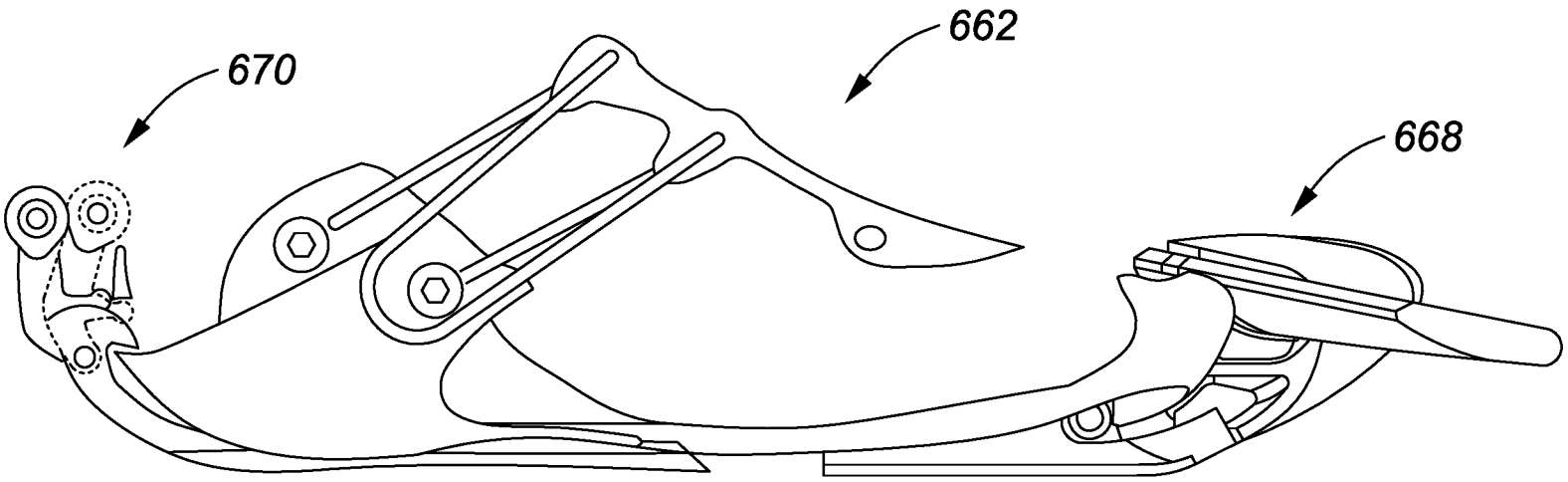
FIG. 58 is a side view of a boot toe body and a boot coupling body according to another embodiment.
Figure 61:
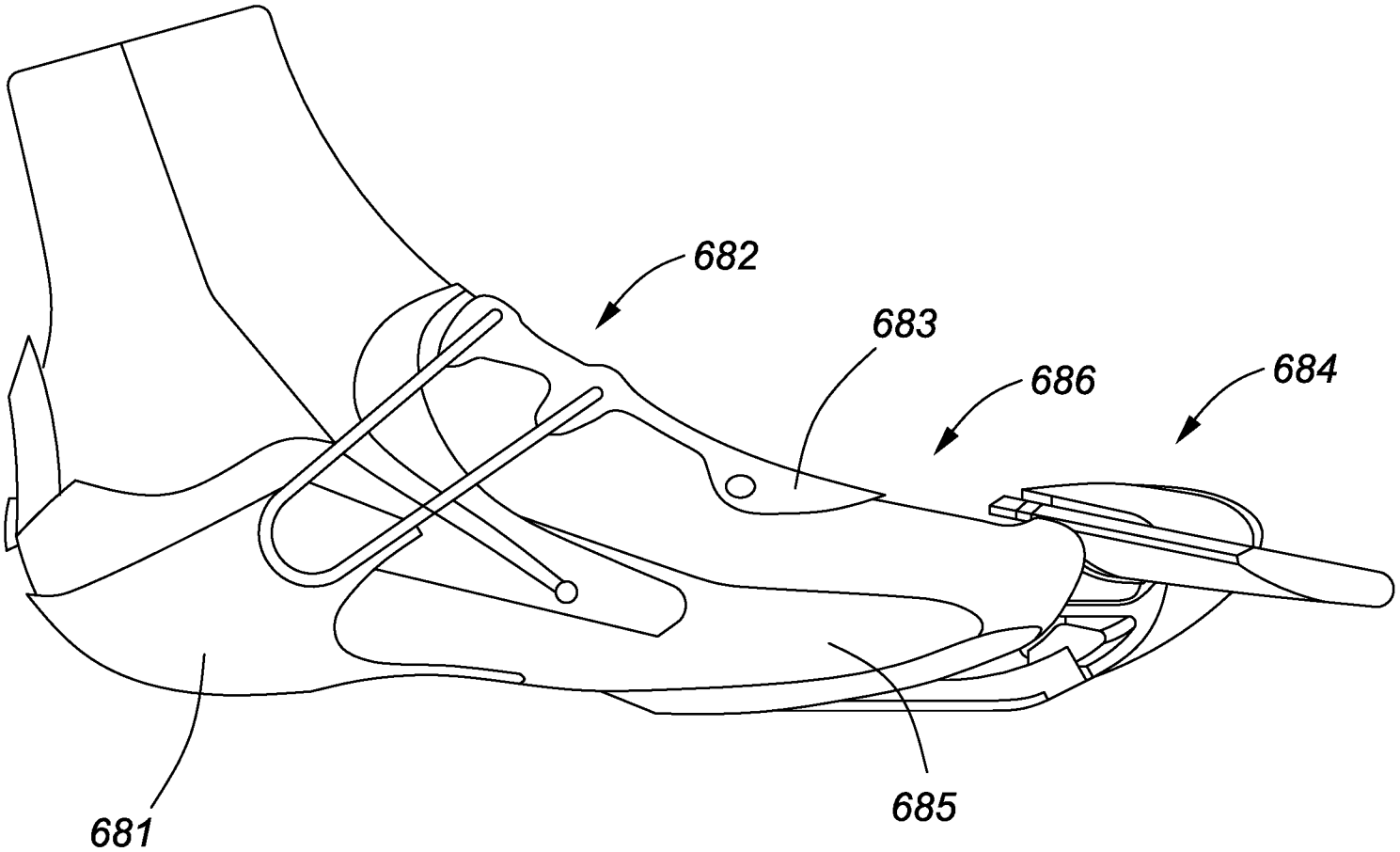
FIG. 61 is a side view of a boot toe body, a boot coupling body, and a boot shell according to another embodiment.

Referring FIGS. 56 and 57, a boot toe body according to another embodiment is shown generally at 662 and is configured to be coupled detachably at a toe region of the boot toe body 662 to a toe coupling region of a boot coupling body shown generally at 664, which is substantially the same as the coupling body 408 and the fin frame 410 shown in FIGS. 47 and 48. The boot toe body 662 is also configured to be coupled detachably to a boot shell 666, which may be temporarily, detachably, non-detachably, permanently, or integrally coupled to a dry suit, to a user's preferred boot, to a liner, or to an innerboot, for example. Referring to FIG. 58, the boot toe body 662 may be configured to be coupled detachably to a boot coupling body 668 also having a heel coupling body shown generally at 670 that is substantially the same as the heel coupling body 502 shown in FIG. 50. FIG. 61 illustrates an embodiment including a boot toe body shown generally at 682 (which is similar to the boot toe body 662) that is detachably coupled to a toe coupling region of a boot coupling body shown generally at 684 (which is also similar to the coupling body 408 and the fin frame 410 shown in FIGS. 47 and 48) and that is detachably coupled to a boot shell shown generally at 686 (which is similar to the boot shell 666) of a boot. In FIGS. 61, 681 and 683 indicate semirigid material, and 685 indicates stretch material.

Figure 59:
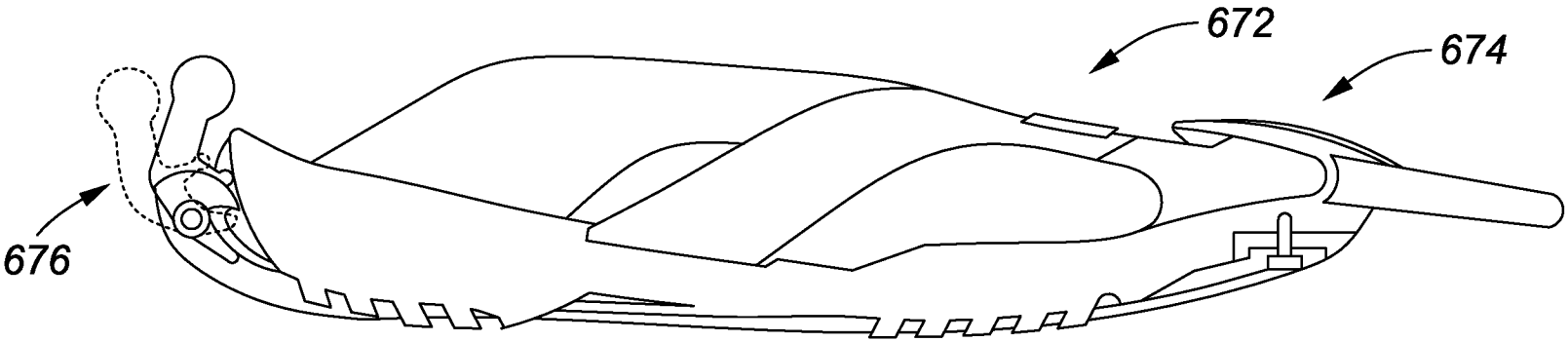
FIG. 59 is a side view of the boot toe body of FIG. 58 and a boot coupling body according to another embodiment.
Figure 60:
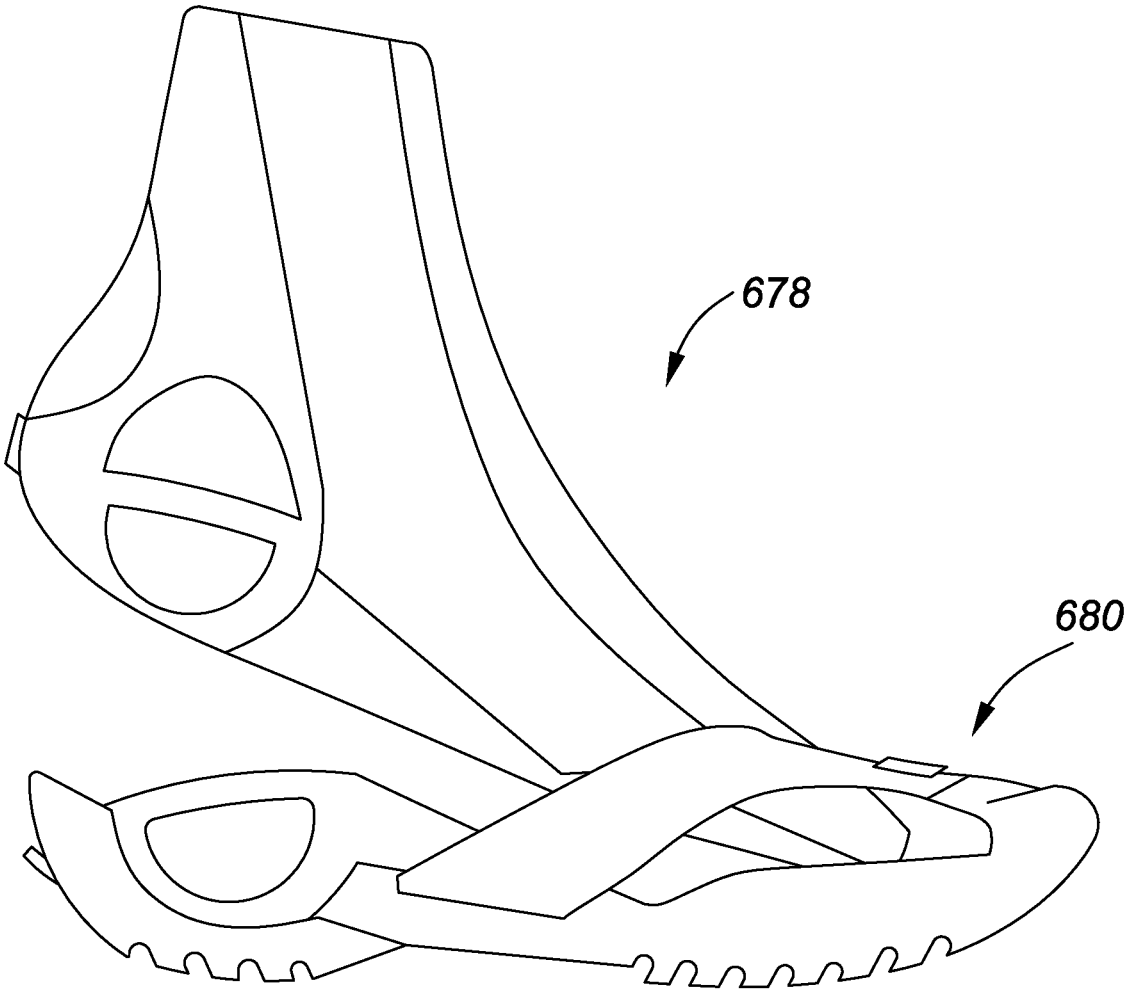
FIG. 60 is a side view of a boot toe body and a boot coupling body according to another embodiment.

Referring FIG. 59, a boot toe body according to another embodiment is shown generally at 672 and is configured to be coupled detachably at a toe region of the boot toe body 672 to a toe coupling region of a boot coupling body shown generally at 674 (which is substantially the same as the coupling body 408 and the fin frame 410 shown in FIGS. 47 and 48) and is also configured to be coupled detachably at a heel region of the boot toe body 672 to a heel coupling body shown generally at 676 (which is substantially the same as the heel coupling body 502 shown in FIG. 50) of the boot coupling body 674. The boot toe body 662 is also configured to be coupled detachably to a dry suit or to a user's preferred boot, for example, either of which may be received in sandal-like structures of the boot coupling body 674. FIG. 60 illustrates an embodiment including a boot shown generally at 678 that may be coupled detachably to a sandal-like boot toe body shown generally at 680.

Figure 62:
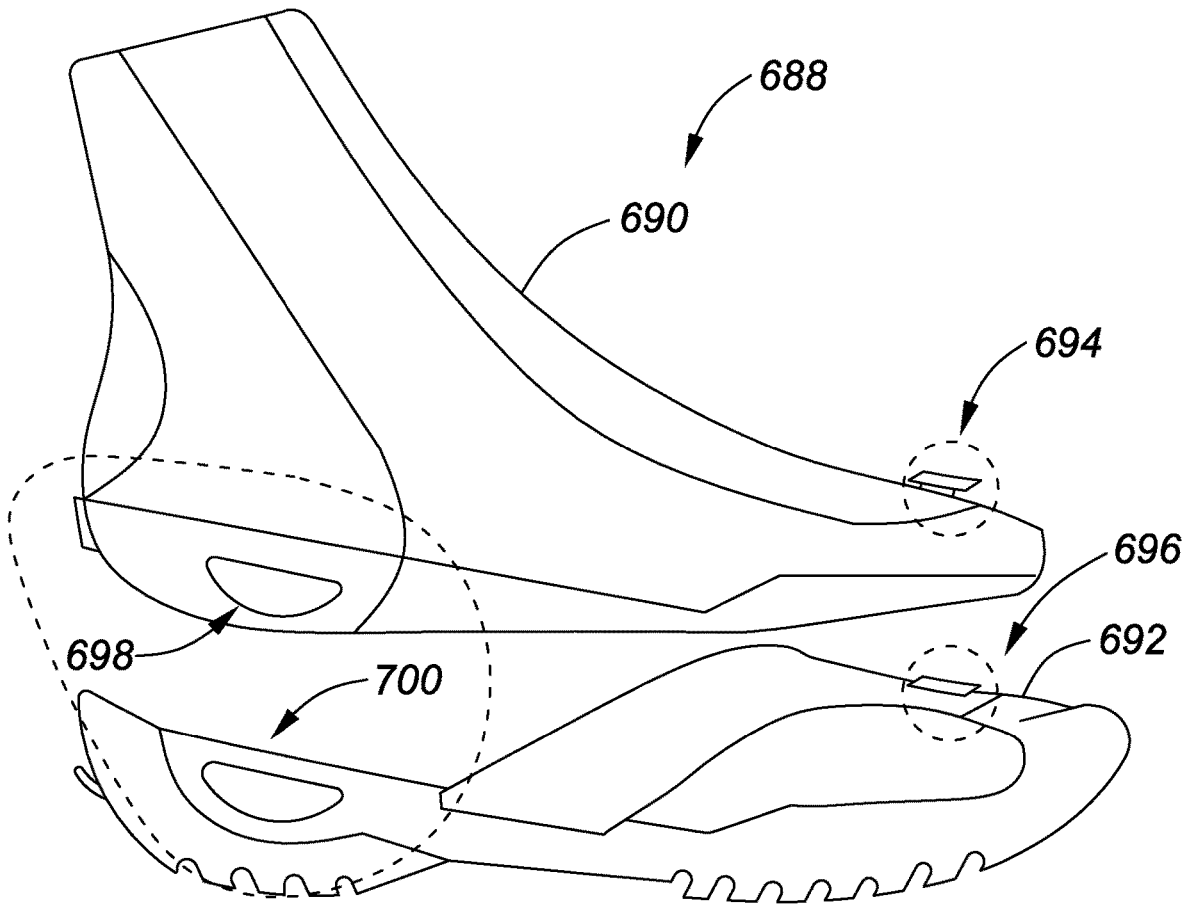
FIG. 62 is a side view of a boot and a boot toe body according to another embodiment.

Referring to FIG. 62, a boot assembly according to another embodiment is shown generally at 688 and includes a boot 690, which may be a unitary boot or may be a boot liner or innerboot combined with a boot shell, for example. The boot assembly 688 also includes a boot toe body 692, which may be connected at a toe region or also at a heel region to a boot coupling body generally as described herein. The boot 690 includes a connector shown generally at 694 on an upper side of a toe region of the boot 690, and connecting surfaces of the connector 694 are complementary to connecting surfaces of a connector shown generally at 696 on an upper side of a toe region of the boot toe body 692. The boot 690 also includes a connector shown generally at 698 on a heel region of the boot 690, and connecting surfaces of the connector 698 are complementary to connecting surfaces of a connector shown generally at 700 on a heel region of the boot toe body 692. The connectors 694, 696, 698, and 700 may thus facilitate detachably attaching the boot 690 to the boot toe body 692.

Figure 63:
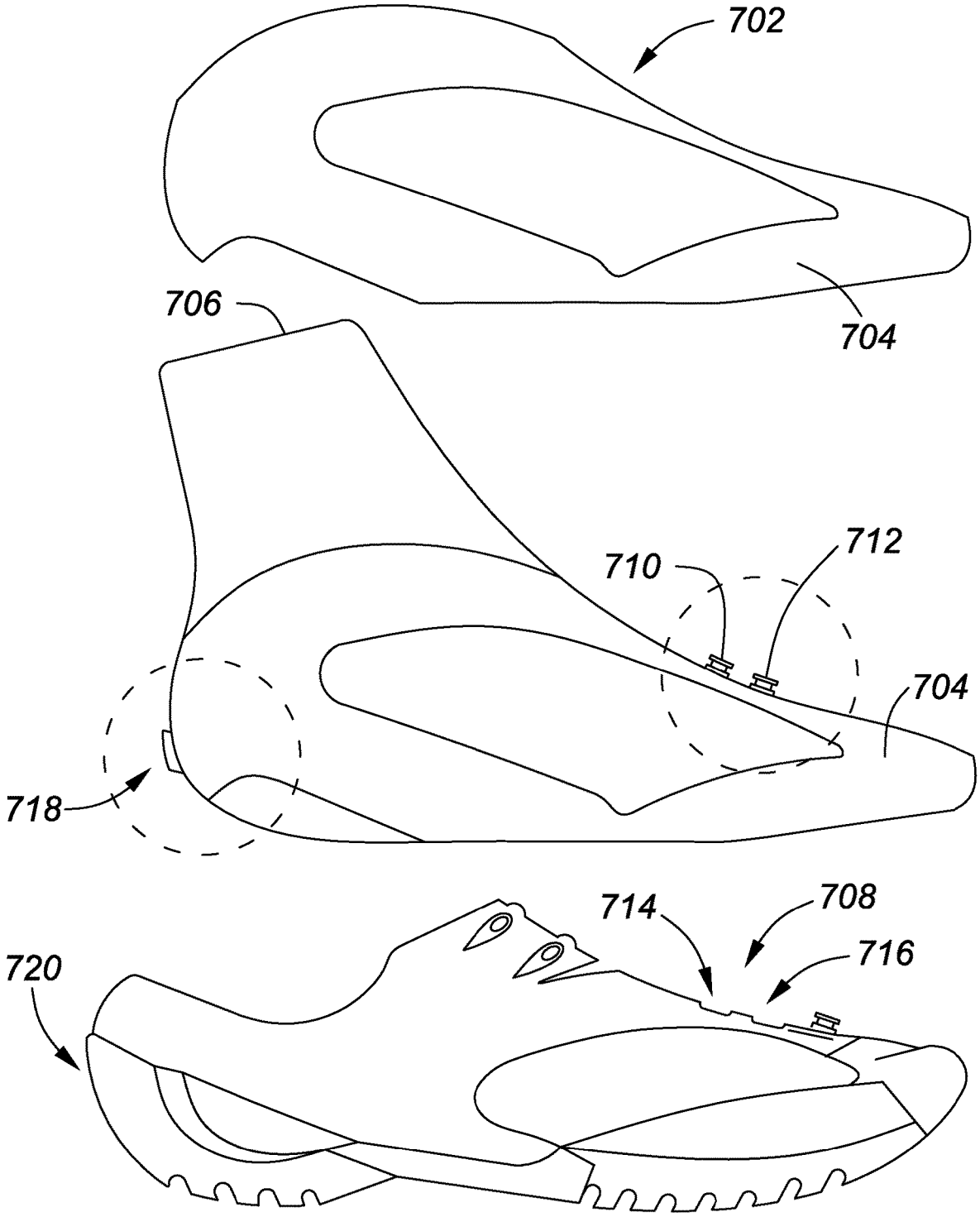
FIG. 63 is a side view of a boot shell, a liner, and a boot toe body according to another embodiment.

Referring to FIG. 63, a boot assembly according to another embodiment is shown generally at 702 and includes a boot shell 704 that may be may be temporarily, detachably, non-detachably, permanently, or integrally coupled (for example by snapping, gluing, sewing, or other techniques of shoe fabrication) to a neoprene sock or boot liner 706. The combination of the boot shell 704 and the boot liner 706 may form a relatively very light boot that may be desirable for some embodiments. The boot assembly 702 also includes a boot toe body 708, which may be connected at a toe region or also at a heel region to a boot coupling body generally as described herein. The liner 706 includes connectors shown generally at 710 and 712 (which are sewn-in flexible hooks or other liner elements in the embodiment shown) on an upper side of a toe region of the liner 706, and connecting surfaces of the connectors 710 and 712 are complementary to connecting surfaces of connector shown generally at 714 and 716 respectively on an upper side of a toe region of the boot toe body 708. The liner 706 also includes a connector shown generally at 718 on a heel region of the liner 706, and connecting surfaces of the connector 718 are complementary to connecting surfaces of a connector shown generally at 720 on a heel region of the boot toe body 708. The connectors 710, 712, 714, 716, 718, and 720 may thus facilitate detachably attaching the liner 706 to the boot toe body 708. More generally, "boot" herein may in some embodiments include a combination of a shell and a permanently coupled or replaceable liner. Further, the shell 704 may transfer forces from a fin (not shown) coupled to a toe region of the shell 704 to other regions of a foot of a user in the liner 706, and in various other embodiments, such shells or other similar structures may transfer forces from a fin coupled to a toe region of the shell to other regions of a foot of a user.

Figure 65:
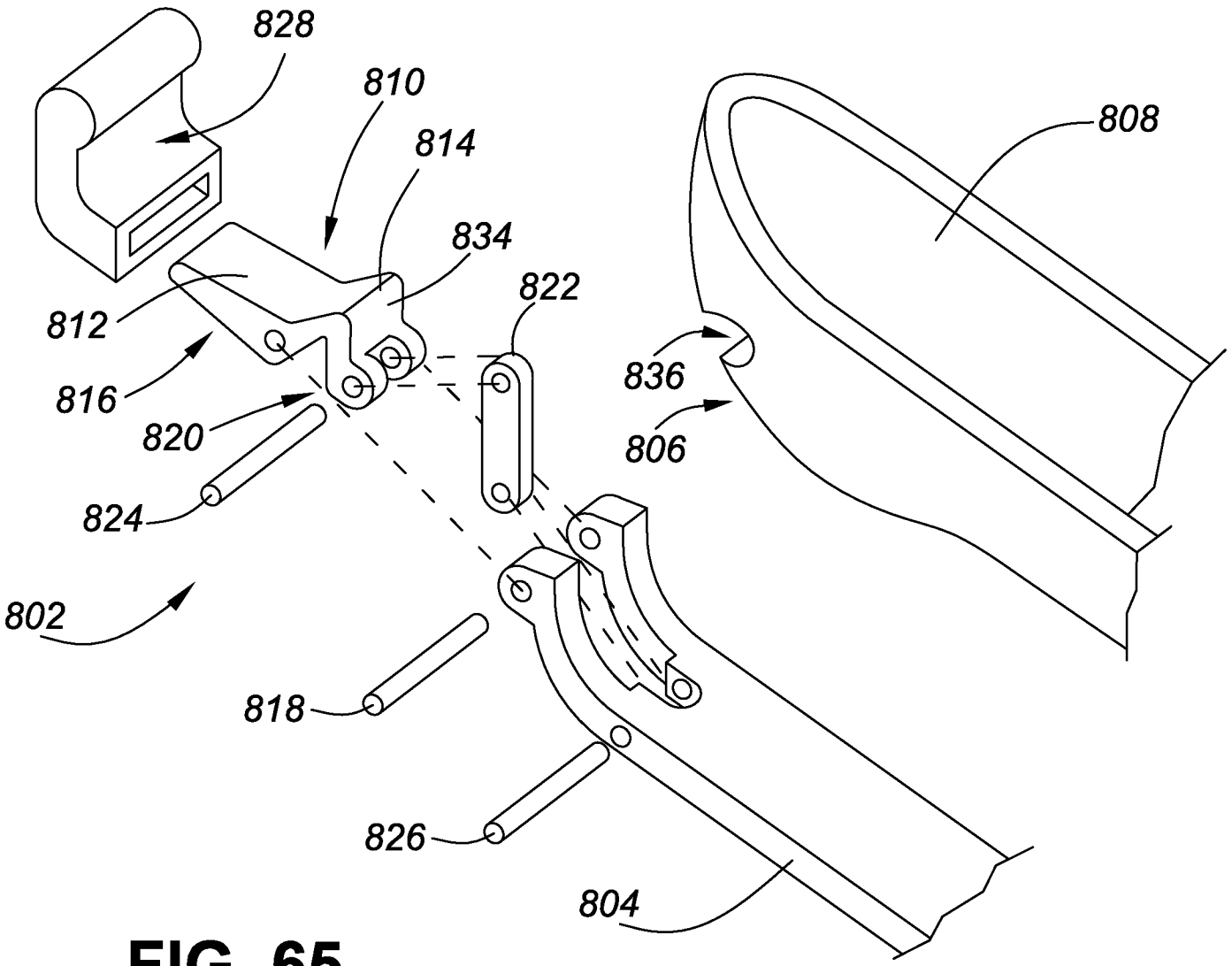
FIG. 65 is an exploded top view of a boot and a heel coupling portion of a boot coupling body according to another embodiment.

Referring to FIG. 65, another embodiment of a heel coupling body is shown generally at 802. Heel coupling body 802 can be an extension of a bottom portion 804 of a boot coupling body such as those described above for example, and is designed to couple detachably to a boot 808. Boot 808 is not necessarily a complete boot, but may in various embodiments be an open-heel body for receiving a boot or for receiving a foot or prosthetic limb, for example.

Heel coupling body 802 includes a retaining mechanism 810. Retaining mechanism 810 has a first end shown generally at 816 and a second end shown generally at 820, and a resiliently deformable portion 814 between the first end 816 and the second end 820 to allow a separation distance between the first end 816 and the second end 820 to be resiliently varied. The resiliently deformable portion 814 includes a retaining surface 834 facing towards the second end 820 of the retaining mechanism 810.

The first end 816 of retaining mechanism 810 is connected to the boot coupling body by a hinge 818, which in the embodiment shown is a fastener that acts as a rotational pivot, but which may be other hinges in other embodiments. The second end 820 of retaining mechanism 810 is connected to one end of a connector 822 by a hinge 824, which in the embodiment shown is a fastener that acts as a rotational pivot, but which may be other hinges in other embodiments. The other end of connector 822 is connected to the boot coupling body by a hinge 826, which in the embodiment shown is a fastener that acts as a rotational pivot, but which may be other hinges in other embodiments. The first end 816 of retaining mechanism 810 comprises a retaining lever 812. A lever extension 828 is connected to the end of retaining lever 812.

Boot 808 further comprises a heel portion 806, which includes a retaining channel 836 sized to receive the retaining surface 834 of the resiliently deformable portion 814 of retaining mechanism 810.

Figure 66:
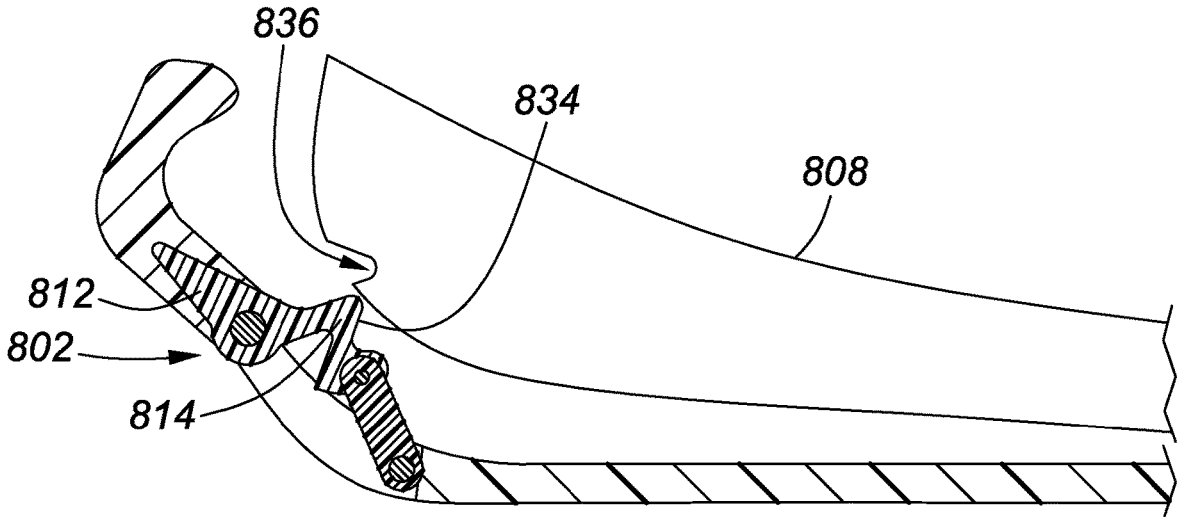
FIG. 66 is a cross-sectional side view of the boot and heel coupling portion in an uncoupled state according to the embodiment of FIG. 65.
Figure 67:
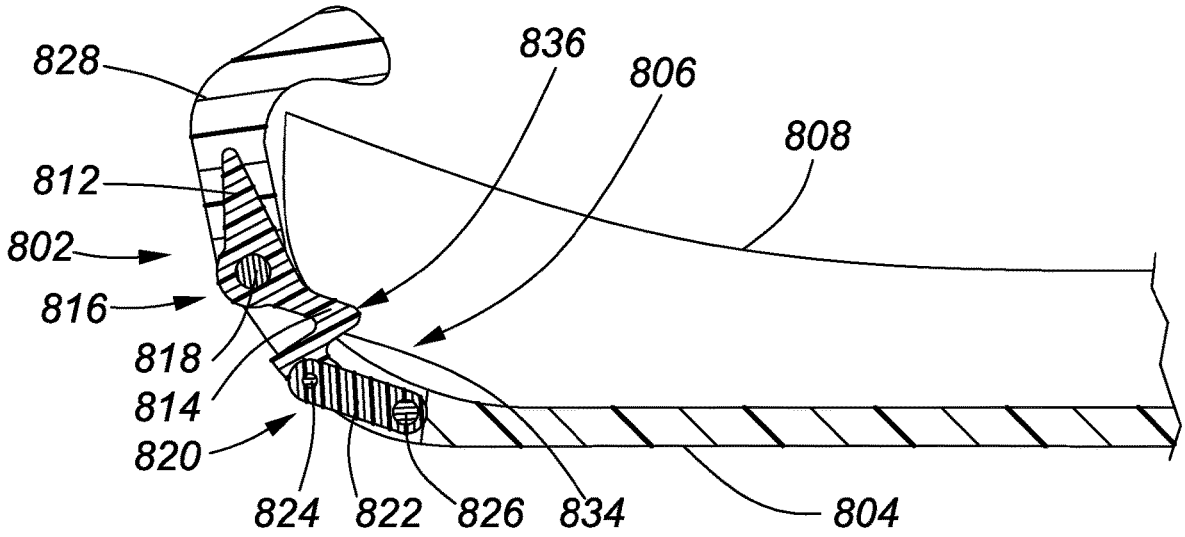
FIG. 67 is a cross-sectional side view of the boot and heel coupling portion in a coupled state according to the embodiment of FIG. 65.

FIGS. 66 and 67 show the coupling action of heel coupling body 802. Referring to FIG. 66, heel coupling body 802 is shown before the boot 808 is coupled to the boot coupling body. In this uncoupled position, retaining lever 812 is angled away backwards from the boot coupling body, and the resiliently deformable portion 814 of retaining mechanism 810 is in a relatively expanded state.

FIG. 67 shows heel coupling body 802 in a coupled state with the boot 808. As boot 808 rotates downward after coupling to the toe coupling body (not shown), the heel portion 806 of the boot 808 exerts a downward force on the second end 820 of the retaining mechanism 810. The downward force exerted on the second end 820 causes connector 822 to rotate about hinge 826 in a rearward direction away from the heel portion 806 of boot 808. The rotation of connector 822 about hinge 826 causes the retaining mechanism 810 to rotate about hinge 818 such that the second end 820 of retaining mechanism 810 moves rearwardly away from the heel portion 806 of boot 808. The connector 822 maintains a generally constant separation distance between the hinges 824 and 826, so rearward movement of the second end 820 of the retaining mechanism 810 causes the resiliently deformable portion 814 of retaining mechanism 810 to compress resiliently such that the separation distance between the first end 816 and the second end 820 (and thus a separation distance between the hinge 818 and the hinge 824) becomes shorter. The heel coupling body 802 is thus configured to vary the separation distance between the hinges 818 and 824 in response to the movement of the retaining mechanism 810 around the hinge 818 by causing the connector 822 to move around the hinge 826, which is on the boot 808 and spaced apart from the hinge 818.

When the hinge 824 passes an imaginary plane formed between hinge 818 and hinge 826, the resiliently deformable portion 814 is able to expand, and the resilient expanding force of the resiliently deformable portion 814 of retaining mechanism 810 urges the retaining surface 834 on the resiliently deformable portion 814 against and into contact with a retaining surface in the retaining channel 836 on the heel portion 806 of boot 808, holding the heel portion 806 of boot 808 against the boot coupling body 802. Therefore, a resilient force caused by resilient deformation of the resiliently deformable portion 814 retains the retaining surface 834 against the retaining surface in the retaining channel 836 on the heel portion 806 of boot 808, and the resiliently deformable portion 814 (and thus more generally the retaining mechanism 810) are thus configured to be resiliently deformed in response to positioning the retaining surface 834 against the retaining surface in the retaining channel 836 by varying the separation distance between the hinge 818 and the hinge 824 in response to movement of the retaining mechanism 810 around the hinge 818.

A user may decouple boot 808 from the boot coupling body by moving the lever extension 828 backwards away from boot 808, which causes the retaining lever 812 to move in the same direction, thereby rotating retaining mechanism 810 about hinge 818. As retaining mechanism 810 rotates around hinge 818, the second end 820 will approach the heel portion 806 of boot 808. The resiliently deformable portion 814 will consequently compress, thereby decreasing the separation distance between the first end 816 and the second end 820 of retaining mechanism 810 and causing the resiliently deformable portion 814 to exit the retaining channel 836. Connector 822 will rotate forwards toward the heel portion 806 of boot 808 about hinge 826; when connector 822 passes the imaginary plane formed between hinges 818 and 826, the resiliently deformable portion 814 is again able to expand, and the resilient expanding force of the resiliently deformable portion 814 urges the retaining surface 834 out of the retaining channel 836 and urges the second end 820 of retaining mechanism 810 upward against the heel portion 806 of boot 808, pushing boot 808 upwards and away from the boot coupling body 802.

Figure 68:
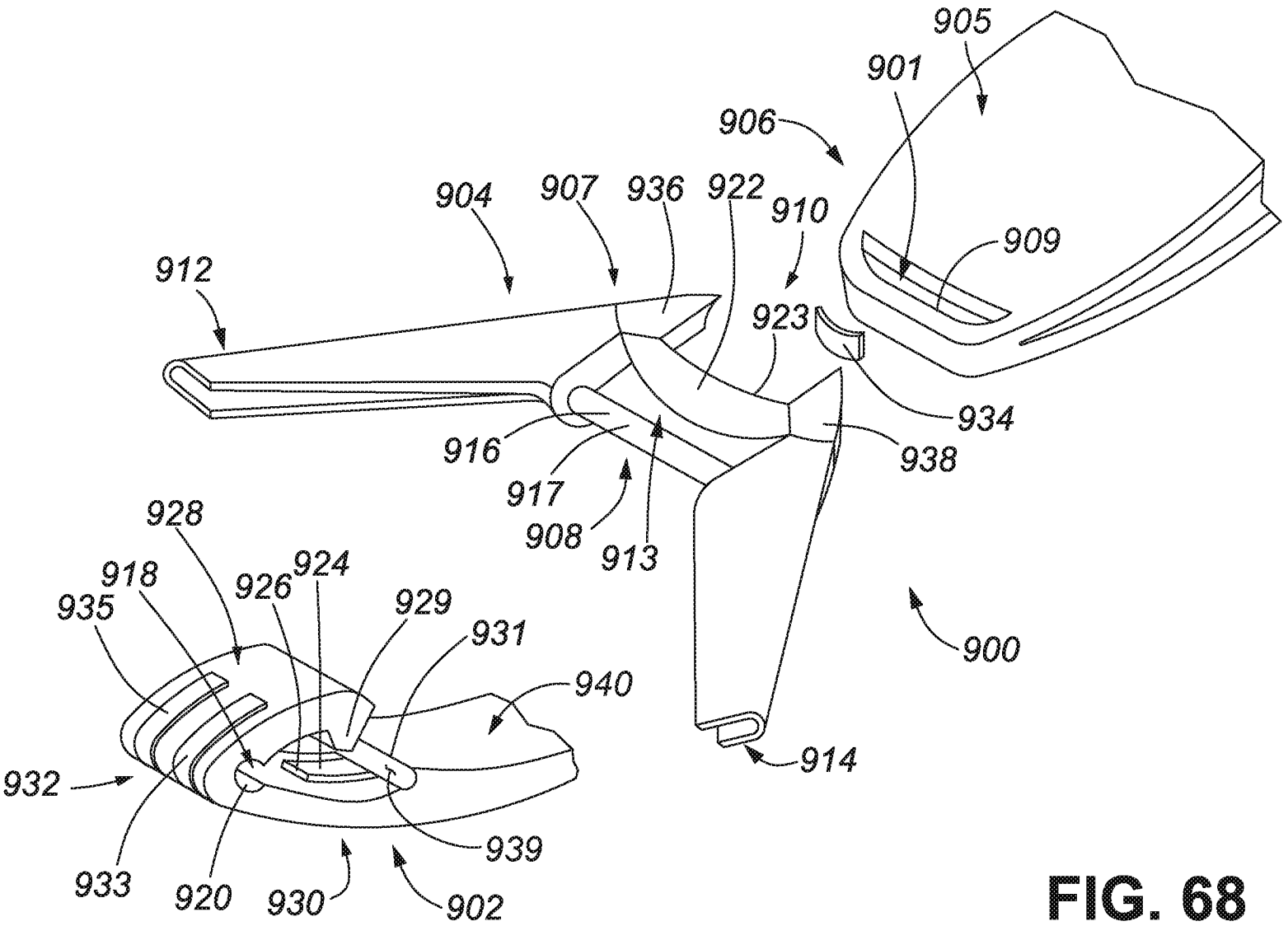
FIG. 68 is an exploded top perspective view of a fin system according to another embodiment.
Figure 69:
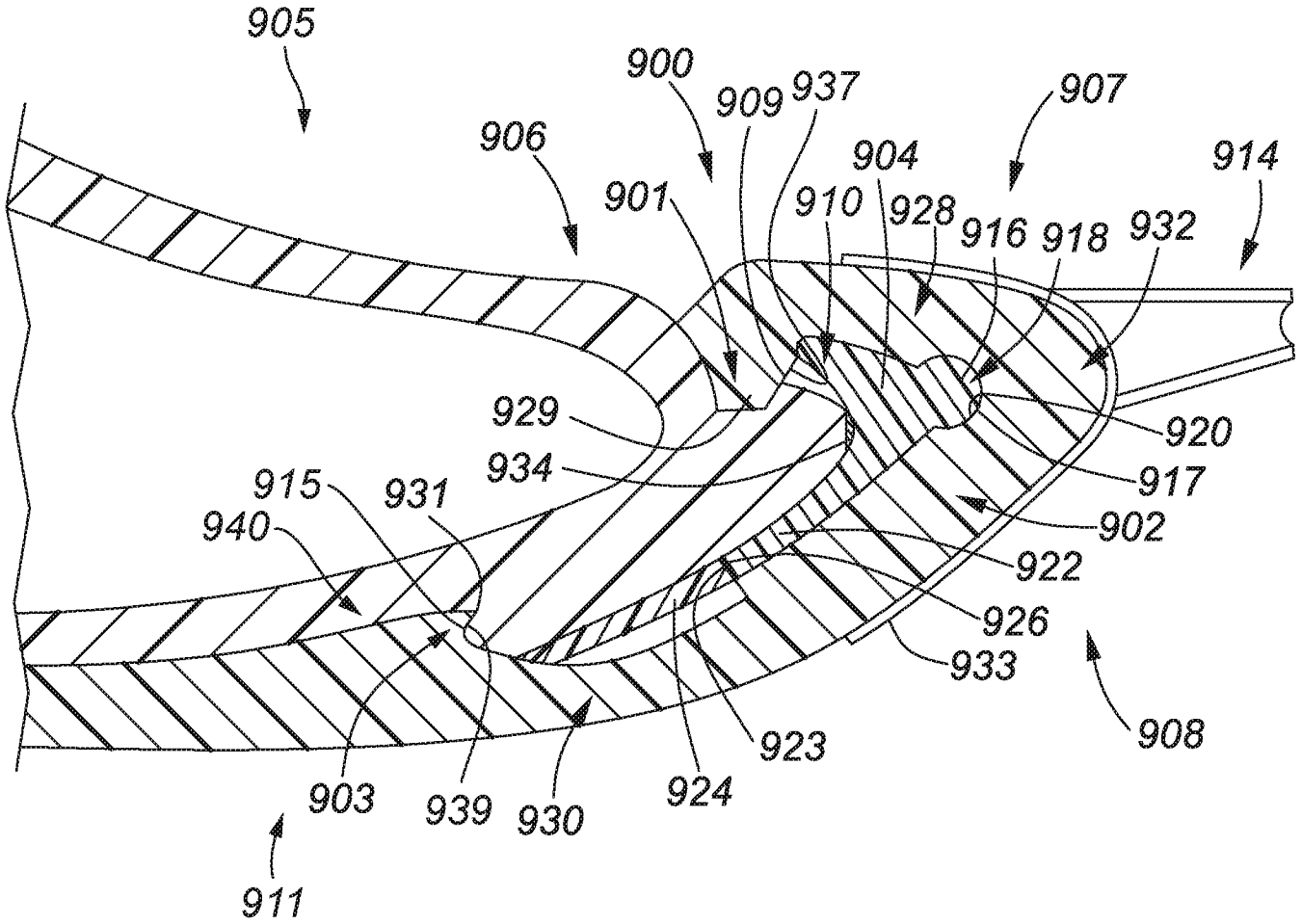
FIG. 69 is a cross-sectional side view of the fin system of FIG. 68.

Referring to FIGS. 68 and 69, a fin system according to another embodiment is shown generally at 900 and includes a boot coupling body shown generally at 902 and a fin frame shown generally at 904. The fin system 900 also includes a boot toe body integrally coupled to a boot and shown generally at 906. On a top side shown generally at 905, the boot toe body 906 includes a receptacle 901 having a retaining surface 909 on the top side 905 of the boot toe body 906, and the receptacle 901 functions as a connector (or as a first complementary boot connector) similar to the receptacle 148 as described above, for example. Also, on a bottom side shown generally at 911, the boot toe body 906 includes a receptacle 903 having a retaining surface 915 on the bottom side 911 of the boot toe body 906, and the receptacle 903 functions as a connector (or as a second complementary boot connector) similar to the receptacle 150 as described above, for example, and the retaining surface 915 is a retaining surface of the receptacle 903, which is a second complementary boot connector.

The fin frame 904 may be integrally, permanently, detachably, or non-detachably coupled to a fin body such as fin body 307 as shown in FIG. 43 or other fin bodies described herein for example, and when the fin frame 904 is coupled to such a fin body, the fin frame 904 and the fin body may together function substantially the same as other fin bodies described above, such as the fin body 102 or the fin bodies shown in FIGS. 16, 21, 26, 35, 36, and 42 for example. Still further, other fin bodies described above, such as the fin body 102 or the fin bodies shown in FIGS. 16, 21, 26, 35, 36, and 42 for example, may be understood to include a fin frame (similar to the fin frame 904, for example) detachably or non-detachably coupled to a fin body (similar to the fin body 307, for example), and boot coupling bodies such as those described herein may be detachably coupled to such fin frames. The fin frame 904 has a top side shown generally at 907, a bottom side shown generally at 908, a proximal end shown generally at 910, distal ends shown generally at 912 and 914, and a central portion shown generally at 913.

The fin frame 904 also includes a first fin connector 916 located at the central portion 913 of the fin frame 904 between distal ends 912 and 914 and projecting outward from fin frame 904 in a direction away from the proximal end 910 of the fin frame 904. In this embodiment, first fin connector 916 is cylindrical in shape. In other embodiments, first fin connector 916 may be shaped differently. The first fin connector 916 defines a first fin retaining surface 917. The fin frame 904 also includes a second fin connector 922 located on the central portion 913 of the fin frame 904 and extending away from the fin frame 904 from the proximal end 910 of the fin frame 904. Second fin connector 922 defines a second fin retaining surface 923.

Figure 70:
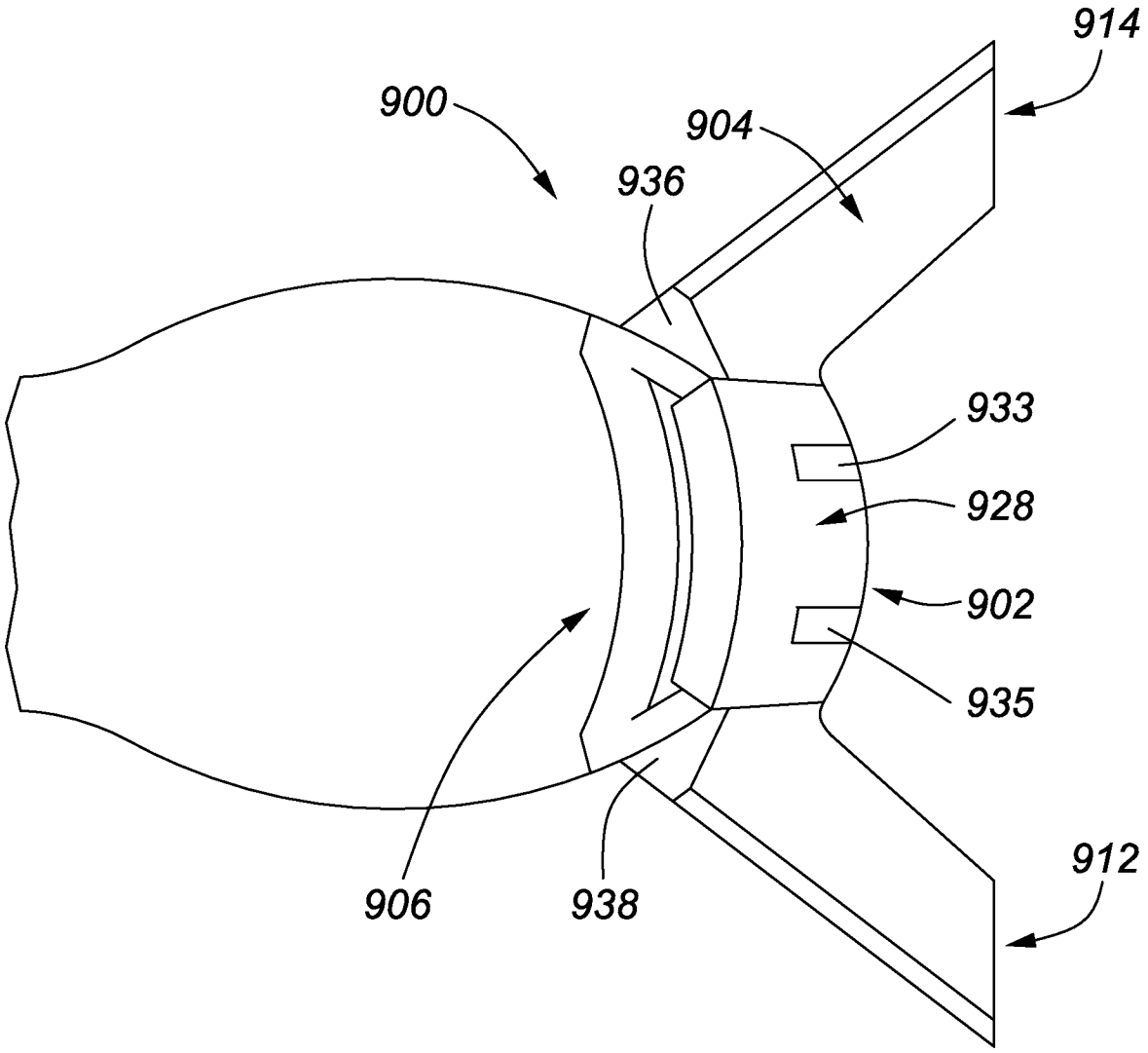
FIG. 70 is a top view of the fin system of FIG. 68.

Referring to FIGS. 68 and 70, in the current embodiment, the fin frame 904 also includes first and second projections 936 and 938 extending away from laterally opposite sides of the fin frame 904 in a direction away from the first fin connector 916 and towards corresponding laterally opposite sides of the boot toe body 906. As the boot toe body 906 is coupled to a fin including the boot coupling body 902 and the fin frame 904, the first and second projections 936 and 938 approach or contact the corresponding laterally opposite sides of the boot toe body 906. In some embodiments, one or both of the first and second projections 936 and 938 may be resiliently deformable so that, as the boot toe body 906 is coupled to a fin including the boot coupling body 902 and the fin frame 904, the first and second projections 936 and 938 may be resiliently urged into contact with the corresponding laterally opposite sides of the boot toe body 906. The first and second projections 936 and 938 may thus fill gaps or spaces that may otherwise be between the boot toe body 906 and the fin. Filling such gaps or spaces may reduce hydrodynamic drag or may reduce or avoid any likelihood of entanglement with objects such as fishing line.

Referring to FIGS. 68, 69, and 70, the boot coupling body 902 is similar to the boot coupling body 104 shown in FIG. 1, being curved in a generally-semi-circular shape having a top portion 928, a bottom portion 930, and an intermediate portion 932 extending between the top portion 928 and the bottom portion 930. The top portion 928 includes a holder (or a holding body) 929 that is complementary to the receptacle 901, that includes a retaining surface (or a holding surface) 937 that is complementary to the retaining surface 909, and that functions as a connector (or as a first boot connector) similar to the holder 138, the holder 330, the holder 430, or the holder 606 as described above, for example, so that the holder 929 is a means for connecting a fin body (coupled to the boot coupling body 902 and the fin frame 904) to the boot toe body 906 at a first complementary boot connector (the receptacle 901) of the boot toe body 906 on the top side 905 of the boot toe body 906. The intermediate portion 932 includes a recess 918 which defines a first complementary fin retaining surface 920 sized to contact the first fin retaining surface 917 on the first fin connector 916 of the fin frame 904 when the recess 918 receives the first fin connector 916. The bottom portion 930 includes a clasp (or boot clasp) 931 that includes a retaining surface 939 on a top side shown generally at 940 of the bottom portion 930 of the boot coupling body 902 and complementary to the retaining surface 915 of the receptacle 903 such that the clasp 931 functions as a connector (or as a second boot connector) similar to the clasp 140, the clasp 258, the clasp 286, the clasp 346, the clasp 418, or the clasp 624 as described above, for example, so the retaining surface 939 is a retaining surface for contacting the retaining surface 915 to connect the clasp 931 (which is a second boot connector) to the receptacle 903 (which is a second complementary boot connector), and the clasp 931 is a means for connecting a fin body (coupled to the boot coupling body 902 and the fin frame 904) to the boot toe body 906 at a second complementary boot connector (the receptacle 903) of the boot toe body 906 on the bottom side 911 of the boot toe body 906, the clasp 931 including the retaining surface 939 on the top side 940 of the bottom portion 930 of the boot coupling body 902 for contacting the retaining surface 915 of the second complementary boot connector (the receptacle 903).

The boot coupling body 902 includes curved members 933 and 935 that may affect how much force is required to vary a separation distance between the holder 929 and the clasp 931, which may thereby vary how easily the boot coupling body 902 may be coupled to or decoupled from the boot toe body 906. For example, relatively firm curved members 933 and 935 may cause the boot coupling body 902 to couple relatively securely to the boot toe body 906, and relatively flexible curved members 933 and 935 may cause the boot coupling body 902 to decouple relatively easily from the boot toe body 906. The curved members 933 and 935 may be integrally formed in the boot coupling body 902, or may be removable and replaceable too allow adjustability of how much force is required to vary a separation distance between the holder 929 and the clasp 931. Alternative embodiments may omit the curved members 933 and 935, or may include only one or more than two such curved members. Further, boot coupling bodies according to other embodiments (such as other boot coupling bodies described herein, for example) may include one, two, or more than two such curved members, or may omit such curved members.

The bottom portion 930 also includes a fin clasp 924 which defines a second complementary fin retaining surface 926. FIG. 69 illustrates the fin clasp 924 in a retaining position in which the second complementary fin retaining surface 926 is positioned to contact the second fin retaining surface 923 on the second fin connector 922 on the fin frame 904 when the recess 918 receives the first fin connector 916 as shown in FIG. 69.

In the current embodiment, the fin clasp 924 is resiliently moveable from the retaining position in a substantially downward direction relative to the remainder of the boot coupling body 902 such that fin clasp 924 can alternate between the retaining position and a releasing position in which the second complementary fin retaining surface 926 is separated from the second fin retaining surface 923 to allow the fin frame 904 to be released from the boot coupling body 902.

In the current embodiment, the fin frame 904 may be coupled to boot coupling body 902 (which forms a fin including the boot coupling body 902 and the fin frame 904) prior to coupling the boot coupling body 902 to boot toe body 906. Initially, in one embodiment, the first fin connector 916 on the fin frame 904 is received in the recess 918 such that first fin retaining surface 917 contacts first complementary fin retaining surface 920. Further, the fin frame 904 may apply a downward force on the fin clasp 924, thereby causing fin clasp 924 to move in a substantially downward direction relative to the remainder of the boot coupling body 902 from the retaining position to the releasing position. The second fin connector 922 may then move beyond the fin clasp 924, allowing the fin clasp 924 to move resiliently from the releasing position back to the retaining position in a substantially upwards direction relative to the remainder of the boot coupling body 902, thereby causing second complementary fin retaining surface 926 contact second fin retaining surface 923. Fin frame 904 may thereby be detachably coupled to the boot coupling body 902 due to retaining surfaces 920 and 926 restricting movement of the fin frame 904 relative to the boot coupling body 902.

To decouple the fin frame 904 from boot coupling body 902, fin clasp 924 may be moved into the releasing position, thereby causing second complementary fin retaining surface 926 to lose contact with second fin retaining surface 923 and allowing fin frame 904 to move in a direction away from the recess 918 on boot coupling body 902, thereby causing first fin retaining surface 917 to lose contact with first complementary fin retaining surface 920.

The fin system 900 thus allows the fin frame 904 (which may be integrally, permanently, detachably, or non-detachably coupled to a fin body such as fin body 307 as shown in FIG. 43 or other fin bodies described herein for example) to be attached to and detached from the boot coupling body 902, for example by snapping the fin frame 904 into or out of the boot coupling body 902. In general, connections and disconnections as described herein may be audible, tactile, or both audible and tactile, which may provide a user with confirmation that a connection or disconnection is complete.

Other embodiments such as those described herein may include similar connectors to couple a fin frame (or a fin) to a boot coupling body. For example, in one embodiment, the fin frame 306 (shown in FIG. 43) may be coupled to the coupling body 304 (also shown in FIG. 43) with connectors (or fin connectors) similar to the first fin connector 916, the second fin connector 922, the recess 918, and the fin clasp 924 as described above, instead of with the retaining member 322 as described above. As another example, in one embodiment, the fin frame 904 may be coupled to the coupling body 902 with a connector similar to the retaining member 322 (shown in FIG. 43) as described above. More generally, such connectors and components of the embodiments described herein may be varied or interchanged in alternative embodiments.

The boot toe body 906 is similar to the boot toe body 106 as shown in FIGS. 1, 6, and 7. Accordingly, coupling the boot coupling body 902 to boot toe body 906 may be done in substantially the same manner as described with reference to FIGS. 6 and 7.

The fin system 900 also includes a resiliently compressible dampening member 934 that may be coupled to the boot coupling body 902 or to the boot toe body 906 (for example on a boot tread) and positioned such that, when the boot coupling body 902 is coupled to the boot toe body 906, the dampening member 934 is positioned between the boot coupling body 902 and the toe body 906 to dampen movement of the boot toe body 906 relative to the fin including the boot coupling body 902 and the fin frame 904. Alternative embodiments may omit the dampening member 934 or may include more than one such dampening member. Further, other embodiments such as those described herein may also include one or more dampening members, which may be coupled to a boot toe body, to a fin frame, or to a boot coupling body, for example.

Figure 71:
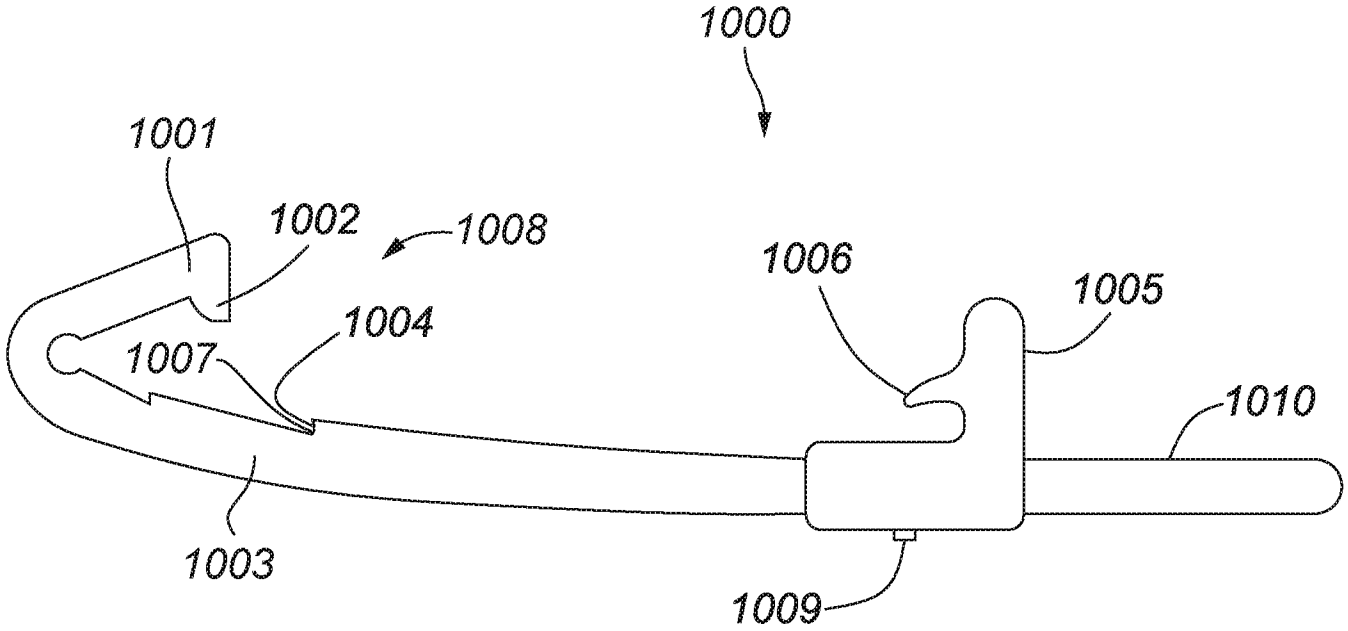
FIG. 71 is a side view of a boot coupling body and heel coupling body according to another embodiment.

Referring to FIG. 71, a boot coupling body according to another embodiment is shown generally at 1000 and includes a top portion 1001 including a first boot connector 1002, and a bottom portion 1003 including a second boot connector 1004, a heel coupling body 1005, and a strap 1010, which may be semi-rigid in some embodiments. The first boot connector 1002 may be similar to the holder 138, the holder 330, the holder 430, the holder 606, or the holder 929 as described above, for example, so that the first boot connector 1002 is also a means for connecting a fin body to a boot toe body at a first complementary boot connector of the boot toe body on a top side of the boot toe body, and the second boot connector 1004 includes a retaining surface 1007 on a top side shown generally at 1008 of the bottom portion 1003 of the boot coupling body 1000 and may be similar to the clasp 140, the clasp 258, the clasp 286, the clasp 346, the clasp 418, the clasp 624, or the clasp 931 as described above, for example, so that the retaining surface 1007 is also a retaining surface for contacting a retaining surface of a second complementary boot connector on a bottom side of a boot toe body to connect the second boot connector 1004 to the second complementary boot connector on the bottom side of the boot toe body, and so that the second boot connector 1004 is also a means for connecting a fin body to a boot toe body at a second complementary boot connector of the boot toe body on a bottom side of the boot toe body, the second boot connector 1004 including the retaining surface 1007 on the top side 1008 of the bottom portion 1003 of the boot coupling body 1000 for contacting a retaining surface of the second complementary boot connector. Heel coupling body 1005 includes a third boot connector 1006 and a fastener 1009, which may for example be a threaded fastener that may tightened onto the strap 1010 by rotation of fastener 1009, or which may be one or more different fasteners. The third boot connector 1006 may be similar to the connector 266, the heel coupling body 502, the heel coupling body 632, the heel coupling body 652, or the heel coupling body 802 as described above, for example, all of which may function as a connector (or boot connector) as described herein.

Strap 1010 extends between first and second boot connectors 1002 and 1004 and third boot connector 1006. Heel coupling body 1005 is slidably attachable to strap 1010 such that a user can adjust a distance between first and second boot connectors 1002 and 1004 and third boot connector 1006 by slidably moving the heel coupling body 1005 along the strap 1010 to a desired position. The fastener 1009 can be tightened onto the strap 1010 to fasten the heel coupling body 1005 to the strap 1010 in the desired position. A distance separating the first and second boot connectors 1002 and 1004 from the third boot connector 1006 is thus adjustable, and if desired any excess length of the strap 1010 may be removed and discarded. In some embodiments, multiple fasteners may be employed to fasten heel coupling body 1005 to strap 1010. In some embodiments, at least one of said fasteners may be included on strap 1010, heel coupling body 1005, or on both. Other embodiments such as those described herein may be similarly adjustable. For example, the connector 266 may be on a heel coupling body that is slidable along a strap, and such a heel coupling body may have a fastener that can fasten the heel coupling body to such a strap in a desired position. Also, other heel coupling bodies such as the heel coupling body 502, the heel coupling body 632, the heel coupling body 652, or the heel coupling body 802 for example may be slidable along a strap and may have a fastener that can fasten the heel coupling body to such a strap in a desired position.

Figure 72:
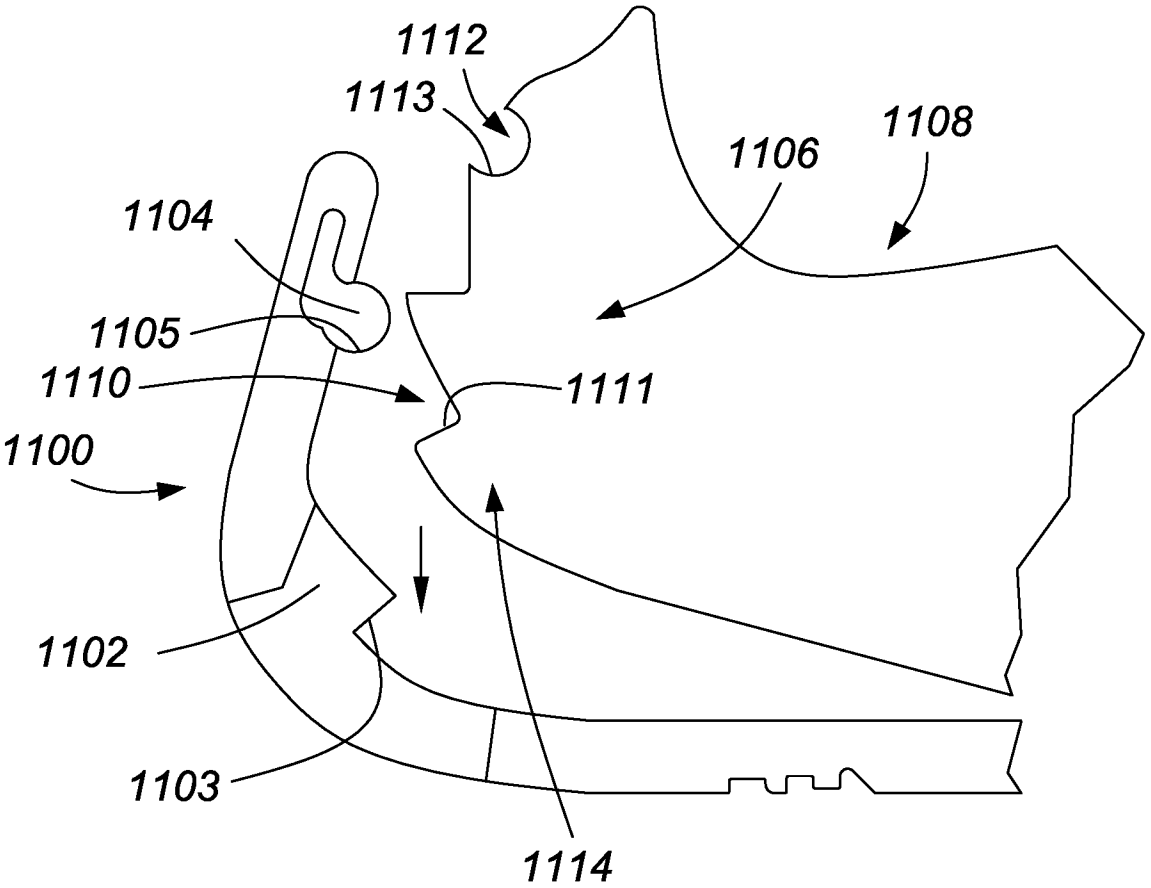
FIG. 72 is an unassembled side view of boot and heel coupling bodies according to another embodiment.
Figure 73:
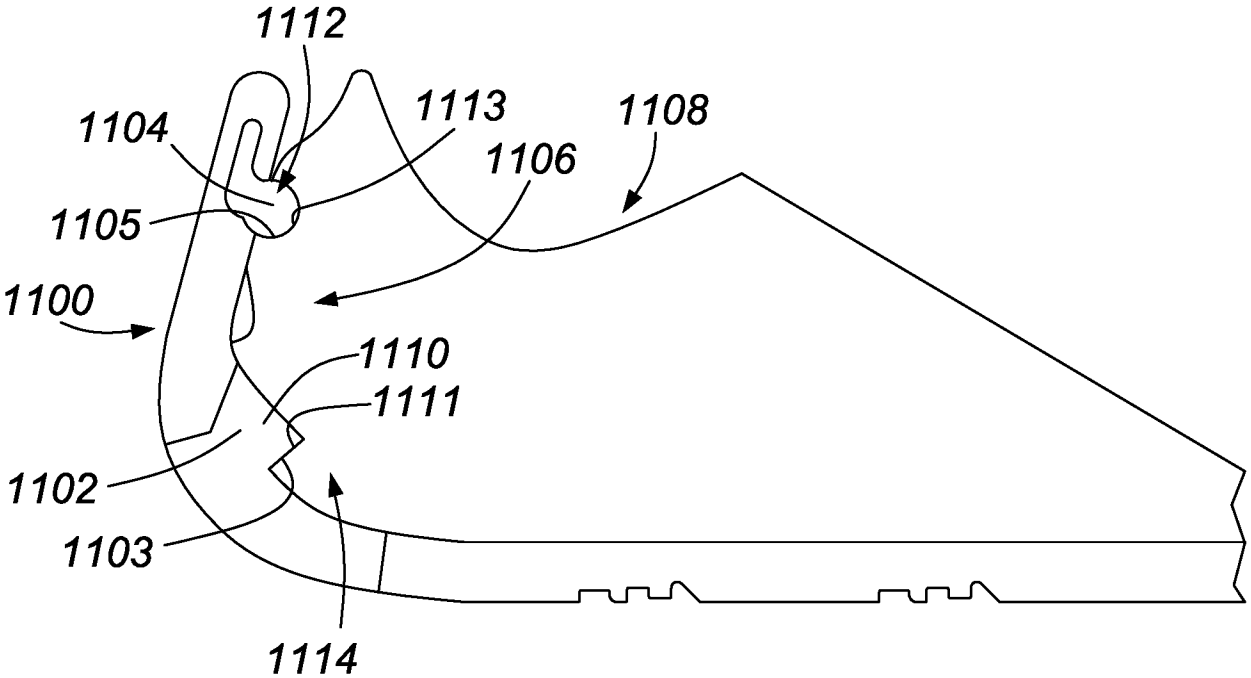
FIG. 73 is an assembled side view of the boot and heel coupling bodies of the embodiment of FIG. 72.

Referring to FIGS. 72 and 73, another embodiment of a heel coupling body is shown generally at 1100. Heel coupling body 1100 can be an extension of a bottom portion of a boot coupling body (like the connector 266, the heel coupling body 502, the heel coupling body 632, the heel coupling body 652, or the heel coupling body 802 as described above, for example), or can be slidably attached to a strap as shown in FIG. 71, for example. Heel coupling body 1100 defines a boot connector (or third boot connector) 1102 having a boot retaining surface 1103. Boot connector 1102 may be similar to the third boot connector 1006 as described above, for example. Heel coupling body 1100 also includes a boot connector (or fourth boot connector) 1104 which defines a boot retaining surface 1105.

Heel coupling body 1100 may be coupled to boot shown generally at 1108. The boot 1108 is not necessarily a complete boot, but may in various embodiments be an open-heel body for receiving a boot or for receiving a foot or prosthetic limb, for example. Boot 1108 includes a heel portion 1106 and a bottom portion 1114. Heel portion 1106 of the boot 1108 includes a receptacle 1110 which defines a heel retaining surface 1111 complementary to the retaining surface 1103 on the boot connector 1102. Boot 1108 also includes a receptacle 1112 defining a heel retaining surface 1113 complementary to the boot retaining surface 1105.

To couple the boot 1108 to the heel coupling body 1100, the retaining surface 1103 on the boot connector 1102 may be positioned against corresponding heel retaining surface 1111 of receptacle 1110. Further, as an additional connection, boot connector 1104 may be urged into receptacle 1112, causing boot retaining surface 1105 to contact corresponding heel retaining surface 1113, further coupling heel coupling body 1100 to the boot 1108. Thus, boot connectors 1102 and 1104 thereby interact with receptacles 1110 and 1112 to restrict movement of boot 1108 relative to the heel coupling body 1100, and the boot connector 1104 may thus function as an additional or "safety" connector to reduce or avoid any likelihood of accidental decoupling of the heel coupling body 1100 from the boot 1108. Other embodiments such as those described herein may also include an additional or "safety" connector such as the boot connector 1104 and a complementary boot connector such as the receptacle 1112.

Figure 74:
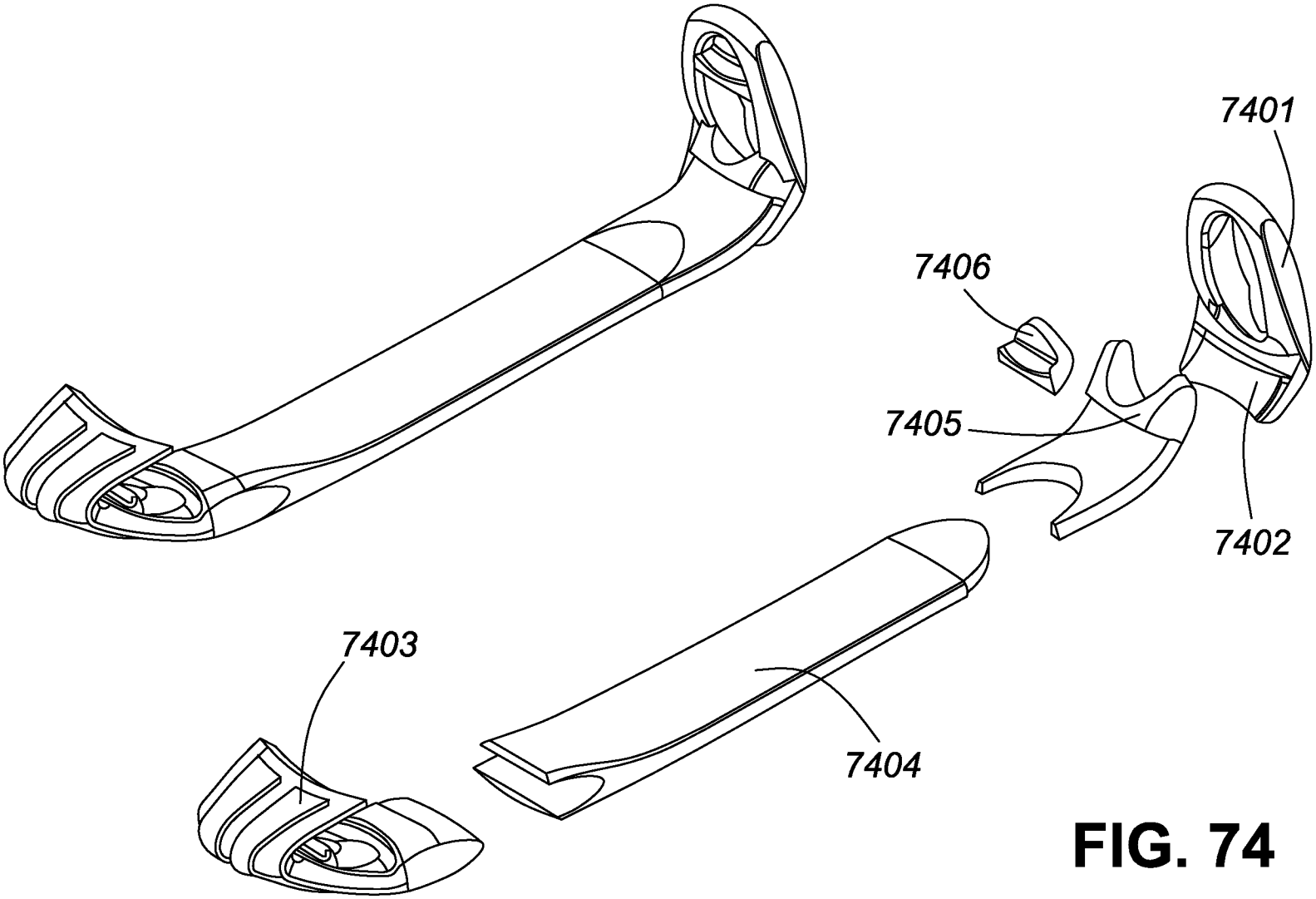
FIG. 74 is a perspective view of a boot coupling body and heel coupling body according to another embodiment.
Figure 75:
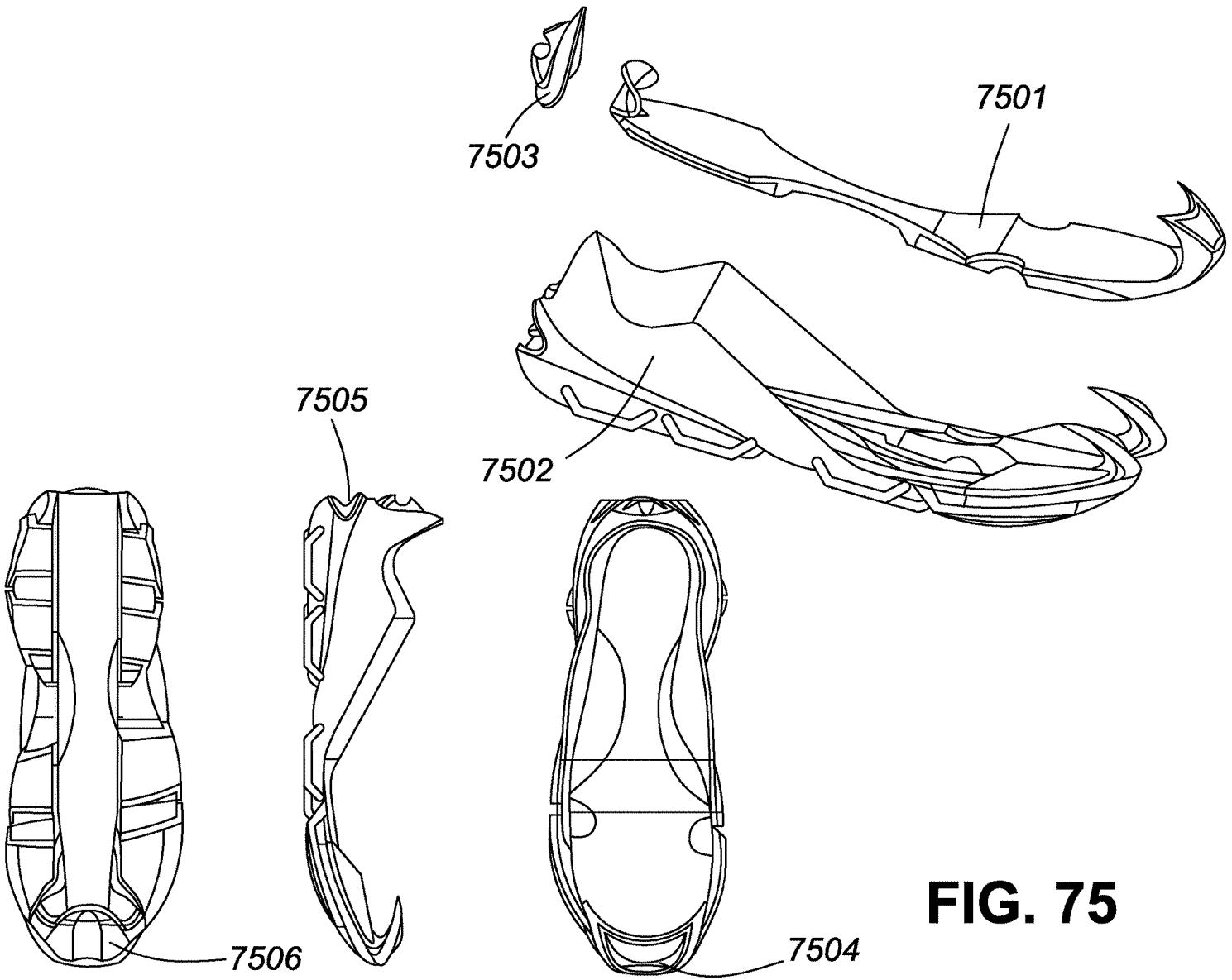
FIG. 75 is a perspective view of a boot according to another embodiment.
Figure 76:
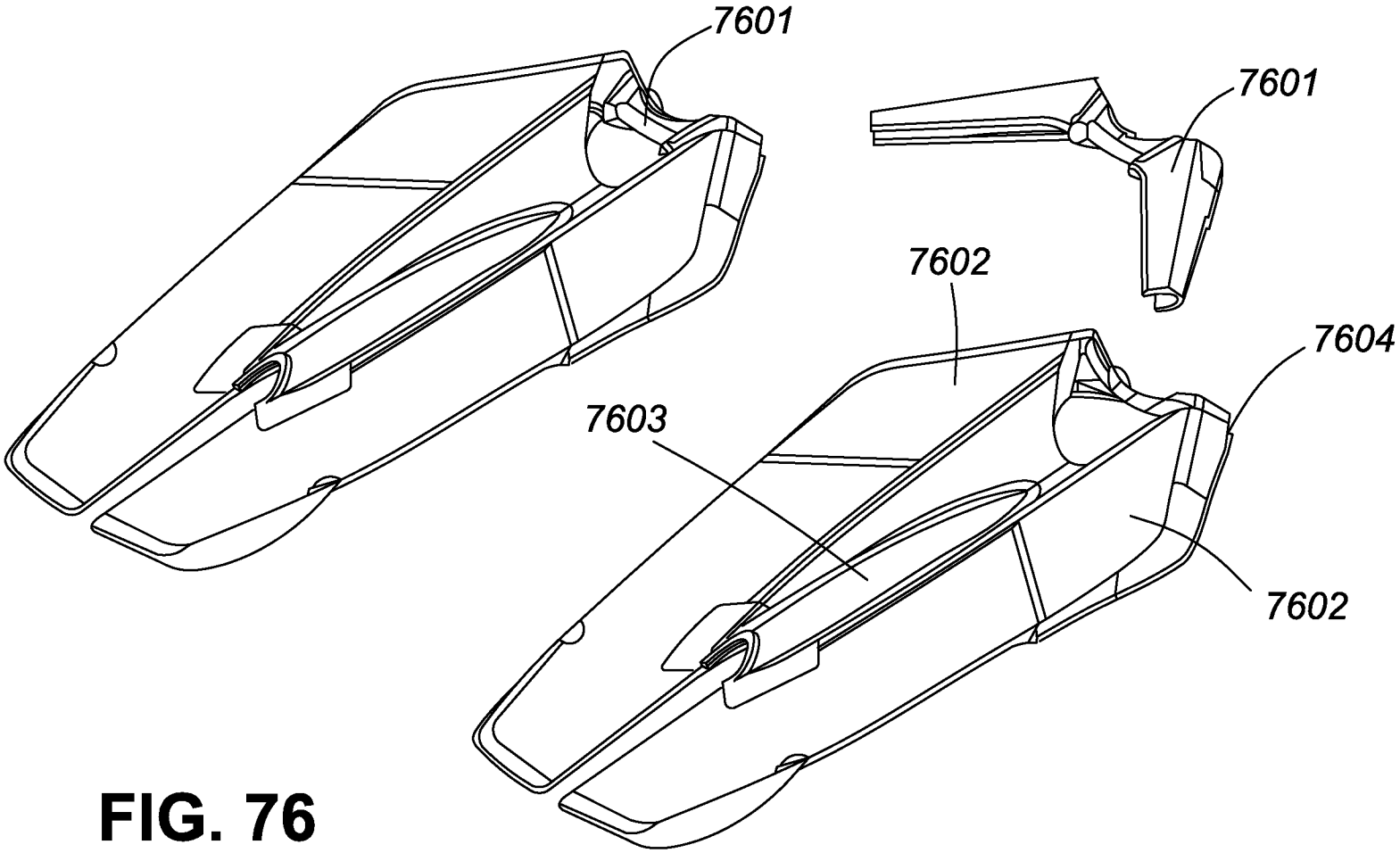
FIG. 76 is a perspective view of a fin according to another embodiment.

FIGS. 74, 75, and 76 are illustrations of other embodiments. For example, FIG. 74 illustrates a boot coupling body according to one embodiment, and FIG. 75 illustrates a boot including a boot-sole inlay according to one embodiment. FIG. 74 illustrates a heel pad 7401, a heel stomp pad 7402, a c-clamp 7403, a strap 7404, a rear hook 7405, and a heel safety hook 7406. FIG. 75 illustrates an inlay 7501, a sole 7502, a boot heel safety 7503, a front top hook 7504, a rear hook 7505, and a front bottom hook 7506. Such a boot-sole inlay, and other bodies such as those described herein for example, may function as a boot sole reinforcement and may also function as a boot toe body, as a heel coupling body, or as both a boot toe body and a heel coupling body as described herein, for example. Such a boot-sole inlay, and other bodies such as those described herein for example, may be formed in different sizes (such as nine different lengths for different shoe sizes, for example). Alternatively, separate inlays for toe and sole regions of a boot may be placed into a mould for a particular shoe size and separated by a distance according to the particular shoe size, so that such separate inlays may reduce tooling costs that would be involved in producing different sizes of single-piece boot-sole inlays for different shoe sizes. Still other embodiments may include only a toe portion and omit any heel portion, which may also reduce tooling costs. Embodiments such as those described herein may be sized to balance interests such as one or more of handling, function, ergonomics, appearance, and producibility for example, and may provide an interface between a human foot and a fin that may provide enough support to attach and use the fin, that may allow agility of the ankle joint under water, and that may protect the foot walking on rough and sharp surfaces. The boot of FIG. 75 is a body for receiving a boot and includes an additional or "safety" connector (similar to the boot connector 1104) identified at 7503 in FIG. 75. FIG. 76 illustrates a fin according to one embodiment. FIG. 76 illustrates a y-frame 7601, a hinge 7602, a membrane 7603, and a spoiler/deflector 7604.

In some embodiments, boots or boot inlays, such as the boot inlay shown in FIG. 75 or other boots or boot inlays such as those described herein for example, may include one or more (such as four, for example) cleat or stud bodies positioned on a bottom side to contact a surface (such as ground, for example) when a user wearing the boot walks on such a surface. Such cleat or stud bodies may prevent other surfaces on the boot or boot inlay from damage or wear when the user walks on such a surface, which may preserve retaining surfaces or other surfaces or structures such as those described herein for example, which may, for example, preserve functionality as described herein and prolong usability of such boots or boot inlays. Further, such cleat or stud bodies may be detachable and replaceable, for example when such cleat or stud bodies become worn from contact with a surface when a user walks on the surface, so that replacing such cleat or stud bodies may further prolong usability of boots or boot inlays such as those described herein for example.

Figure 77:
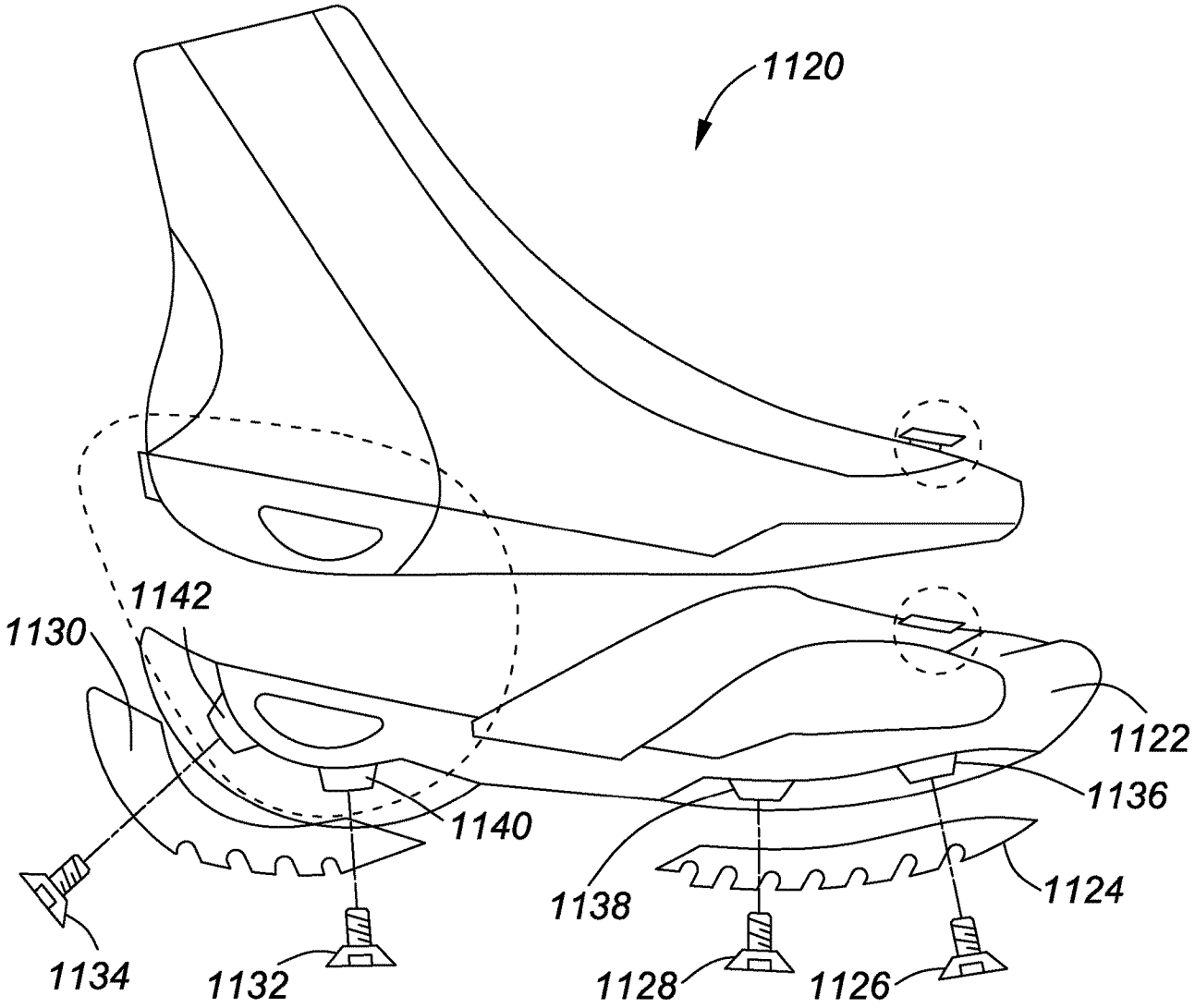
FIG. 77 is a side view of a boot and a boot toe body according to another embodiment.

As another example, referring to FIG. 77, a boot assembly according to another embodiment is shown generally at 1120 and includes a boot inlay 1122. A front profile 1124 is attachable to the boot inlay 1122 using fasteners 1126 and 1128, and a rear profile 1130 is attachable to the boot inlay 1122 using fasteners 1132 and 1134. For example, in some embodiments, the fasteners 1126, 1128, 1132, and 1134 may be stainless steel screws or bolts that may be connectable to metal inserts 1136, 1138, 1140, and 1142 respectively. As with the cleat or stud bodies described above, the front profile 1124 and the rear profile 1130 may be positioned on a bottom side to contact a surface (such as ground, for example) when a user wearing the boot assembly 1120 walks on such a surface to prevent other surfaces on the boot assembly 1120 from damage or wear when the user walks on such a surface, which may preserve retaining surfaces or other surfaces or structures such as those described herein for example, which may, for example, preserve functionality as described herein and prolong usability of the boot assembly 1120. Further, the front profile 1124 and the rear profile 1130 may be detachable and replaceable, for example when the front profile 1124 and the rear profile 1130 become worn from contact with a surface when a user walks on a surface, so that replacing the front profile 1124 and the rear profile 1130 may further prolong usability of the boot assembly 1120. Alternative embodiments may include more or fewer replaceable profiles, different replaceable profiles, or no replaceable profiles at all, and more, fewer, or different fasteners, on various different embodiments of boots, boot toe bodies, boot inlays, or other shoes or footwear such as those described herein, for example.

Figure 78:
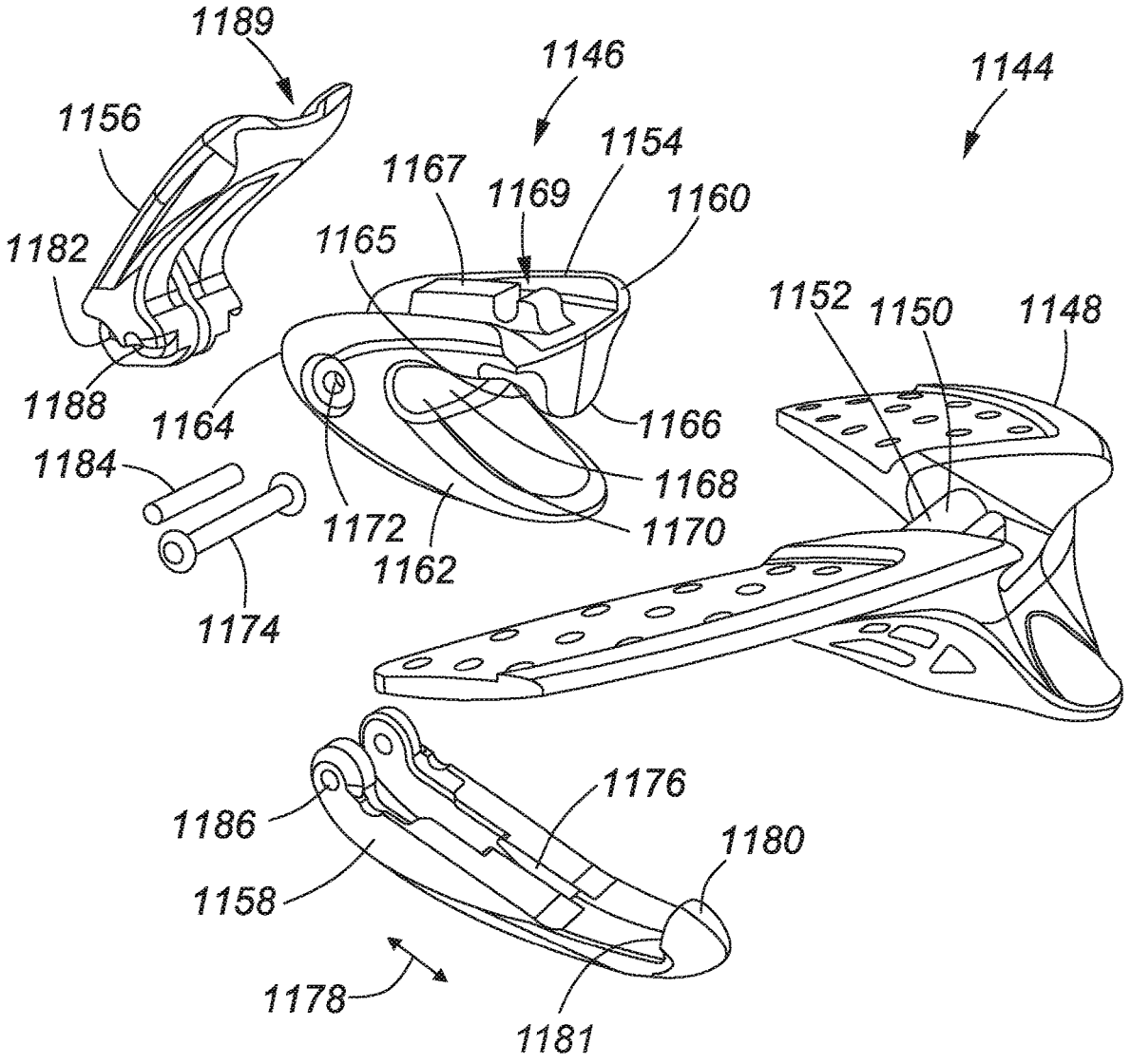
FIG. 78 is an exploded top perspective view of a fin system according to another embodiment.
Figure 79:
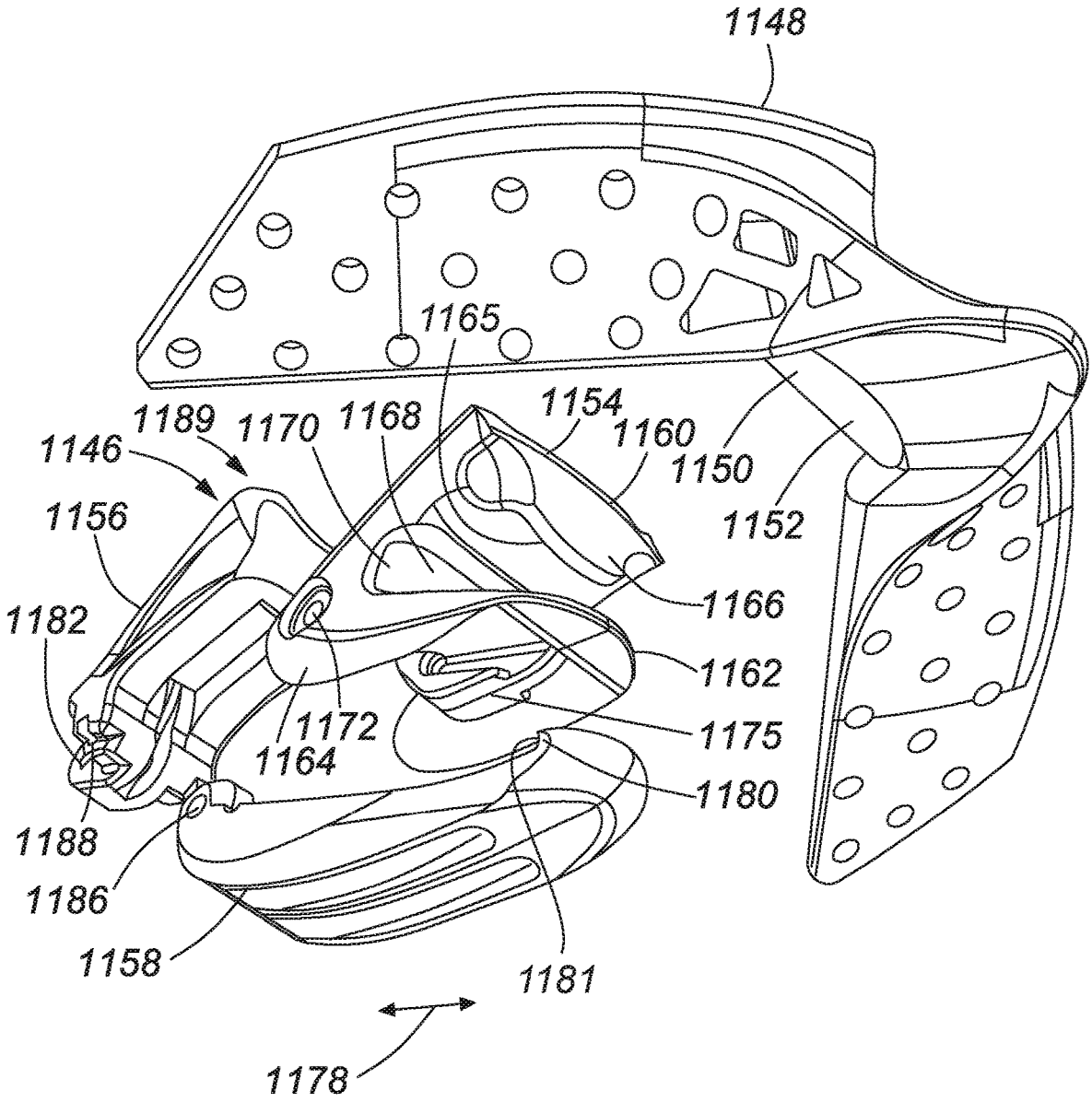
FIG. 79 is an exploded bottom perspective view of the fin system of FIG. 78.

Referring to FIGS. 78 and 79, a fin system according to another embodiment is shown generally at 1144 and includes a boot coupling body shown generally at 1146 and a fin frame 1148. The fin frame 1148 may be integrally, permanently, detachably, or non-detachably coupled to a fin body such as fin body 307 as shown in FIG. 43 or other fin bodies described herein for example, and when the fin frame 1148 is coupled to such a fin body, the fin frame 1148 and the fin body may together function substantially the same as other fin bodies described above, such as the fin body 102 or the fin bodies shown in FIGS. 16, 21, 26, 35, 36, and 42 for example. The fin frame 1148 may be similar to the fin frame 904 and includes a fin connector 1150 defining a fin retaining surface 1152 that may be similar to the first fin connector 916 and the first fin retaining surface 917 respectively.

The boot coupling body 1146 includes a generally-semi-circular body 1154, a lever body 1156, and a movable connector body 1158. The generally-semi-circular body 1154 has a top portion 1160, a bottom portion 1162, and an intermediate portion 1164 extending between the top portion 1160 and the bottom portion 1162.

The top portion 1160 includes a holder (or a holding body) 1166 that is complementary to a receptacle (for example the receptacle 1192 shown in FIGS. 82 and 83) on a top portion of a boot toe body that functions as a connector (or as a first complementary boot connector) similar to the receptacle 148 as described above, for example, and the holder 1166 includes a retaining surface (or a holding surface) 1165 such that the holder 1166 functions as a connector (or as a first boot connector) similar to the holder 138, the holder 330, the holder 430, the holder 606, or the holder 929 as described above, for example. The top portion 1160 also defines a connection body 1167 that, in the embodiment shown, includes a recess shown generally at 1169 for receiving and releasably holding a portion of the lever body 1156.

The intermediate portion 1164 includes a recess 1168 which defines a complementary fin retaining surface 1170 sized to contact the fin retaining surface 1152 on the fin connector 1150 of the fin frame 1148 to hold the fin connector 1150 releasably in the recess 1168 and thus to hold the fin frame 1148 releasably to the boot coupling body 1146 when the recess 1168 receives the fin connector 1150. The intermediate portion 1164 also includes a transverse through-opening 1172 sized to receive a pivot 1174.

The bottom portion 1162 includes a projection 1175 receivable in a channel 1176 of the movable connector body 1158 to attach the movable connector body 1158 to the bottom portion 1162 while allowing the movable connector body 1158 to slide relative to the bottom portion 1162 in a direction 1178 that is longitudinal relative to the movable connector body 1158 and in which a clasp (or boot clasp) 1180 on the movable connector body 1158 moves towards and away from the bottom portion 1162. When the movable connector body 1158 is attached to the bottom portion 1162 of the generally-semi-circular body 1154 of the boot coupling body 1146, the clasp 1180 is on a bottom portion 1163 of the boot coupling body 1146. The clasp 1180 includes a retaining surface 1181 on a top side shown generally at 1183 of the bottom portion 1163 of the boot coupling body 1146. The retaining surface 1181 is complementary to a retaining surface of a receptacle (for example a retaining surface 1196 of the receptacle 1194 shown in FIGS. 82 and 83) that functions as a connector (or as a second complementary boot connector) similar to the receptacle 150 as described above, for example. The clasp 1180 functions as a connector (or as a second boot connector) similar to the clasp 140, the clasp 258, the clasp 286, the clasp 346, the clasp 418, the clasp 624, or the clasp 931 as described above, for example, so the retaining surface 1181 is a retaining surface for contacting the retaining surface 1196 to connect the clasp 1180 (which is a second boot connector) to the receptacle 1194 (which is a second complementary boot connector).

The lever body 1156 includes a transverse through-opening 1182 sized to receive a pivot 1184, and the movable connector body 1158 includes a transverse through-opening 1186 also sized to receive the pivot 1184. As a result, the lever body 1156 and the movable connector body 1158 may be hingedly connected to each other at the transverse through-openings 1182 and 1186 respectively for rotation around the pivot 1184. Further, the lever body 1156 includes a transverse through-opening 1188 sized to receive the pivot 1174. As a result, the lever body 1156 and the intermediate portion 1164 may be hingedly connected to each other at the transverse through-openings 1172 and 1188 respectively for rotation around the pivot 1174. A distal end of the lever body 1156 is shown generally at 1189 and is at an opposite end of the lever body 1156 from the transverse through-openings 1186 and 1188.

Figure 80:
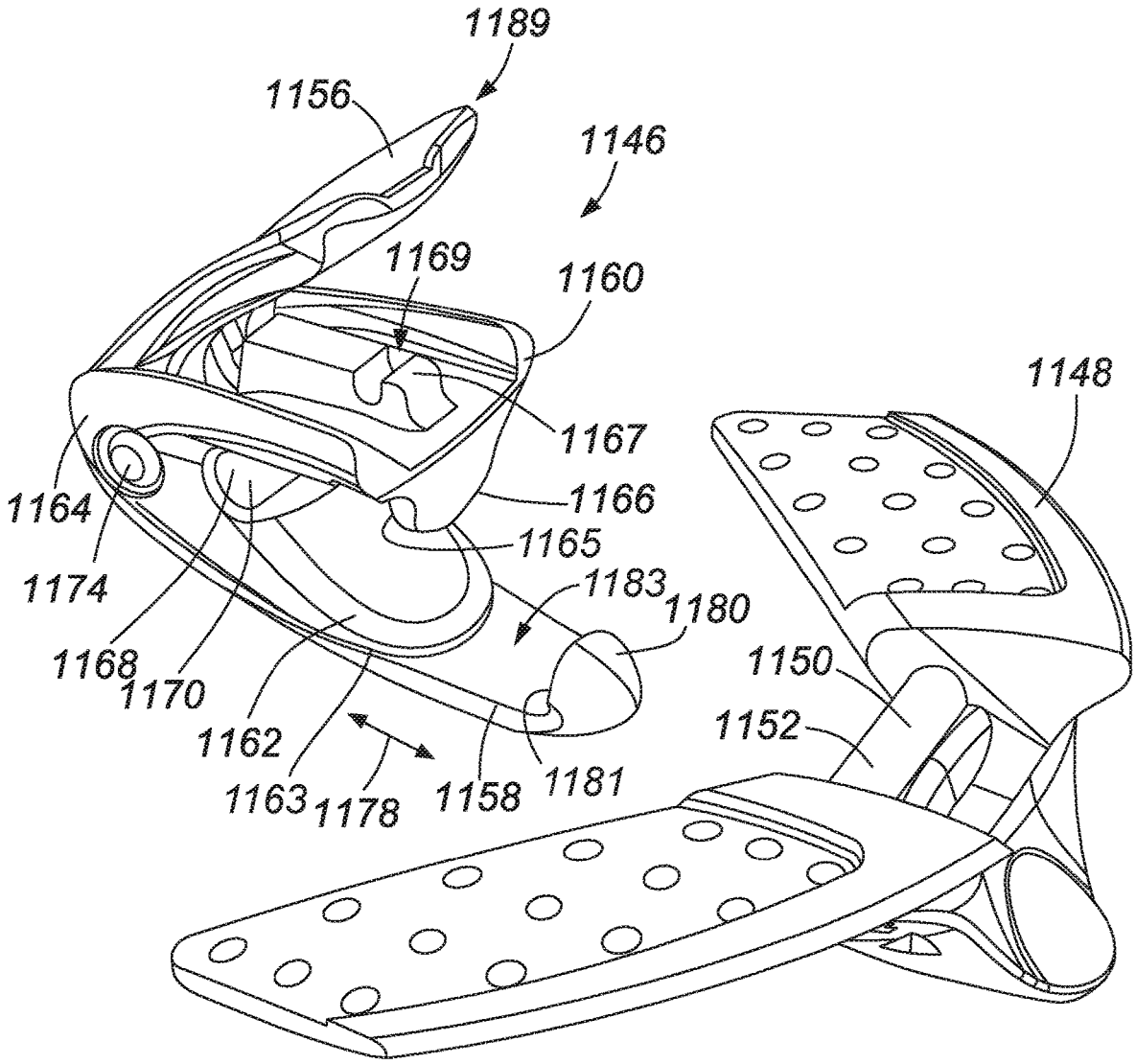
FIG. 80 is an exploded top perspective view of the fin system of FIG. 78, showing a boot coupling body of the fin system of FIG. 78 assembled.

The boot coupling body at 1146 may be assembled as shown in FIG. 80 with the lever body 1156 and the movable connector body 1158 hingedly connected to each other at the transverse through-openings 1182 and 1186 respectively for rotation around the pivot 1184, with the lever body 1156 and the intermediate portion 1164 hingedly connected to each other at the transverse through-openings 1172 and 1188 respectively for rotation around the pivot 1174, and with the projection 1175 of the bottom portion 1162 received in the channel 1176 to attach the movable connector body 1158 to the bottom portion 1162 while allowing the movable connector body 1158 to slide relative to the bottom portion 1162 in the direction 1178 so that the clasp 1180 is movable towards and away from the bottom portion 1162.

Figure 81:
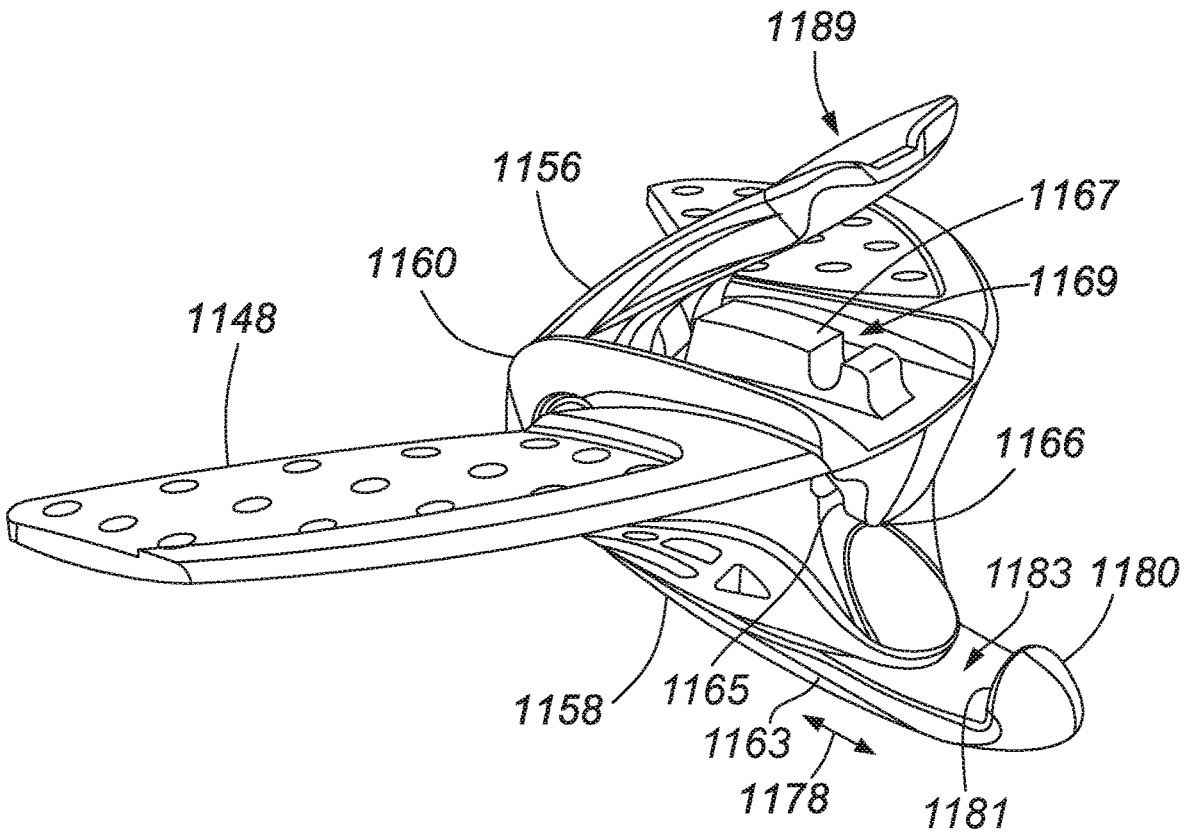
FIG. 81 is a top perspective view of the fin system of FIG. 78.
Figure 82:
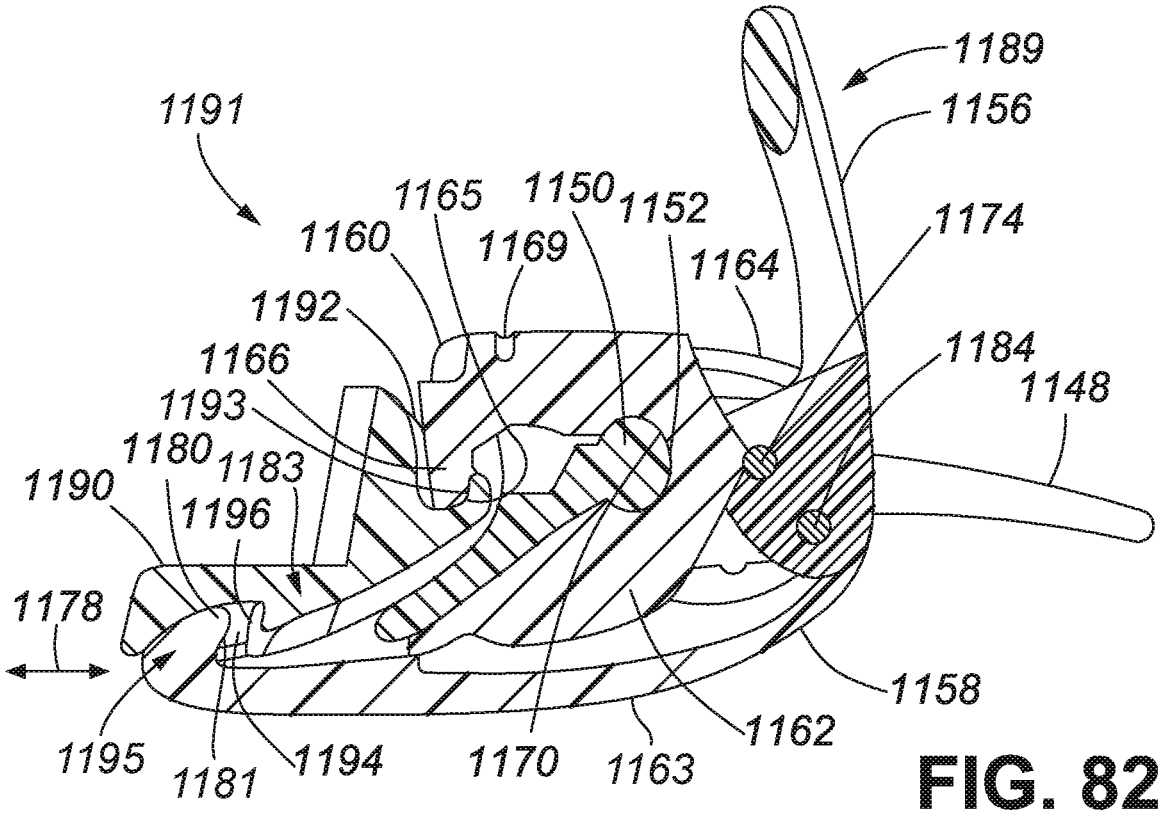
FIG. 82 is a cross-sectional view of the fin system of FIG. 78, showing a boot toe body and showing a lever body of the boot coupling body of the fin system of FIG. 78 in an open position.
Figure 83:
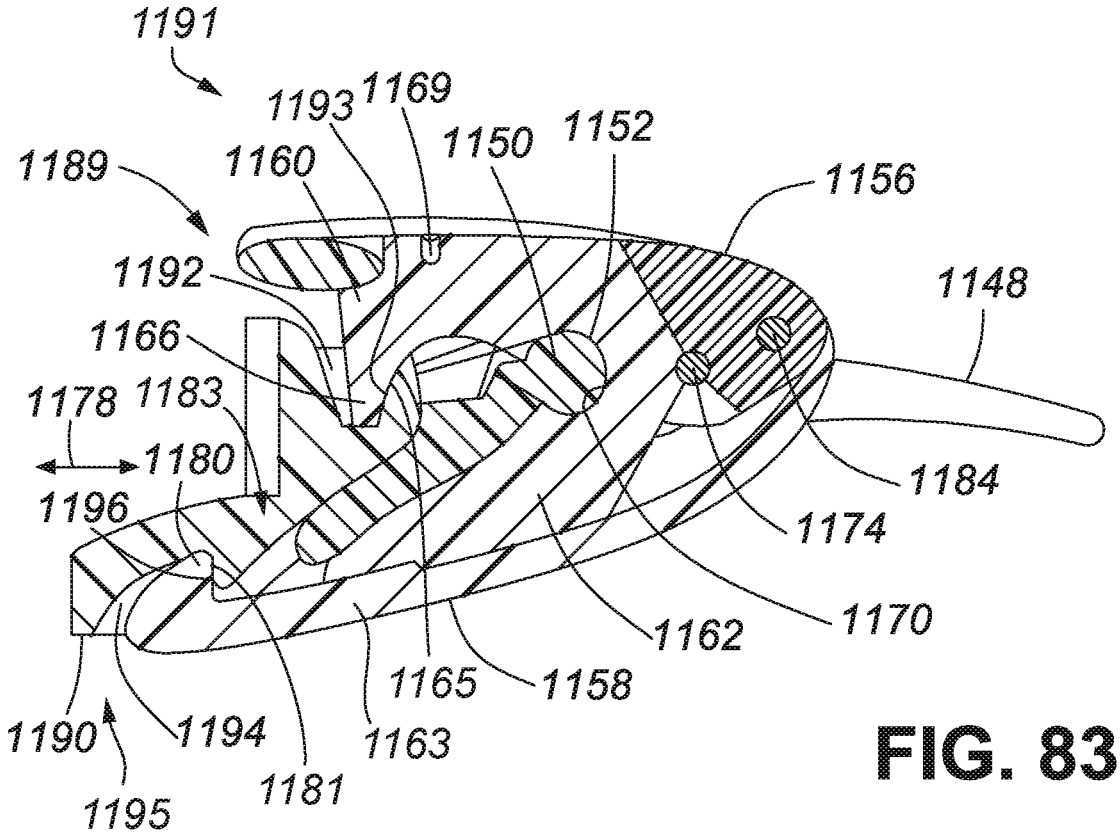
FIG. 83 is a cross-sectional view of the fin system of FIG. 78, showing the boot toe body of FIG. 82 and showing the lever body of FIG. 82 in a closed position.
Figure 84:
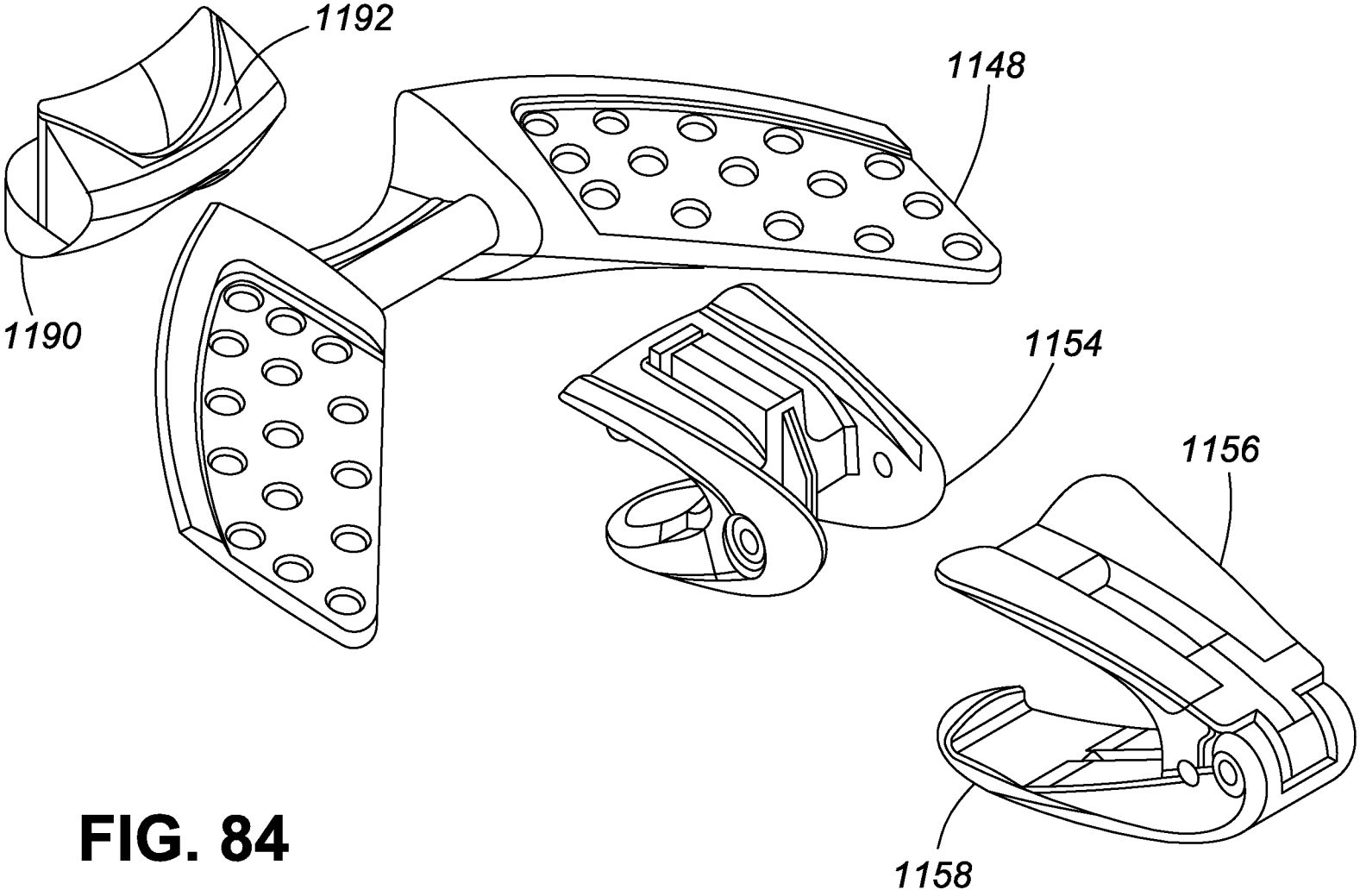
FIG. 84 is an exploded top perspective view of the fin system of FIG. 78, showing the boot toe body of FIG. 82.

Once the boot coupling body at 1146 is assembled, the lever body 1156 may be moved to an open position shown in FIGS. 80 to 82 in which the lever body 1156 is pivoted around the pivot 1174 to separate the distal end 1189 of the lever body 1156 from the top portion 1160. As the distal end 1189 of the lever body 1156 is moved away from the top portion 1160, the pivot 1184 moves around the pivot 1174 and moves the movable connector body 1158 and the clasp 1180 in the direction 1178 away from the bottom portion 1162. As shown in FIG. 83, the lever body 1156 may be moved to a closed position in which the lever body 1156 is pivoted around the pivot 1174 to move the distal end 1189 of the lever body 1156 closer to the top portion 1160. As the distal end 1189 of the lever body 1156 is moved closer to the top portion 1160, the pivot 1184 moves around the pivot 1174 and moves the movable connector body 1158 and the clasp 1180 in the direction 1178 towards the bottom portion 1162.

Accordingly, once assembled, the boot coupling body at 1146 may function similarly to the boot coupling body 902, except that the clasp 1180 is movable towards and away from the bottom portion 1162 (and thus towards and away from the fin frame 1148) in the direction 1178. For example, the fin frame 1148 may be coupled to the boot coupling body 1146 by receiving the fin connector 1150 in the recess 1168 and more generally as described above with reference to the fin frame 904 and the boot coupling body 902 or in other ways such as other ways described herein, for example.

Referring to FIG. 82, the fin frame 1148 may then be coupled to a boot toe body 1190. On a top side shown generally at 1191, the boot toe body 1190 includes a receptacle 1192, which includes a retaining surface 1193 on the top side 1191 of the boot toe body 1190, and which functions as a connector (or as a first complementary boot connector) similar to the receptacle 148 as described above, for example. Also, on a bottom side shown generally at 1195, the boot toe body 1190 includes a receptacle 1194, which includes the retaining surface 1196 on the bottom side 1195 of the boot toe body 1190, and which functions as a connector (or as a second complementary boot connector) similar to the receptacle 150 as described above, for example, and the retaining surface 1196 is a retaining surface of the receptacle 1194, which is a second complementary boot connector. The fin frame 1148 may then be coupled to the boot toe body 1190 for example by positioning the holder 1166 in the receptacle 1192, and then—when the lever body 1156 is in the open position (shown in FIGS. 80 to 82) in which the clasp 1180 is moved in the direction 1178 away from the bottom portion 1162—by positioning the clasp 1180 in the receptacle 1194. As shown in FIG. 82, the clasp 1180 may be received easily in the receptacle 1194 when the lever body 1156 is in the open position because moving the clasp 1180 in the direction 1178 away from the bottom portion 1162 may move the clasp 1180 past the retaining surface 1196 in the receptacle 1194. Then, when the holder 1166 is in the receptacle 1192 and when the clasp 1180 is received in the receptacle 1194, the lever body 1156 may be moved to the closed position (shown in FIG. 83) in which the distal end 1189 of the lever body 1156 is moved closer to the top portion 1160 and the clasp 1180 is moved in the direction 1178 towards the bottom portion 1162. As the clasp 1180 is moved in the direction 1178 towards the bottom portion 1162, the clasp 1180 may be retained behind the retaining surface 1196 and the fin frame 1148 may thus be coupled to the boot toe body 1190. Therefore, the holder 1166 is a means for connecting a fin body (coupled to the boot coupling body 1146 and the fin frame 1148) to the boot toe body 1190 at a first complementary boot connector (the receptacle 1192) of the boot toe body 1190 on the top side 1191 of the boot toe body 1190, and the clasp 1180 is a means for connecting such a fin body to the boot toe body 1190 at a second complementary boot connector (the receptacle 1194) of the boot toe body 1190 on the bottom side 1195 of the boot toe body 1190, the clasp 1180 including the retaining surface 1181 on the top side 1183 of the bottom portion 1163 of the boot coupling body 1146 for contacting the retaining surface 1196 of the second complementary boot connector (the receptacle 1194). Further, the fin frame 1148 may be decoupled from the boot toe body 1190 by returning the lever body 1156 to the open position (shown in FIGS. 80 to 82) to move the clasp 1180 back in the direction 1178 away from the bottom portion 1162 to allow the clasp 1180 to move past the retaining surface 1196 in the receptacle 1194.

The lever body 1156 may be releasably held in the closed position (shown in FIG. 83) in different ways to keep the fin frame 1148 coupled to the boot toe body 1190. For example, as indicated above, a portion of the lever body 1156 may snap into, and be releasably held in, the recess 1169 of the connection body 1167. However, the connection body 1167 is only one example, and the lever body 1156 may be releasably held in the closed position in different ways that may, for example, include different snaps, retainers, clips, or combinations thereof, for example. Also, the boot coupling body 1146 may be configured so that, as the pivot 1184 moves around the pivot 1174 as the lever body 1156 is moved to the closed position, the movable connector body 1158 may be stretched and tension may be imparted to the movable connector body 1158, and the pivot 1184 may cross a straight line extending through the clasp 1180 and through the pivot 1174. Once the pivot 1184 moves around the pivot 1174 in the direction towards the closed position and crosses the straight line extending through the clasp 1180 and through the pivot 1174, tension imparted to the movable connector body 1158 as described above may tend to hold the lever body 1156 in the closed position.

Figure 85:
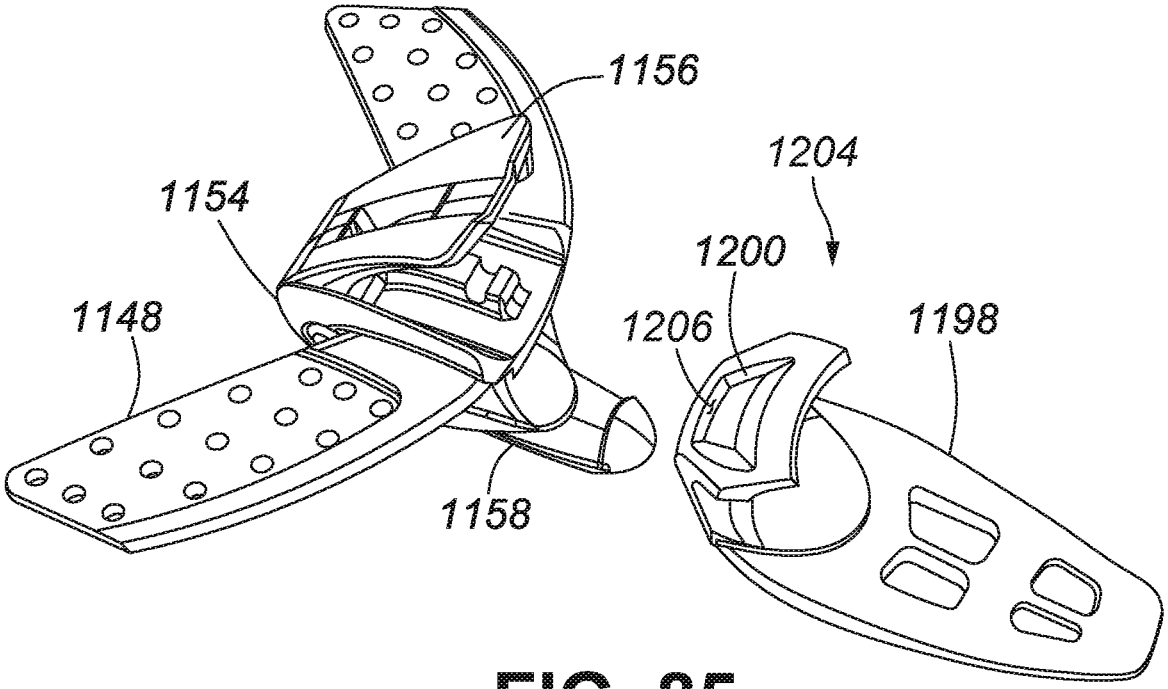
FIG. 85 is a top perspective view of the fin system of FIG. 78, showing a boot toe body according to another embodiment.
Figure 86:
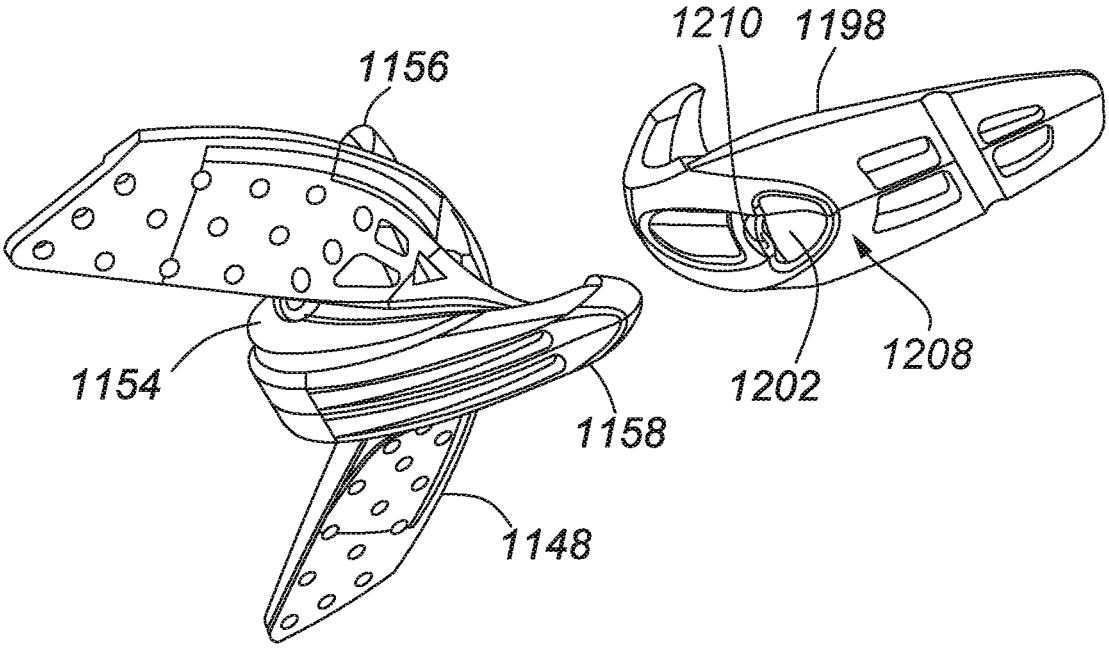
FIG. 86 is a bottom perspective view of the fin system of FIG. 78, showing the boot toe body of FIG. 85.

Referring to FIGS. 85 and 86, a boot toe body 1198 according to another embodiment is shown. On a top side shown generally at 1204, the boot toe body 1198 includes a receptacle 1200, which includes a retaining surface 1206 on the top side 1204 of the boot toe body 1198, and which functions as a connector (or as a first complementary boot connector) similar to the receptacle 148 as described above, for example. Also, on a bottom side shown generally at 1208, the boot toe body 1198 includes a receptacle 1202, which includes a retaining surface 1210 on the bottom side 1208 of the boot toe body 1198, and which functions as a connector (or as a second complementary boot connector) similar to the receptacle 150 as described above, for example, and the retaining surface 1210 is a retaining surface of the receptacle 1202, which is a second complementary boot connector.

The embodiments of FIGS. 78 to 86 are examples only, and other embodiments may differ. For example, alternative embodiments may include different fins or different fin frames such as those described herein. For example, in some embodiments, a fin, a fin frame, or both a fin and a fin frame may be attached to or part of the boot coupling body 1146 in different ways such as those described herein. Also, alternative embodiments may include different clasps or other connectors that may be movable in other ways. For example, alternative embodiments may include alternatives to the lever body 1156, which may include hinges that differ from the pivots 1174 and 1184, or that may omit hinges or differ in other ways. For example, alternatives to the lever body 1156 may be on different portions of a boot coupling body and may move in different directions or in different ways. As another example, alternative embodiments may include alternatives to the movable connector body 1158, and such alternatives may be movable in other ways and may be movably connected in other ways.

Further, in alternatives to the embodiments of FIGS. 78 to 86, a holder (or a holding body) on a top portion of a boot coupling body (such as the holder 1166, for example) may be movable, for example in response to movement of a lever body. In other words, the embodiments of FIGS. 78 to 86 may be reversed upside down so that a movable connector (movable as the clasp 1180 is movable as described above, for example) may be complementary to a connector on a top side of a boot toe body. Of course alternative embodiments may be varied in other ways, and may for example include more than one movable connector such as a movable connector (movable as the clasp 1180 is movable as described above, for example) complementary to a connector on a top side of a boot toe body and another movable connector (also movable as the clasp 1180 is movable as described above, for example) complementary to a connector on a bottom side of a boot toe body, for example.

Figure 87:
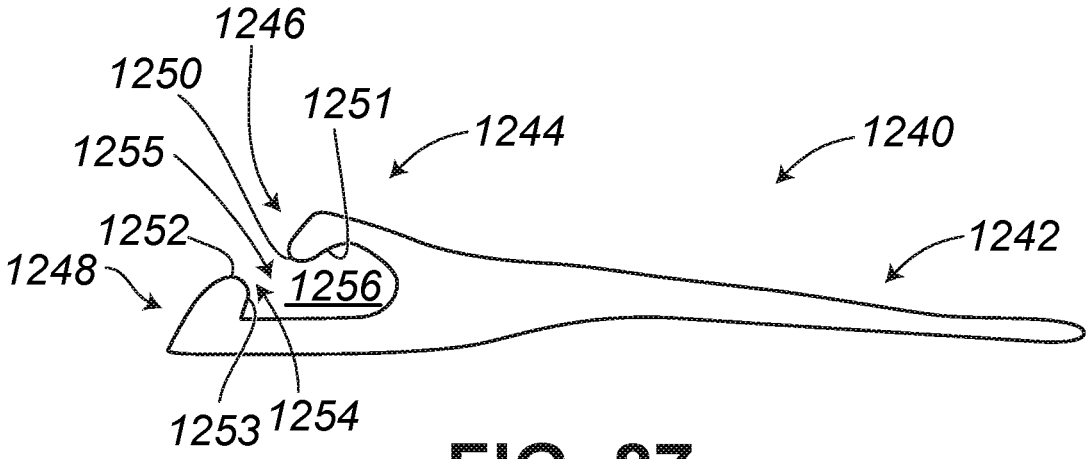
FIG. 87 is a side view of a fin apparatus according to another embodiment.

Referring to FIG. 87, a flipper (or fin apparatus) according to another embodiment is shown generally at 1240. The flipper 1240 has a fin (or fin body) shown generally at 1242 and a foot coupling portion (or boot coupling body) shown generally at 1244. The fin 1242 may be any fin usable to generate propulsion in water, including any one of the fins shown in FIGS. 1 to 35 and 40 to 42 of U.S. Pat. No. 9,737,762, for example.

The foot coupling portion 1244 has a first end (or top portion) shown generally at 1246 and a second end (or bottom portion) shown generally at 1248 opposite the first end 1246. The foot coupling portion 1244 defines a first inward projection 1250 on the first end (or top portion) 1246, and a second inward projection 1252 on the second end (or bottom portion) 1248. The first inward projection 1250 has a retaining surface (or a holding surface) 1251, and the second inward projection 1252 has a retaining surface 1253 on a top side shown generally at 1255 of the second end (or bottom portion) 1248 of the foot coupling portion (or boot coupling body) 1244. The first and second inward projections 1250 and 1252 are spaced apart by a gap shown generally at 1254, and the gap 1254 is an opening to a recess 1256 in the foot coupling portion 1244.

Figure 88:
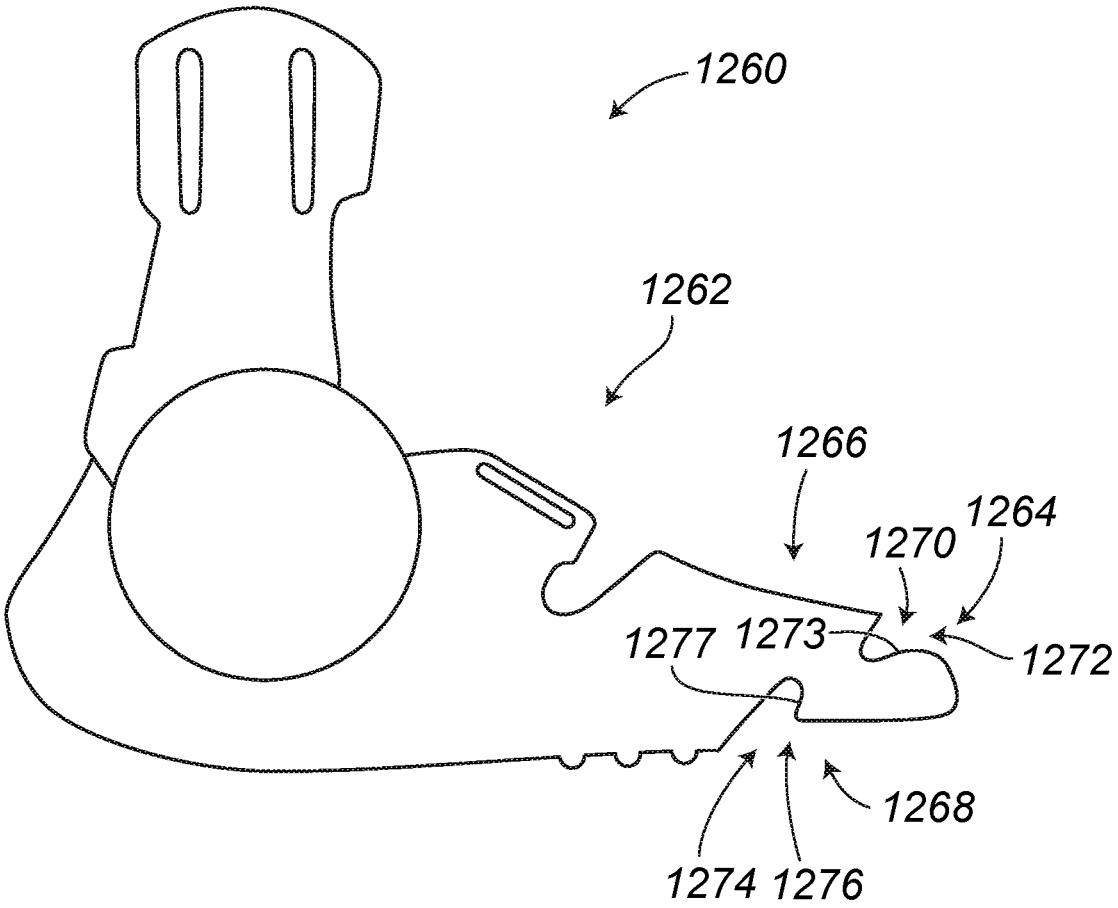
FIG. 88 is a side view of a boot shell according to another embodiment.

Referring to FIG. 88, a boot shell in accordance with another embodiment is shown generally at 1260. The boot shell 1260 is made from a relatively rigid thermoplastic material and includes a foot holding portion shown generally at 1262. The foot holding portion 1262 has a front end (or boot toe body) shown generally at 1264, and the front end 1264 has a top side shown generally at 1266 and a bottom side shown generally at 1268. In a first region shown generally at 1270 on the top side 1266 of the front end (or boot toe body) 1264 of the foot holding portion 1262, the boot shell 1260 defines a first receptacle shown generally at 1272 and complementary to the first inward projection 1250 of the flipper 1240 (shown in FIG. 87). The first receptacle 1272 includes a retaining surface 1273 on the top side 1270 of the front end (or boot toe body) 1264 and complementary to the retaining surface 1251. Also, in a second region shown generally at 1274 on the bottom side 1268 of the front end (or boot toe body) 1264 of the foot holding portion 1262, the boot shell 1260 defines a second receptacle shown generally at 1276 and complementary to the second inward projection 1252 of the flipper 1240 (shown in FIG. 87). The second receptacle 1276 includes a retaining surface 1277 complementary to the retaining surface 1253.

Figure 38:
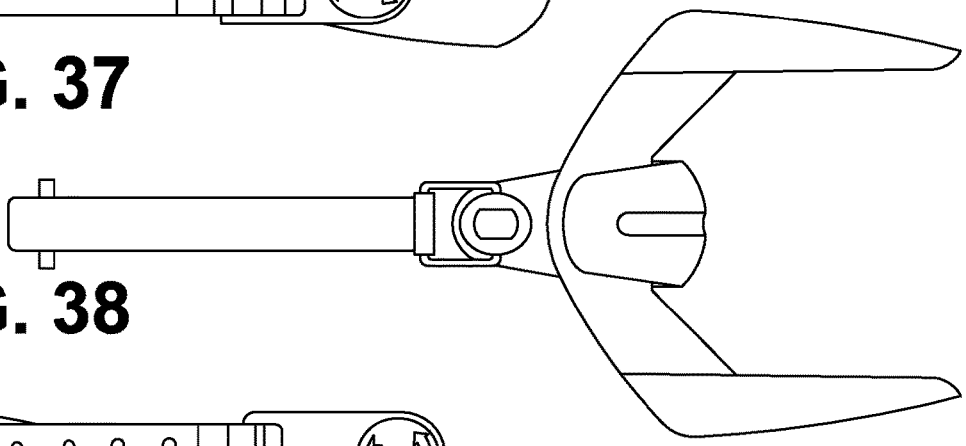
FIG. 38 is a bottom view of a boot coupling body and part of a fin body according to another embodiment.
Figure 39:
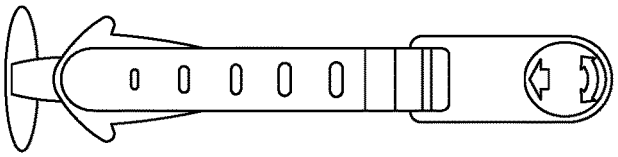
FIG. 39 is a bottom view of part of a boot coupling body according to another embodiment.

Referring to FIGS. 87 and 88, in operation, a user may insert a liner (such as the liner 1062 shown in FIG. 38 of U.S. Pat. No. 9,737,762, for example) in the boot shell 1260, and the user may connect the flipper 1240 to the boot shell 1260 by receiving the first inward projection 1250 in the first receptacle 1272 and by receiving the second inward projection 1252 in the second receptacle 1276. The first inward projection 1250 thus functions as a first boot connector, and the second inward projection 1252 thus functions as a second boot connector, although the first and second inward projections 1250 and 1252 may more generally be described as connectors, boot connectors, clasps, boot clasps, holders, and holding bodies for connecting the flipper 1240 to a boot including the boot shell 1260. Also, the first receptacle 1272 thus functions as a first complementary boot connector, and the second receptacle 1276 thus functions as a second complementary boot connector, although the first and second receptacles 1272 and 1276 may more generally be described as connectors, boot connectors, or complementary boot connectors for connecting the flipper 1240 to a boot including the boot shell 1260, and the retaining surface 1277 is a retaining surface of the second receptacle 1276, which is a second complementary boot connector. In the embodiment shown, the foot coupling portion 1244 is made from a relatively rigid but deformable thermoplastic material, so that the boot coupling portion 1244 may be temporarily deformed to connect the flipper 1240 to a boot including the boot shell 1260 as described above. Therefore, the first inward projection 1250 is a means for connecting the fin (or fin body) 1242 to the front end (or boot toe body) 1264 of the foot holding portion 1262 at a first complementary boot connector (the receptacle 1272) of the front end (or boot toe body) 1264 of the foot holding portion 1262 on the top side 1266 of the front end (or boot toe body) 1264 of the foot holding portion 1262, and the second inward projection 1252 is a means for connecting the fin (or fin body) 1242 to the front end (or boot toe body) 1264 of the foot holding portion 1262 at a second complementary boot connector (the receptacle 1276) of the front end (or boot toe body) 1264 of the foot holding portion 1262 on the bottom side 1268 of the front end (or boot toe body) 1264 of the foot holding portion 1262, the second inward projection 1252 including the retaining surface 1253 on the top side 1255 of the bottom portion 1248 of the boot coupling body 1244 for contacting the retaining surface 1277 of the second complementary boot connector (the receptacle 1276).

In general, the boot toe bodies such as those described herein for example may be molded into or otherwise temporarily or permanently coupled to boots (including other footwear or prosthetic limbs) to form boots that are connectable to fin apparatuses such as those described herein for example. Such boot toe bodies may be standardized and manufactured in one or in a small number of sizes, thereby possibly reducing manufacturing costs when compared to other boot binding systems, while boots such as the boots described herein may be manufactured by a number of manufactures in a large number of varieties that may vary by foot size and shape, by material, by ankle support, and in many other ways. Further, fin apparatuses such those described herein may also vary in many ways, such as in length, in width, in shape, in material, and in flexibility, for example. Nevertheless, such various boots and various fin apparatuses may be interchangeable where the boots include standardized boot toe bodies (such as the boot toe bodies described herein for example) and where the fin apparatuses are connectable to such boot toe bodies. Therefore, a user may interchange a variety of boots and/or a variety of fin apparatuses to form combinations of particular boots and particular fin apparatuses to suit particular purposes (for example, a boot suitable for cold water combined with a fin apparatus suitable for spear fishing, or a boot suitable for warm water combined with a fin apparatus suitable for snorkeling) without requiring entire fin systems to embody the desired features of both the boot and the fin apparatus. Further, as boots or fin apparatuses are improved over time, a user may upgrade only an improved boot or an improved fin apparatus, without requiring an entire fin apparatus to benefit from the upgrade. The boot toe bodies may thus function as interfaces between a human foot and a wide variety of fin apparatuses.

Various components of the embodiments described above may be varied or interchanged in alternative embodiments. For example, some or all of boot toe bodies of embodiments such as those described herein may, in alternative embodiments, be combined with some or all of fin bodies such as those described herein or with some or all of boot coupling bodies such as those described herein. As another example, connectors from some embodiments may, in alternative embodiments, be interchanged with connectors from other embodiments. For example, a toe connector from one embodiment may be combined with a heel connector from another embodiment. As another example, boots, other footgear, bodies coupled to boots, bodies coupled to other footgear, bodies configured to be coupled to boots, bodies configured to be coupled to other footgear, bodies configured to hold or be coupled directly or indirectly to a foot or to a prosthetic limb, for example all may, in alternative embodiments, be interchanged with each other. As such, where connection is shown to a boot, for example, similar connection in an alternative embodiment may be to other footgear, to a body coupled to a boot, to a body coupled to other footgear, to a body configured to be coupled to a boot, to a body configured to be coupled to other footgear, or to a body configured to hold or be coupled directly or indirectly to a foot or to a prosthetic limb. As still another example, various different fin apparatuses, fin frames, and fin bodies such as those described herein may, in alternative embodiments, be substituted for each other. Therefore, although specific embodiments have been described and illustrated, such embodiments should be considered illustrative only and not as limiting the invention as construed according to the accompanying claims.

The embodiments of the invention in which an exclusive property or privilege is claimed are defined as follows:

1. A method of coupling a boot toe body to a fin apparatus comprising a fin body coupled to a boot coupling body, the method comprising:

connecting a first boot connector on a top portion of the boot coupling body to a first complementary boot connector on a top side of the boot toe body; and connecting a second boot connector on a bottom portion of the boot coupling body to a second complementary boot connector on a bottom side of the boot toe body, wherein:

the second complementary boot connector comprises a retaining surface;

the second boot connector comprises a retaining surface on a top side of the bottom portion of the boot coupling body; and connecting the second boot connector to the second complementary boot connector comprises:

contacting the retaining surface on the top side of the bottom portion of the boot coupling body and the retaining surface of the second complementary boot connector; and retaining the second boot connector against movement in a direction towards the fin body.

2. A fin apparatus coupleable to a boot toe body, the fin apparatus comprising:

a fin body; and a boot coupling body comprising:

a top portion comprising a first boot connector for connecting with a first complementary boot connector on a top side of the boot toe body; and a bottom portion comprising a second boot connector for connecting with a second complementary boot connector on a bottom side of the boot toe body;

wherein the second boot connector comprises a retaining surface on a top side of the bottom portion of the boot coupling body for contacting a retaining surface of the second complementary boot connector; and wherein the retaining surface on the top side of the bottom portion of the boot coupling body is configured to retain the second boot connector against movement in a direction towards the fin body when the retaining surface on the top side of the bottom portion of the boot coupling body contacts the retaining surface of the second complementary boot connector.

3. The fin apparatus of claim 2 wherein the boot coupling body is coupleable to the fin body.

4. The fin apparatus of claim 2 wherein the boot coupling body is detachably coupleable to a fin frame detachably coupleable to the fin body.

5. The fin apparatus of claim 2 wherein the boot coupling body is detachably coupleable to a fin frame non-detachably coupled to the fin body.

6. The fin apparatus of claim 2 wherein the boot coupling body comprises a unitary body having the first and second boot connectors.

7. The fin apparatus of claim 2 wherein:

the boot coupling body is detachably coupleable to a fin frame;

the fin frame comprises a resiliently deformable fin frame retaining member comprising a fin retaining surface; and the boot coupling body defines a through-hole and a fin retaining surface complementary to the fin retaining surface of the fin frame retaining member such that, when the fin frame retaining member is received in the through-hole of the boot coupling body, the fin retaining surface of the fin frame retaining member is positionable against the complementary fin retaining surface of the boot coupling body to couple the fin frame detachably to the boot coupling body.

8. The fin apparatus of claim 2 wherein:

the boot coupling body is detachably coupleable to a fin frame;

the boot coupling body comprises a first fin connector and a second fin connector; and the fin frame comprises:

a first complementary fin connector complementary to the first fin connector of the boot coupling body; and a second complementary fin connector complementary to the second fin connector of the boot coupling body.

9. The fin apparatus of claim 2 wherein the boot coupling body comprises two or more bodies detachably coupleable together.

10. The fin apparatus of claim 2 wherein the boot coupling body comprises a fin frame detachably coupleable to the fin body.

11. The fin apparatus of claim 2 wherein the boot coupling body comprises a fin frame non-detachably coupled to the fin body.

12. The fin apparatus of claim 2 wherein the boot coupling body comprises a fin frame, and wherein the first boot connector is on the fin frame.

13. The fin apparatus of claim 2 wherein the second boot connector is on a coupling body detachably coupleable to a fin frame coupleable or coupled to the fin body.

14. The fin apparatus of claim 13 wherein:

the fin frame comprises a resiliently deformable fin frame retaining member comprising a fin retaining surface; and the coupling body defines a through-hole and a fin retaining surface complementary to the fin retaining surface of the fin frame retaining member such that, when the fin frame retaining member is received in the through-hole of the coupling body, the fin retaining surface of the fin frame retaining member is positionable against the complementary fin retaining surface of the coupling body to couple the fin frame detachably to the coupling body.

15. The fin apparatus of claim 13, wherein:

the coupling body comprises a first fin connector and a second fin connector; and the fin frame comprises:

a first complementary fin connector complementary to the first fin connector of the coupling body; and a second complementary fin connector complementary to the second fin connector of the coupling body.

16. The fin apparatus of claim 8 wherein the first fin connector comprises a fin receptacle sized to receive the first complementary fin connector, and wherein the fin receptacle defines at least one fin retaining surface positioned to restrict movement of the fin frame relative to the first fin connector when the first complementary fin connector is received in the fin receptacle.

17. The fin apparatus of claim 15 wherein the first fin connector comprises a fin receptacle sized to receive the first complementary fin connector, and wherein the fin receptacle defines at least one fin retaining surface positioned to restrict movement of the fin frame relative to the first fin connector when the first complementary fin connector is received in the fin receptacle.

18. The fin apparatus of claim 8 wherein the second fin connector comprises a fin clasp comprising a fin retaining surface positionable against the second complementary fin connector to restrict movement of the fin frame relative to the second fin connector when the second complementary fin connector is positioned against the fin clasp and when the fin clasp is in a retaining position, and wherein the fin clasp is moveable into a releasing position to allow movement of the fin frame relative to the second fin connector.

19. The fin apparatus of claim 15 wherein the second fin connector comprises a fin clasp comprising a fin retaining surface positionable against the second complementary fin connector to restrict movement of the fin frame relative to the second fin connector when the second complementary fin connector is positioned against the fin clasp and when the fin clasp is in a retaining position, and wherein the fin clasp is moveable into a releasing position to allow movement of the fin frame relative to the second fin connector.

20. The fin apparatus of claim 2 wherein:

the first boot connector comprises a holding body having a holding surface positionable against a retaining surface on the top side of the boot toe body; and the second boot connector comprises a boot clasp comprising the retaining surface on the top side of the bottom portion of the boot coupling body.

21. The fin apparatus of claim 20 wherein the holding body is configured to be retained against movement in a direction towards the fin body when the holding surface is positioned against the retaining surface on the top side of the boot toe body.

22. The fin apparatus of claim 2 further comprising the boot toe body.

23. The fin apparatus of claim 20 wherein the boot clasp comprises a roller positionable against the retaining surface of the second complementary boot connector.

24. The fin apparatus of claim 20 wherein the boot clasp is rotatable about an axis of rotation extending between the top and bottom sides of the boot toe body to connect the second boot connector to the second complementary boot connector.

25. The fin apparatus of claim 24 wherein the axis of rotation is angled to cause the boot clasp to move in a direction away from the top side of the boot toe body when the boot clasp is rotated about the axis of rotation to connect the second boot connector to the second complementary boot connector.

26. The fin apparatus of claim 20 wherein:

the holding body is receivable in a first receptacle on the top side of the boot toe body; and the boot clasp is receivable in a second receptacle on the bottom side of the boot toe body.

27. The fin apparatus of claim 20 further comprising a lever operable to transfer a force to the second boot connector in a direction away from the bottom side of the boot toe body to cause the boot clasp to lose contact with the retaining surface of the second complementary boot connector.

28. The fin apparatus of claim 24 wherein the boot clasp is shaped to lose contact with the retaining surface of the second complementary boot connector in response to rotation of the boot clasp about the axis of rotation.

29. The fin apparatus of claim 28 wherein the axis of rotation is angled to cause the boot clasp to move in a direction towards from the top side of the boot toe body when the boot clasp is rotated about the axis of rotation to decouple the boot toe body from the fin apparatus.

30. The fin apparatus of claim 2 wherein the boot coupling body is resiliently deformable to increase a separation distance between the first and second boot connectors.

31. The fin apparatus of claim 30 wherein the boot coupling body comprises a resilient body unattached to the second boot connector and resiliently deformable to increase the separation distance between the first and second boot connectors.

32. The fin apparatus of claim 30 wherein the second boot connector is resiliently deformable to increase the separation distance between the first and second boot connectors.

33. The fin apparatus of claim 32 wherein the boot coupling body comprises a resiliently deformable spring having the second boot connector.

34. The fin apparatus of claim 3 further comprising a fastener for coupling the boot coupling body to the fin body.

35. The fin apparatus of claim 2 further comprising a third boot connector for connecting with a third complementary boot connector on a heel end of a boot coupled to the boot toe body.

36. The fin apparatus of claim 35 wherein a distance separating the third boot connector from the first and second boot connectors is adjustable.

37. The fin apparatus of claim 36 further comprising:

a strap extending from the first and second boot connectors to the third boot connector;

a heel connector body comprising the third boot connector; and a fastener for fastening the heel connector body to the strap at a desired distance from the first and second boot connectors.

38. The fin apparatus of claim 35 wherein the third boot connector comprises a holding body receivable in a receptacle on the heel end of the boot and comprising a holding surface positionable on a retaining surface on the heel end of the boot.

39. The fin apparatus of claim 38 further comprising a wedge positionable to be wedged in the receptacle on the heel end of the boot to urge the third boot connector against the retaining surface on the heel end of the boot.

40. The fin apparatus of claim 38 wherein the third boot connector is configured to be resiliently deformed in response to positioning the holding surface on the third boot connector against the retaining surface on the heel end of the boot.

41. The fin apparatus of claim 40 wherein the third boot connector is configured to be resiliently deformed by varying a separation distance between first and second hinges on the third boot connector in response to movement of the third boot connector around the first hinge.

42. The fin apparatus of claim 41 wherein the third boot connector is configured to vary the separation distance between the first and second hinges on the third boot connector in response to the movement of the third boot connector around the first hinge by causing a connector connected to the second hinge to move around a third hinge on the boot and spaced apart from the first hinge.

43. The fin apparatus of claim 40 wherein the third boot connector is configured to cause a resilient force caused by resilient deformation of the third boot connector to retain the holding surface on the third boot connector against the retaining surface on the heel end of the boot.

44. The fin apparatus of claim 35 further comprising a fourth boot connector on the boot coupling body for connecting with a fourth complementary boot connector on the heel end of the boot.

45. The fin apparatus of claim 44 wherein the fourth boot connector comprises a retaining surface receivable in a receptacle of the fourth complementary boot connector.

46. The fin apparatus of claim 45 wherein the receptacle of the fourth complementary boot connector defines at least one retaining surface positioned to restrict movement of the fourth boot connector relative to the boot when the retaining surface on the fourth boot connector is received in the receptacle of the fourth complementary boot connector.

47. The fin apparatus of claim 24 further comprising a third boot connector for connecting with a third complementary boot connector on a heel end of a boot coupled to the boot toe body, wherein the third boot connector is rotatably coupled to the second boot connector for rotation about the axis of rotation.

48. The fin apparatus of claim 2 further comprising first and second projections positionable between laterally opposite sides of the fin apparatus and corresponding laterally opposite sides of the boot toe body when the fin apparatus is coupled to the boot toe body.

49. The fin apparatus of claim 48 wherein the first and second projections are resiliently deformable.

50. The fin apparatus of claim 2 further comprising at least one resiliently compressible dampening member positioned between the boot toe body and the fin apparatus when the fin apparatus is coupled to the boot toe body to dampen movement of the boot toe body relative to the fin apparatus.

51. The fin apparatus of claim 2 wherein:

the boot coupling body comprises first and second ends;

the first boot connector is on the first end of the boot coupling body; and the second boot connector is on the second end of the boot coupling body.

52. The fin apparatus of claim 2 wherein at least one of the first boot connector and the second boot connector is movable relative to the fin body towards and away from the fin body.

53. The fin apparatus of claim 52 further comprising at least one lever configured to move the at least one of the first boot connector and the second boot connector relative to the fin body towards and away from the fin body.

54. A fin apparatus coupleable to a boot toe body, the fin apparatus comprising:

a fin body; and a boot coupling body comprising:

a top portion comprising a means for connecting the fin body to the boot toe body at a first complementary boot connector of the boot toe body on a top side of the boot toe body; and a bottom portion comprising a means for connecting the fin body to the boot toe body at a second complementary boot connector of the boot toe body on a bottom side of the boot toe body, wherein the means for connecting the fin body to the boot toe body at the second complementary boot connector of the boot toe body comprises a retaining surface on a top side of the bottom portion of the boot coupling body for contacting a retaining surface of the second complementary boot connector.

* * * * *